United States Patent [19]

Papamichalis et al.

[11] Patent Number: 4,536,886

[45] Date of Patent: Aug. 20, 1985

[54] LPC POLE ENCODING USING REDUCED SPECTRAL SHAPING POLYNOMIAL

[75] Inventors: Panos E. Papamichalis; George R. Doddington, both of Richardson, Tex.

[73] Assignee: Texas Instruments Incorporated, Dallas, Tex.

[21] Appl. No.: 373,959

[22] Filed: May 3, 1982

[51] Int. Cl.[3] ..... G10L 1/00

[52] U.S. Cl. ..... 381/41; 364/513.5

[58] Field of Search ..... 381/41–53; 364/513.5

[56] References Cited

U.S. PATENT DOCUMENTS

| | | | |
|---|---|---|---|
| 4,045,616 | 8/1977 | Sloane | 381/41 |
| 4,184,049 | 1/1980 | Crochiere et al. | 381/41 |
| 4,340,781 | 7/1982 | Ichikawa et al. | 381/41 |
| 4,378,469 | 3/1983 | Fette | 381/41 |
| 4,393,272 | 7/1983 | Itakura et al. . | |

*Primary Examiner*—E. S. Matt Kemeny

*Attorney, Agent, or Firm*—Robert O. Groover, III; Douglas A. Sorensen; James T. Comfort

[57] ABSTRACT

Pole encoding of a linear predictive all-pole model of speech is accomplished by first finding poles up to the number required for good prediction (e.g., ten). These poles are extracted from the LPC predictor polynomial, using, e.g., a slightly modified Bairstow method. Those poles having a sufficiently narrow bandwidth (i.e., those sufficiently near the unit circle) are separately encoded, since these poles generally correspond to perceptually important formants. The remaining poles are lumped together to form a residual polynomial. The residual polynomial is then transformed to produce reflection coefficients, and all reflection coefficients above the first two are discarded. This provides an efficient spectral-shaping polynomial of a reduced degree. Thus, pole encoding is made possible using a reduced and adaptively varied bit rate.

11 Claims, 3 Drawing Figures

LPC POLE ENCODING USING REDUCED SPECTRAL SHAPING POLYNOMIAL

BACKGROUND OF THE INVENTION

The present invention relates to method and apparatus for encoding speech signals.

It is highly desirable to be able to store and transmit speech signals using a reduced bandwidth. For example, if 8000 Hz of a speech signal is sampled at the Nyquist rate with 12-bit accuracy, the resulting data rate required is almost 200 kilobits per second of speech. Since the actual information content of speech is far smaller than this, it is extremely desirable to reduce the data rate required to encode speech down to something closer to the actual information content as received by a human listener. Such compressed speech coding has three principal areas of application, each of major importance: synthetic speech, transmission of spoken messages, and speech recognition.

A principal area of efforts to accomplish this end has been linear predictive coding of speech. In the general linear prediction model, a signal $s_n$ is considered to be the output of a system with an input $u_n$ such that the following relation hold:

$$S_n = -\sum_{k=1}^{p} a_k s_{n-k} + G \sum_{m=0}^{q} b_m u_{n-m}, \tag{1}$$

where $b_0$ is defined as one, and $a_k$ (k ranging over integers between 1 and p inclusive), and $b_m$ (m ranging over integers between 1 and q inclusive), and the gain G are the parameters of the hypothesized system. Since the signal $s_n$ is modeled as a linear function of past outputs and present and past inputs, linear prediction from these outputs and inputs specifies the value of $s_n$.

A slightly simplified version of this model, which is much more tractable, is the autoregressive or all-pole model. In this model, the signal $s_n$ is assumed to be a linear combination of past values and of a single input value $u_n$:

$$S_n = -\sum_{k=1}^{p} a_k S_{n-k} + G u_n, \tag{2}$$

where G is a gain factor.

By taking the z transform of both sides of this equation, the system transfer function H(z) is $$H(z) = \frac{G}{1 + \sum_{k=1}^{p} a_k z^{-k}} \tag{3}$$

Given a particular signal sequence $s_n$, analysis according to this model requires that the predictor coefficients $a_k$ and the gain G be determined in some manner.

In the model of human speech upon which the present invention is based, the human voice is modeled as a combination of an excitation function with a linear predictive filter. Once the system has been analyzed according to this fashion, the excitation function can normally be transmitted at quite a low bit rate. However, the present invention is not directed to excitation function modeling, and conventional modeling, analysis, and encoding methods are used for this aspect. See generally Rabmer & Schafer, *Digital Processing of Speech Signals* (1978). Markel & Gray, *Linear Prediction of Speech* (1976); Atal et al, "Speech Analysis and Synthesis by Linear Prediction of the Speech Wave", 50 Journal of the Acoustical Society of America 637 (1971); Makharl "Linear Prediction: A Tutorial Review", 63 Proceedings IEEE p. 561 (1975); all of which are hereby incorporated by reference. Pitch and gain energy are commonly used as a minimum set of excitation parameters.

To represent speech in accordance with the LPC model, the predictor coefficients $a_k$, or some equivalent set of parameters, must be transmitted so that the linear predictive model can be used to resynthesize the speech signal at the receiver. In the prior art, reflection coefficients have often been used as the transmitted parameters. The desirable features to be selected for, in deciding which set of parameters is to be transmitted to permit resynthesis of speech according to the LPC model, include: 1. The synthesized filter should be guaranteed stable. 2. The parameters transmitted should preferably correspond fairly closely to perceptual parameters, to permit perceptually efficient use of bandwidth. 3. A minimum computational load should be imposed, at both transmitting and (especially) receiving ends. 4. Preferably the parameters should have a natural ordering, so that an efficiently reduced set of parameters can be obtained by truncation.

Thus is an object of the present invention to provide a method for encoding speech according to the linear predictive coding model, such that the stability of the LPC filter is guaranteed, at minimum bit rate.

It is a further object of the present invention to provide a method for encoding speech parameters in accordance with the linear predictive coding model, such that the encoded parameters correspond closely to perceptual parameters and require minimum bit rate.

It is a further object of the present invention to provide a method for encoding speech for synthesis according to the linear predictive coding model at minimum bit rate, such that a minimium computational load is required to regenerate the encoded speech.

BRIEF DESCRIPTION OF THE DRAWINGS

The present invention will be described with reference to the accompanying drawings, wherein.

DESCRIPTION OF THE PREFERRED EMBODIMENTS

Figure 1:
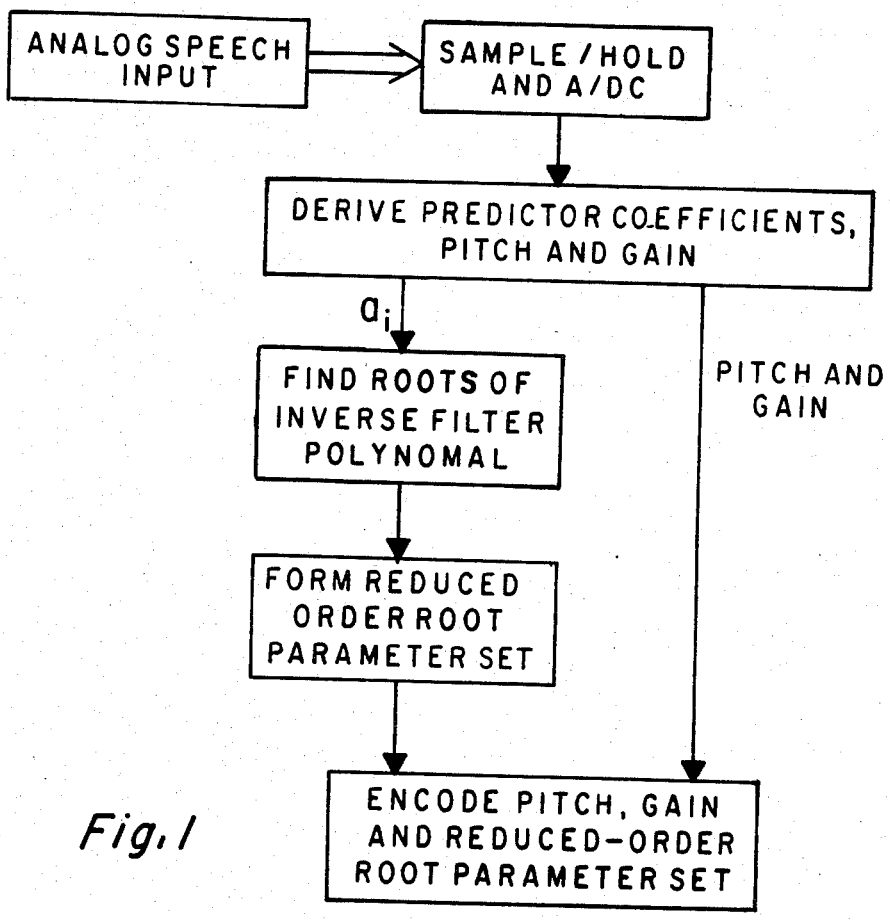
FIG. 1 shows generally the sequence of steps used in practicing the method of the present invention for encoding speech.
Figure 2:
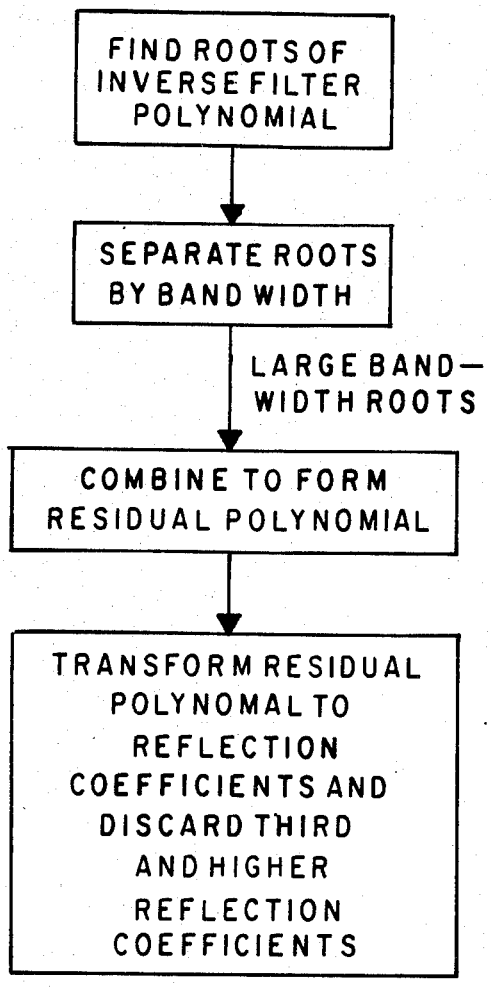
FIG. 2 shows the sequence of steps required to reduce the number of parameters required for good-quality encoding of LPC poles.
Figure 3:
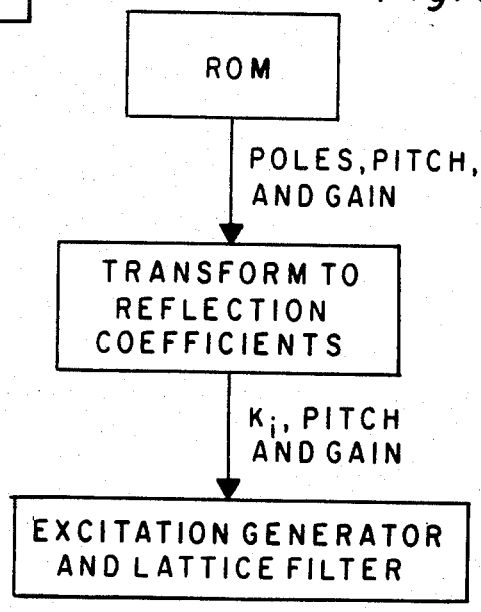
FIG. 3 shows generally the structure of a terminal used to synthesize speech encoded according to the present invention.

The present invention teaches encoding of speech, in the LPC model, by means of poles. Since the poles correspond fairly directly to formants, the poles are a perceptually efficient set of parameters to encode. Moreover, transmission of poles guarantees a stable resynthesized filter. The possibility of pole encoding has been discussed in the prior art, but the present invention teaches a novel method of pole coding which provides major advantages and incorporates a number of novel features.

In the present invention, a bandwidth threshold is used to select those poles which have a narrow bandwidth (i.e., high-Q poles) and all other poles are approximated by a single spectral shaping polynomial of fixed order, preferably of order two. Thus, the variable number of formants which occurs in actual speech is well approximated by a varying number of encoded poles, and great computational efficiency is preserved.

Reflection coefficients $k_i$ have been preferred in the past, since they alone among possible LPC filter parameters both guarantee filter stability and have a natural ordering. A natural ordering of the transmitted parameters permits the use of entropy coding (a coding method where the codeword length varies from parameter to parameter, so that the more frequently occurring parameters are assigned shorter codewords). for lower average bit rates. The only other set of equivalent parameters which guarantees the stability of the filter are the poles of the transfer function H(z). Unfortunately, the poles of H(z) do not have a natural ordering. Besides this lack of natural ordering, another reason why pole encoding in the prior art has not been more extensively considered is that finding the roots of a tenth or higher order polynomial is computationally very expensive. Thus, to obtain the formant structure of the speech spectrum, peak-picking methods have typically been used (i.e., direct comparison of amplitudes in the frequency domain), although this has great difficulties when formants merge or diverge, and does not facilitate adaptation to the variable number of formants.

A sample embodiment of the present invention proceeds as follows. First, a raw speech input is sampled at eight kilohertz and is represented by a tenth order LPC model. (A higher order LPC model can of course be alternatively used.) The all-pole model is now computed, according to equation (3), to produce estimations of the filter coefficients $a_i$ in the inverse filter polynomial $$A(z) = H \sum_{k=1}^{p} a_k z^{-k} \tag{4}$$

These filter coefficients $a_k$ are computed as follows. The autocorrelation function R(i) is defined as $$R(i) = \sum_{n=-\infty}^{\infty} S_n S_{n+i} \tag{5}$$

(In practice, since the autocorrelation is only computed over a finite interval, a window function may be used to restrict the range of computation of this function to the desired practical limit.)

The result of the foregoing prior art operations is the complete set of P (e.g. ten) filter coefficients $a_k$. The present invention now proceeds to find the poles of the transfer function H(z), which are the roots of the polynomial A(z). A modification of the Bairstow root-finding method is preferably used to accomplish this.

When a function is known in the complex plane, the Bairstow method may be used to find the roots. (See for example Hildebrand, Introduction to Numerical Analysis, McGraw Hill, 2nd Edition, 1956, pp. 613–617). The present invention introduces four innovations into the conventional Bairstow method, which provide greater efficiency in the context of the present speech problem. The preceding prior art steps have defined the function A(z) as a function of a complex variable z. The next step in the method of the present invention is to find the zeros of this complex function. Five equally spaced points are first defined on the top half of the unit circle (in the complex plane of the independent variable z). The Bairstow root-finding method is performed to 100 iterations on each initial guess. If no convergence is found within 100 iterations, the next starting point on the unit half circle is chosen, and the modified Bairstow method is started again. However, if a zero is found, the function A(z) may now reduced. That is, whenever a root r is found, the function $(1-rz^{-1})$ is necessarily a factor of the polynomial. Moreover, since all the filter coefficients $a_k$ are real, all the complex roots of the inverse filter polynomial A(z) will come in conjugate pairs. That is, if a complex root r exists, a quadratic factor $1+(r+r^*)z^{-1}+|r|^2z^{-2}$ may be factored out of the polynomial, where $r^*$ represents the complex conjugate of r. Once a root has been found, the reduced polynomial A'(z) (that is, the remainder polynomial after the quadratic factor corresponding to the just-found root has been factored out of the polynomial A(z)) is then calculated, and the modified root-finding method just discussed is begun over again.

Moreover, several other novel features have been introduced in the Bairstow root-finding algorithm method itself, to better adapt it to the needs of the present invention. First, the prior art normally teaches a percentage convergence test, to ascertain whether the successive guesses generated by the Bairstow method are converging on a root. However, in the present invention, since it is known that all roots are within the unit circle (because the filter is guaranteed stable), each quadratic factor corresponding to a desired root may be represented as $z^{-2}+F_1z^{-1}+F_2$ where $F_1$ equals twice the real part of the root, and $F_2$ equals the square of the absolute value of the root. Thus, $F_1$ necessarily has a magnitude less than two, and $F_2$ necessarily has a magnitude less than 1. In the present invention, the successive estimates of these values are subjected to an absolute convergence test, e.g. a total change of less than one over one million in the two parameters combined. Second, since we know that all roots of interest are within the unit circle, the maximum step size is limited preferably to one. Third, to prevent oscillation, a damping factor is applied: if the successive differences between successive estimates of either $F_1$ or $F_2$ change sign, the later difference in successive guesses is damped by (e.g.) 20%. That is, if successive guesses generated by the Bairstow method are $F_1$, $F_1+a$, and $F_1+a-b$, where a and b are both positive, the last guess is corrected to $F_1+a-(0.8\times b)$.

Repetition of the foregoing steps provides all roots of the polynomial A(z). A further innovative step in the present invention is then applied. In speech coding, the narrow-bandwidth poles correspond to the perceptually important formants. However, since the set of formants is very often less than four, and may be none at all, a variety of wide-bandwidth poles (i.e., roots of the polynomial A(z) which lie close to the origin) will typically also be found. These poles are only important for spectral shaping. A key innovation of the present invention is to approximate all of these wide-bandwidth poles with a single reduced order (preferably second order) spectral shaping polynomial. This is accomplished as follows.

First, a bandwidth threshold is imposed. 300 Hz has been empirically determined as a desirable bandwidth threshold, since formants will typically have a threshold substantially less than this. Alternative constant values for the bandwidth threshold may alternatively be selected, but a threshold in the neighborhood of 200 to 700 Hz is believed to be most desirable. A bandwidth of 300 Hz corresponds to an amplitude value of 0.889. Phase and amplitude of the root values are transformed, to minimize the effect of quantization error, as discussed below.

Thus, the bandwidth limitation is used to segregate the roots of the polynomial A(z) into four or fewer formant factors $(1+(r_i+r_i^*)z^{-1}+|r_i|^2z^{-2})$, plus a residual polynomial A'. That is, the polynomial A(z) is now expressed as follows:

$$A(z)=\pi(1+(r_i+r_i^*)z^{-1}+|r_i|^2z^{-2})A'(z) \quad (6)$$

where A'(z) is a residual polynomial, having a degree between 2 and 10, which represents all the broad-bandwidth (spectral shaping) poles, together with the real roots if any.

The next cirtical step in the present invention is to efficiently approximate the residual polynomial A'(z) by means of a reduced residual polynomial A''(z). This is done by exploiting the natural ordering of reflection coefficients $k_i$, as discussed above. First, the residual polynomial A'(z) is transformed into a reflection coefficient representation. This is preferably done, by the following (prior art) recursive procedure. (The parameter i is used here as a recursion parameter, which is initially set equal to q, and gradually decremented down to one.) First, (for each i) $k_i$ is set equal to $a_{i,i}$, where $a_{q,k}$ is defined as the coefficient $a_k$ of the qth order residual polynomial A'(z). Next, a reduced set of coefficients is derived as follows:

$$a_{i-1,j}=\frac{a_{i,j}-k_ia_{i,i-j}}{1-k_i^2}, \text{ for } j=1,\ldots i-1. \quad (7)$$

The parameter i is then decremented, and the above cycle is repeated, until i=1. The result of this is a complete set of reflection coefficients, $k_1, \ldots k_q$, which represent the residual polynomial A'(z).

The natural ordering of the reflection coefficients $k_i$ is now exploited to obtain a minimal and efficient reduced (second order) residual polynomial A''(z). This is done simply by discarding all the $k_i$ after $k_1$ and $k_2$. The $a_k$s corresponding to the reduced residual polynomial A''(z) are now regenerated by the simple formula $a_0=-1, a_1=k_1(1+k_2), a_2=k_2$. Thus, all of the residual wide-bandwidth poles are efficiently approximated by a single reduced residual polynomial A''(z).

Thus, efficient coding of speech according to an LPC model is now permitted. In combination with the required coding of the excitation function (typically pitch and gain are encoded), the present invention permits the transfer function H(z) of the LPC filter to be encoded as follows: two bits are used to indicate the number of poles currently separately being transmitted; a phase and amplitude value are encoded for each of the (four or fewer) narrow-bandwidth poles; and first and second reflection coefficients are encoded to represent the reduced residual polynomial.

A further transformation of these parameters may be used to minimize the perceptual impact of quantization error. That is, when these quantities are digital encoded for transmission, the perceptual importance of a least-significant-bit error in any parameter should be approximately the same. To accomplish this, the parameters derived are preferably transformed as follows: The phase (of poles in the complex plane) $\theta$: is transformed to Mel-center frequency:

$$MCF_i = 20\log_{10}\left(1+\frac{CF_i}{1000}\right), \; CF_i=\frac{\theta_i f_s}{2\pi},$$

where $f_s$ equals the sampling frequency. The amplitude $r_i$ of each root is transformed to bandwidth $$BW_i = -\frac{f_s \ln r_i}{\pi}$$

or alternatively to log-amplitude $A_i=20\log_{10}(1-r_i)$. The reflection coefficients $k_i$ are preferably encoded as the logarithms of the respective area ratios. Empirical probability distributions of these parameters are optionally used to permit more efficient coding.

Thus, the present invention requires the following apparatus: means for sampling a speech signal; means for defining an LPC inverse filter polynomial corresponding to said speech signal; means for finding the roots of said inverse filter polynomial; means for encoding all of said roots of said inverse filter polynomial which have bandwidth greater than a threshold bandwidth; means for multiplying together roots of said inverse filter polynomial which do not have a bandwidth greater than said threshold bandwidth, to produce a residual polynomial; means for defining reflection coefficients corresponding to said residual polynomial; means for encoding parameters corresponding to a truncated set of said reflection coefficients of said residual polynomial. In the presently preferred embodiment of the invention, the sampling means is embodied in a conventional A/D converter and sample-and-hold circuit, and all the other said means are embodied in a VAX 11/780 computer. A listing of sample programming for a VAX computer is appended.

The present invention is applicable not only to real-time speech communication but also to packet speech communication and to stored sythetic speech. At the receiver, the pole parameters are reconverted to reflection coefficients, permitting LPC synthesis of speech in accordance with these parameters and the pitch and gain.

```
      SUBROUTINE LGND_FIT (YIN, N, LGND, MAXFIT, SQERTHR, SQERROR, AMIN,
     1                                                   AMAX, COEF, YOUT)
C
C.....................................................................
C     Subroutine to compute an estimate (in the least-square-error
C     sense) of the sampled function represented by the vector YIN.
C     The estimate is of the form :
C
C     YOUT(i) = COEF(1) * LEGENDRE(1, X(i)) + ... +
C                                     COEF(LGND) * LEGENDRE(LGND, X(i))
C
C     for the i-th point, where -1 .LE. X(i) .LE. 1, LGND .LE. 40,
C     and LEGENDRE (i, x) is the Legendre polynomial of order i-1,
C     evaluated at the point x.
C
C     YIN : (R*4) Input vector of N function samples
C     N : (I*2) Dimension of YIN, YOUT.
C     LGND-1 : (I*2) Max order for Legendre polynomials.
C             (Input if SQERTHR .LE. -10;  Output otherwise.)
C     MAXFIT : (I*2)(Input) Maximum permissible order of fit.
C     SQERTHR: (R*4) LGND is selected so that SQERROR .LE. SQERTHR.  If
C             -10.LT.SQERTHR.LE.0, LGND is determined from N only. (Input)
C     SQERROR: (R*4) Average square error of the curve fitting. (Output)
C     AMIN, AMAX : (R*4) Min, max permissible values for YOUT (Input).
C     COEF : (R*4) Output array of LGND coefficients for Legendre polyn.
C     YOUT : (R*4) Output vector of N samples.
C
C     NOTE :: This subroutine calls the subroutine IFLSQ of the IMSLibrary
C.....................................................................
C

      DIMENSION YIN(1), COEF(1), YOUT(1)
      INTEGER*2 N, LGND, MAXFIT
      DIMENSION X(1024), WK(1024)

      IF (AMIN .GE. AMAX) STOP ' AMIN > AMAX (in LGND_FIT)'
      IF (N .LT. 2) THEN
              TYPE *,'>>>Too few points for curve fitting: NPTS =',N
              RETURN
      ELSE IF (N .GT. 1024) THEN
              TYPE *,'>>>Too many points for curve fitting: NPTS =',N
              RETURN
      END IF

      IF (0 .LT. SQERTHR) LGND = 1
      IF (-10.LT.SQERTHR .AND. SQERTHR.LE.0) LGND = (N-1) / 5 + 2
      DO 120 I=1,N
120   X(I) = -1. + 2. * (I-1.) / (N-1.)

140   CALL ORTHPOL1 (X, YIN, N, LGND, COEF, WK)

      SQERROR = 0.
      DO J=1,N
              SQERROR = SQERROR + WK(J)**2
      END DO
      SQERROR = SQERROR / FLOAT(N)

      IF (SQERTHR .GT. 0) THEN
              IF (SQERROR .GT. SQERTHR) THEN
                      IF (LGND.EQ.MAXFIT .OR. LGND.EQ.N) GO TO 160
                      LGND = LGND + 1
                      IF (LGND .GT. 40) STOP '*** LGND > 40 ***'
                      GO TO 140
              END IF
      END IF
```

```
160     CALL ORTHPOL2 (COEF, X, LGND, N, YOUT)
        DO I = 1,N
                IF (YOUT(I) .LT. AMIN) YOUT(I) = AMIN
                IF (YOUT(I) .GT. AMAX) YOUT(I) = AMAX
        END DO

        RETURN
        END

C       SUBROUTINES ORTHPOL
C
C*********************************************************************
C       Subroutine ORTHPOL1 fits a linear combination of orthogonal
C       polynomials to a discrete set of points in the least square error
C       sense.  The outputs are the the coefficients of the linear
C       combination and the error array.  This subroutine is basically
C       copied from 'Elementary Numerical Analysis' by Conte and de Boor,
C       pp. 260-261.
C
C       Subroutine ORTHPOL2 determines from the coefficients of a linear
C       combination of orhogonal polynomials the data values on the fitted
C       curve.
C*********************************************************************
C
        SUBROUTINE ORTHPOL1 (XIN, YIN, NPTS, NORDER, COEF, ERR)
C
C
C       XIN:   (R*4) Input array of the data points' abscissae.
C       YIN:   (R*4) Output array of the data points' ordinates.
C       NPTS:  (I*2) Number of data points (Dimen. of XIN and YIN)
C       NORDER: (I*2) Order of the linear combination. (>=1)
C       COEF:  (R*4) Output array of linear combin. coefficients.
C       ERR:   (R*4) Output array of errors YIN - FIT, where FIT represents
C                        the fitted value.
C
        INTEGER*2 NPTS, NORDER
        DIMENSION XIN(NPTS), YIN(NPTS), COEF(NORDER), ERR(NPTS)
        DIMENSION FIT(NPTS)
        DIMENSION B(40), C(40), S(40), PJM1(100), PJ(100)


        NORDER = MIN (NORDER, NPTS)
        DO 100 J=1,NORDER
                B(J) = 0.
                S(J) = 0.
                COEF(J) = 0.
100     CONTINUE
        C(1) = 0.
        DO 120 I=1,NPTS
                COEF(1) = COEF(1) + YIN(I)
                B(1) = B(1) + XIN(I)
120     CONTINUE
        S(1) = NPTS
        COEF(1) = COEF(1) / S(1)
        DO 140 I=1,NPTS
                ERR(I) = YIN(I) - COEF(1)
140     CONTINUE
        IF (NORDER .EQ. 1)                RETURN


        B(1) = B(1) / S(1)
        DO 160 I=1,NPTS
                PJM1(I) = 1.
                PJ(I) = XIN(I) - B(1)
160     CONTINUE
        J = 1
180     J = J + 1
        DO 200 I=1,NPTS
                COEF(J) = COEF(J) + ERR(I) * PJ(I)
                B(J) = B(J) + XIN(I) * PJ(I)**2
                S(J) = S(J) + PJ(I)**2
```

```
200     CONTINUE
        COEF(J) = COEF(J) / S(J)
        DO 220 I=1,NPTS
                ERR(I) = ERR(I) - COEF(J) * PJ(I)
220     CONTINUE
        IF (J .EQ. NORDER)                          RETURN

        B(J) = B(J) / S(J)
        C(J) = S(J) / S(J-1)
        DO 240 I=1,NPTS
                P = PJ(I)
                PJ(I) = (XIN(I)-B(J)) * PJ(I) - C(J) * PJM1(I)
                PJM1(I) = P
240     CONTINUE
        GO TO 180

C
C
C
C
        ENTRY ORTHPOL2 (COEF, XIN, NORDER, NPTS, FIT)
C
C       COEF, XIN, NORDER, NPTS: As above (all are inputs here).
C       FIT: (R*4) Output array of the fitted points.
C


        DO 300 J=1,NORDER
                B(J) = 0.
                S(J) = 0.
300     CONTINUE
        C(1) = 0.
        DO 320 I=1,NPTS
                B(1) = B(1) + XIN(I)
320     CONTINUE
        S(1) = NPTS
        DO 340 I=1,NPTS
                FIT(I) = COEF(1)
340     CONTINUE
        IF (NORDER .EQ. 1)                  RETURN


        B(1) = B(1) / S(1)
        DO 360 I=1,NPTS
                PJM1(I) = 1.
                PJ(I) = XIN(I) - B(1)
360     CONTINUE
        J = 1


380     J = J + 1
        DO 400 I=1,NPTS
                B(J) = B(J) + XIN(I) * PJ(I)**2
                S(J) = S(J) + PJ(I)**2
400     CONTINUE
        DO 420 I=1,NPTS
                FIT(I) = FIT(I) + COEF(J) * PJ(I)
420     CONTINUE
        IF (J .EQ. NORDER)                          RETURN

        B(J) = B(J) / S(J)
        C(J) = S(J) / S(J-1)
        DO 440 I=1,NPTS
                P = PJ(I)
                PJ(I) = (XIN(I)-B(J)) * PJ(I) - C(J) * PJM1(I)
                PJM1(I) = P
440     CONTINUE
        GO TO 380

        END
```

```
100          subroutine BAIRSTOW (A, N, F, CONVERGED)
200    !
300    ! This subroutine finds a quadratic factor, F(z), of the polynomial
400    !       where:
500    !               P(z) = A(1)*z**N + A(2)*z**(N-1) + . . . + A(N+1)
600    !       and
700    !               F(z) = z**2 + F(1)*z + F(2)
800    !
900    !*****INPUT:
1000   !
1100   !       A:      R*4 array of N+1 polynomial coefficients
1200   !       N:      I*2 scalar, the order of the polynomial (2 < N <= N_
1300   !       F:      R*4 pair of starting coefficients of quadratic facto
1400   !               (shrewdly chosen to minimize the number of iteration
1500   !
1600   !*****OUTPUT:
1700   !
1800   !       A:      R*4 array of N-1 coefficients of factored polynomial
1900   !               (Remains unchanged if N <= 2 or procedure doesn't c
2000   !       F:      R*4 pair of coefficients of true quadratic factor
2100   !   CONVERGED:  L*2 scalar, indicating convergence of the root find
2200   !
2300   !***************
2400   !
2500   ! The polynomial is factored using a modified Bairstow root-finding
2600   ! procedure which assumes that the polynomial represents a linear
2700   ! predictive model of a speech signal with (most) roots being comple
2800   ! conjugate pairs lying close the unit circle.  Major modifications
2900   ! are restrictions on step size and initial starting points.
3000   !
3100           real*4 A(N+1), F(2)
3200           integer*2 N
3300           logical*2 CONVERGED
3400           parameter N_MAX=32, MAX_STEP=1E-6, MAX_ITERATIONS=100
3500           parameter D_MAX=1.0, E_MAX=1.0, ALPHA=-0.8, CDMIN=1E-32
3600   !
3700   ! INITIALIZATION
3800           dpre = 9E9
3900           epre = 9E9
4000           if (N.le.2.or.N.gt.N_MAX) then  !make error return
4100                   type *,'BAIRSTOW error, call made with order =',N
4200                   CONVERGED = .false.
4300                   return
4400           end if
4500   !
4600   ! BAIRSTOW ITERATION FOR BETTER QUADRATIC FACTOR
4700           do 10 iteration=1,MAX_ITERATIONS
4800   !
4900   ! Perform synthetic division
5000           b1 = 0.0
5100           b2 = 0.0
5200           c1 = 0.0
5300           c2 = 0.0
5400           do 11 i=1,N
5500           b3 = b2
5600           b2 = b1
5700           c3 = c2
5800           c2 = c1
5900           b1 = A(i)-F(1)*b2-F(2)*b3
6000           c1 = b1-F(1)*c2-F(2)*c3
6100   11      continue
6200           b3 = b2
6300           b2 = b1
6400           b1 = A(N+1)-F(1)*b2-F(2)*b3
6500   !
6600   ! Compute incremental step
6700           cd = dble(c2)**2-dble(c1)*dble(c3)
6800           if (abs(cd).le.CDMIN) cd=sign(CDMIN,CD)
6900           d = (b1*c3-b2*c2)/cd
```

```
7000            e = (b2*c1-b1*c2)/cd
7100            if (d.ge.0.0) then
7200                    if (d.gt.D_MAX) d=D_MAX                 !limit step s
7300                    if (dpre.lt.0.0) d=min(d,ALPHA*dpre)    !damp oscillat
7400                else
7500                    if (d.lt.-D_MAX) d=-D_MAX
7600                    if (dpre.gt.0.0) d=max(d,ALPHA*dpre)
7700                end if
7800            if (e.ge.0.0) then
7900                    if (e.gt.E_MAX) e=E_MAX
8000                    if (epre.lt.0.0) e=min(e,ALPHA*epre)
8100                else
8200                    if (e.lt.-E_MAX) e=-E_MAX
8300                    if (epre.gt.0.0) e=max(e,ALPHA*epre)
8400                end if
8500            F(1) = F(1)-d
8600            F(2) = F(2)-e
8700            dpre = d
8800            epre = e
8900    !
9000    ! Test for sufficiently small step size
9100            if (abs(d)+abs(e).le.MAX_STEP) then !reduce A and return
9200                    b2 = 0.0
9300                    b1 = 0.0
9400                    do 20 i=1,N-1
9500                    b3 = b2
9600                    b2 = b1
9700                    b1 = A(i)-F(1)*b2-F(2)*b3
9800                    A(i) = b1
9900    20              continue
10000                   CONVERGED = .true.
10100                   return
10200           end if
10300   10      continue
10400           CONVERGED = .false.
10500           return
10600           end
  100           subroutine POLY_FACTOR (A, N, F, CONVERGED)
  200   !
  300   ! This subroutine factors the polynomial P(z) into N/2 factors Fn(z)
  400   !       where:
  500   !               P(z) = A(1)*z**N + A(2)*z**(N-1) + . . . + A(N+1)
  600   !       and
  700   !               Fn(z) = z**2 + F(1,n)*z + F(2,n)
  800   !
  900   !*****INPUT:
 1000   !
 1100   !       A:      R*4 array of N+1 polynomial coefficients
 1200   !       N:      I*2 scalar, the order of the polynomial (must be <= N
 1300   !
 1400   !*****OUTPUT:
 1500   !
 1600   !       F:      R*4 array of (2,N/2) quadratic factor coefficients
 1700   !   CONVERGED:  L*2 scalar, indicating convergence of the root finder
 1800   !
 1900   !***************
 2000   !
 2100   ! The polynomial is factored using a modified Bairstow root-finding
 2200   ! procedure which assumes that the polynomial represents a linear
 2300   ! predictive model of a speech signal with (most) roots being complex
 2400   ! conjugate pairs lying close the unit circle.  Major modifications
 2500   ! are restrictions on step size and initial starting points.
 2600   !
 2700           real*4 A(1), F(2,1)     !actual dimensions:  A(N+1), F(2,(N+
 2800           integer*2 N
 2900           logical*2 CONVERGED
 3000           parameter N_MAX=32,PI=3.1415927
 3100           real*4 aw(N_MAX+1), fstart(2,N_MAX)
```

```
3200            data fstart/N_MAX*1.0,N_MAX*1.0/
3300            data n_pre/0/
3400    !
3500    ! INITIALIZATION
3600            if (N.LT.1.OR.N.GT.N_MAX) then !make error return
3700                    type *,'POLY_FACTOR error, call made with order =',N
3800                    CONVERGED = .false.
3900                    return
4000            end if
4100            call double (A, aw, 2*(N+1))     !move input to working array
4200            if (N.ne.n_pre) then !set up new starting coefficients
4300                    n_pre = N
4400                    do 2 i=1,N
4500                    fstart(1,i) = 2.0*cos(i*PI/N)
4600    2               continue
4700            end if
4800    !
4900    ! FACTOR POLYNOMIAL
5000            do 3 nfactor=1,(N+1)/2  !compute N/2 factors
5100            norder = N-2*(nfactor-1)
5200            if (norder.le.2) then !skip Bairstow procedure and wrap up
5300                    F(1,nfactor) = aw(2)/aw(1)
5400                    if (norder.ec.2) then
5500                            F(2,nfactor) = aw(3)/aw(1)
5600                        else
5700                            F(2,nfactor) = 0.0
5800                        end if
5900                    CONVERGED = .true.
6000                    return
6100            else !do Bairstow's procedure
6200            do 4 ntry=1,N   !try to get convergence with various starting
6300            call double (fstart(1,ntry), F(1,nfactor), 4)
6400            call BAIRSTOW (aw, norder, F(1,nfactor), CONVERGED)
6500            if (CONVERGED) go to 3
6600    4       continue
6700            return
6800            end if
6900    3       continue
7000            return
7100            end
 100            subroutine BAIRSTOW (A, N, F, CONVERGED)
 200    !
 300    ! This subroutine finds a quadratic factor, F(z), of the polynomial
 400    !       where:
 500    !               P(z) = A(1)*z**N + A(2)*z**(N-1) + . . . + A(N+1)
 600    !       and
 700    !               F(z) = z**2 + F(1)*z + F(2)
 800    !
 900    !*****INPUT:
1000    !
1100    !       A:      R*4 array of N+1 polynomial coefficients
1200    !       N:      I*2 scalar, the order of the polynomial (2 < N <= !
1300    !       F:      R*4 pair of starting coefficients of quadratic fact
1400    !               (shrewdly chosen to minimize the number of iteratic
1500    !
1600    !*****OUTPUT:
1700    !
1800    !       A:      R*4 array of N-1 coefficients of factored polynomir
1900    !               (Remains unchanged if N <= 2 or procedure doesn't c
2000    !       F:      R*4 pair of coefficients of true quadratic factor
2100    !   CONVERGED:  L*2 scalar, indicating convergence of the root find
2200    !
2300    !***************
2400    !
2500    ! The polynomial is factored using a modified Bairstow root-finding
2600    ! procedure which assumes that the polynomial represents a linear
2700    ! predictive model of a speech signal with (most) roots being compl
2800    ! conjugate pairs lying close the unit circle.  Major modification:
```

```
2900  ! are restrictions on step size and initial starting points.
3000  !
3100          real*4 A(N+1), F(2)
3200          integer*2 N
3300          logical*2 CONVERGED
3400          parameter N_MAX=32, MAX_STEP=1E-6, MAX_ITERATIONS=100
3500          parameter D_MAX=1.0, E_MAX=1.0, ALPHA=-0.8, CDMIN=1E-32
3600  !
3700  ! INITIALIZATION
3800          dpre = 9E9
3900          epre = 9E9
4000          if (N.le.2.or.N.gt.N_MAX) then  !make error return
4100                  type *,'BAIRSTOW error, call made with order =',N
4200                  CONVERGED = .false.
4300                  return
4400          end if
4500  !
4600  ! BAIRSTOW ITERATION FOR BETTER QUADRATIC FACTOR
4700          do 10 iteration=1,MAX_ITERATIONS
4800  !
4900  ! Perform synthetic division
5000          b1 = 0.0
5100          b2 = 0.0
5200          c1 = 0.0
5300          c2 = 0.0
5400          do 11 i=1,N
5500          b3 = b2
5600          b2 = b1
5700          c3 = c2
5800          c2 = c1
5900          b1 = A(i)-F(1)*b2-F(2)*b3
6000          c1 = b1-F(1)*c2-F(2)*c3
6100  11      continue
6200          b3 = b2
6300          b2 = b1
6400          b1 = A(N+1)-F(1)*b2-F(2)*b3
6500  !
6600  ! Compute incremental step
6700          cd = dble(c2)**2-dble(c1)*dble(c3)
6800          if (abs(cd).le.CDMIN) cd=sign(CDMIN,CD)
6900          d = (b1*c3-b2*c2)/cd
7000          e = (b2*c1-b1*c2)/cd
7100          if (d.ge.0.0) then
7200                  if (d.gt.D_MAX) d=D_MAX                  !limit step s
7300                  if (dpre.lt.0.0) d=min(d,ALPHA*dpre)  !damp oscilla
7400              else
7500                  if (d.lt.-D_MAX) d=-D_MAX
7600                  if (dpre.gt.0.0) d=max(d,ALPHA*dpre)
7700              end if
7800          if (e.ge.0.0) then
7900                  if (e.gt.E_MAX) e=E_MAX
8000                  if (epre.lt.0.0) e=min(e,ALPHA*epre)
8100              else
8200                  if (e.lt.-E_MAX) e=-E_MAX
8300                  if (epre.gt.0.0) e=max(e,ALPHA*epre)
8400              end if
8500          F(1) = F(1)-d
8600          F(2) = F(2)-e
8700          dpre = d
8800          epre = e
8900  !
9000  ! Test for sufficiently small step size
9100          if (abs(d)+abs(e).le.MAX_STEP) then !reduce A and return
9200                  b2 = 0.0
9300                  b1 = 0.0
9400                  do 20 i=1,N-1
9500                  b3 = b2
9600                  b2 = b1
```

```
                    b1 = A(i)-F(1)*b2-F(2)*b3
                    A(i) = b1
20                  continue
                    CONVERGED = .true.
                    return
            end if
10          continue
            CONVERGED = .false.
            return
            end
            subroutine PROD_FACTOR (F, K, A)
!
! This subroutine computes the polynomial P(z) formed by the product
! of K quadratic factors {Fk(z), k=1,K}
! where
!           P(z) = A(1)*z**N + A(2)*z**(N-1) + . . . + A(N+1)
! and
!           Fk(z) = z**2 + F(1,k)*z + F(2,k)
!
!*****INPUT:
!
!           F:      R*4 array of (2,K) quadratic factor coefficients
!
!           K:      I*2 scalar, the number of quadratic factors
!
!*****OUTPUT:
!
!           A:      R*4 array of N+1 (=2*K+1) polynomial coefficients
!
!***************
            real*4 F(2,1), A(1)
            integer*2 K
!
            if (K.lt.1) then !make error return
                    type *,'PROD_FACTOR error, number of factors =',K
                    return
            end if
            N = 2*K
            A(1) = 1.0
            A(N) = F(1,1)
            A(N+1) = F(2,1)
            if (K.gt.1) then !compute product of factors
                    do 1 i=2,K
                    nstart = N+1-2*i
                    A(nstart+1) = F(1,i)+A(nstart+3)
                    A(nstart+2) = F(2,i)+F(1,i)*A(nstart+3)+A(nstart+4)
                    if (i.gt.2) then !compute center section
                            do 2 j=nstart+3,N-1
                            A(j) = A(j+2)+F(1,i)*A(j+1)+F(2,i)*A(j)
2                           continue
                    end if
                    A(N) = F(1,i)*A(N+1)+F(2,i)*A(N)
                    A(N+1) = F(2,i)*A(N+1)
1                   continue
            end if
            return
            end
            subroutine POLY_FACTOR (A, N, F, CONVERGED)
!
! This subroutine factors the polynomial P(z) into N/2 factors Fn(z)
!           where:
!                   P(z) = A(1)*z**N + A(2)*z**(N-1) + . . . + A(N+1)
!           and
!                   Fn(z) = z**2 + F(1,n)*z + F(2,n)
!
!*****INPUT:
!
!           A:      R*4 array of N+1 polynomial coefficients
```

```
1200    !        N:        I*2 scalar, the order of the polynomial (must be <=
1300    !
1400    !*****OUTPUT:
1500    !
1600    !        F:        R*4 array of (2,N/2) quadratic factor coefficients
1700    !   CONVERGED:  L*2 scalar, indicating convergence of the root finder
1800    !
1900    !***************
2000    !
2100    ! The polynomial is factored using a modified Bairstow root-finding
2200    ! procedure which assumes that the polynomial represents a linear
2300    ! predictive model of a speech signal with (most) roots being complex
2400    ! conjugate pairs lying close the unit circle.  Major modifications
2500    ! are restrictions on step size and initial starting points.
2600    !
2700            real*4 A(1), F(2,1)      !actual dimensions:  A(N+1), F(2,(N+
2800            integer*2 N
2900            logical*2 CONVERGED
3000            parameter N_MAX=32,PI=3.1415927
3100            real*4 aw(N_MAX+1), fstart(2,N_MAX)
3200            data fstart/N_MAX*1.0,N_MAX*1.0/
3300            data n_pre/0/
3400    !
3500    ! INITIALIZATION
3600            if (N.LT.1.OR.N.GT.N_MAX) then !make error return
3700                    type *,'POLY_FACTOR error, call made with order =',N
3800                    CONVERGED = .false.
3900                    return
4000            end if
4100            call double (A, aw, 2*(N+1))     !move input to working array
4200            if (N.ne.n_pre) then !set up new starting coefficients
4300                    n_pre = N
4400                    do 2 i=1,N
4500                    fstart(1,i) = 2.0*cos(i*PI/N)
4600    2               continue
4700            end if
4800    !
4900    ! FACTOR POLYNOMIAL
5000            do 3 nfactor=1,(N+1)/2  !compute N/2 factors
5100            norder = N-2*(nfactor-1)
5200            if (norder.le.2) then !skip Bairstow procedure and wrap up
5300                    F(1,nfactor) = aw(2)/aw(1)
5400                    if (norder.eq.2) then
5500                            F(2,nfactor) = aw(3)/aw(1)
5600                        else
5700                            F(2,nfactor) = 0.0
5800                        end if
5900                    CONVERGED = .true.
6000                    return
6100            else !do Bairstow's procedure
6200            do 4 ntry=1,N   !try to get convergence with various start
6300            call double (fstart(1,ntry), F(1,nfactor), 4)
6400            call BAIRSTOW (aw, norder, F(1,nfactor), CONVERGED)
6500            if (CONVERGED) go to 3
6600    4       continue
6700            return
6800            end if
6900    3       continue
7000            return
7100            end

                SUBROUTINE LPCX_CFBWTOF(F1,F2,CF,BW,ICMPLX,FS)
        C
        C       THIS ROUTINE CONVERTS CF,BW DATA TO THE COEFTS F1,F2 OF
        C       THE DENOMINATOR POLYNOMIAL: Z**2 + F1 * Z + F2.WHETHER THE
        C       INPUT CORRESPONDS TO COMPLEX OR REAL POLE IS CODED IN THE
```

```
C       FLAG ICMPLX.  FS IS THE SAMPLING FREQUENCY IN HZ.
C
        INTEGER*2 ICMPLX      ! CHANGE MADE ON APRIL 29,81
        T = 1./FS
        PI = 3.14159
        TPI = 2. *PI
        IF(ICMPLX.EQ.0)THEN
C       PROCESSING FOR REAL POLES
        IF(CF.EQ.0.)GO TO 22
                R1 = EXP(-PI * ABS(CF)*T) * CF/ABS(CF)
                GO TO 23
22              R1 =0.
23              IF(BW.EQ.0.)GO TO 24
                R2 = EXP(-PI * ABS(BW)*T) * BW/ABS(BW)
                GO TO 25
24              R2=0.
25              CONTINUE
                F1 = -(R1 + R2)
                Q = (R1 - R2) **2
                F2 = -(Q - F1**2)/4.
        ELSE
C       PROCESSING FOR COMPLEX POLES
                R = EXP(-PI * BW *T)
                F2 = R ** 2
                F1 = - 2. * R * COS(TPI *CF * T)
        ENDIF
        RETURN
        END
```

```
100             SUBROUTINE LPCX_LARTOK(K,LAR,NLPC)
200     C  THIS ROUTINE TRANSFORMS LOG AREA RATIO PARAMETERS TO THE
300     C  NEGATIVE OF THE K-PARAMETERS SO THAT KTOA ROUTINES OF
400     C  MARKEL CAN BE USED(MINOR CONVENIENCE!).  IN OTHER WORDS, IF
500     C  YOU TANDEM THE ROUTINES KTOLAR AND LARTOK, THE RESULTING K-
600     C  PARAMETERS WILL BE THE NEGATIVE OF THE ONES STARTED WITH. SO
700     C  WATCHOUT IF YOU ARE USING THIS FOR SYNTHESIS PURPOSES.
800             REAL K,LAR
900             DIMENSION LAR(1),K(1)
950             INTEGER*2 NLPC
1000            DO 1 J=1,NLPC
1100            AK = 10. **(LAR(J))
1200            K(J) = (AK - 1.)/(AK + 1.)
1250            K(J) = - K(J)
1300    1       CONTINUE
1400            RETURN
1500            END
```

```
100             SUBROUTINE LPCX_KTOLAR(K,LAR,NLPC)
200     C  THIS ROUTINE CONVERTS K-PARAMETERS TO LOG AREA RATIO
300     C  PARAMETERS BY THE RELATION LAR = ALOG10(1.+K/1.-K).
400     C  NLPC IS THE ORDER OF THE LPC.
500             REAL K,LAR
600             DIMENSION K(1),LAR(1)
700             INTEGER*2 NLPC
800             DO 1 J=1,NLPC
900             IF(ABS(K(J)).NE.1.)THEN
1000            LAR(J) = ALOG10((1.+K(J))/(1.-K(J)))
1100            ENDIF
1200    C
1300    C       SETTING LAR(J) TO A LARGE POSITIVE NUMBER FOR K(J)=1
1400    C       AND LAR(J) TO A LARGE NEGATIVE NUMBER FOR K(J) = -1
1500            IF(K(J).EQ.1.) LAR(J) = 1.E6
1600            IF(K(J).EQ.-1.)LAR(J) = -1.E6
1700    C
1800    1       CONTINUE
1900            RETURN
2000            END
```

```
100          SUBROUTINE LPCX_ATOROOTS(A,NLPC,CF,BW,ICX,FS,CONV)
200    C     THIS ROUTINE COMPUTES THE ROOTS OF THE ALL POLE
300    C     SPECTRUM IN TERMS OF CF AND BW  BY FIRST FACTORING
400    C     THE DENOMINATOR POLYNOMIAL INTO QUADRATIC TERMS AND
500    C     THEN CALLING THE ROUTINE FTOCFBW.
600    C
700          DIMENSION CF(1),BW(1),ICX(1),A(1),F(2,100)
800          LOGICAL CONV
850          INTEGER*2 NLPC,ICX
900    C     FACTORING THE DENOMINATOR POLYNOMIAL
1000         CALL POLY_FACTOR(A,NLPC,F,CONV)
1100         IF(.NOT.CONV)THEN
1300         RETURN
1400         ENDIF
1500   C     CHECK WHETHER NLPC IS EVEN OR ODD
1600         N2 = NLPC/2
1700         NLPC2 = 2 * N2
1800         IF( NLPC2 .EQ.NLPC)THEN
1900         N2 =NLPC/2
2000         ELSE
2100         N2 =  1 + (NLPC/2)
2200         ENDIF
2300   C     THERE ARE N2 POLYNOMIALS
2400         NLPC2 = 2 * N2
2500   C     CONVERT POLYNOMIAL FACTORS TO ROOTS
2600         DO 1 J=1,N2
2700         F1 = F(1,J)
2800         F2 = F(2,J)
2900         CALL LPCX_FTOCFBW(F1,F2,C,B,ICMPLX,FS)
3000         CF(J)=C
3100         BW(J) = B
3200         ICX(J)=ICMPLX
3300   1     CONTINUE
3400         RETURN
3500         END
100          SUBROUTINE LPCX_ASTOKS(C,RC,M)
200    C
300          INTEGER*2  M
400          REAL  RC(1:M)
500          REAL  C(0:M),B(0:32),A(0:32)
600    C
700          DO 1 I=0,M
800                  A(I)=C(I)
900      1   CONTINUE
1000   C
1100         DO 30 J=1,M
1200                 MR=M-J
1300                 MRP1=MR+1
1400                 D=1.-A(MRP1)*A(MRP1)
1500                 DO 10 K=0,MR
1600                         B(K)=A(MR+1-K)
1700     10          CONTINUE
1800                 DO 20 K=0,MR
1900                         A(K)=(A(K)-A(MRP1)*B(K))/D
2000     20                  CONTINUE
2100                 RC(MRP1)=A(MRP1)
2200     30          CONTINUE
2300         RETURN
2400         END
             SUBROUTINE LPCX_KTOA(K,N,A)
             REAL K
             DIMENSION A(1),K(1),B(32)
             INTEGER*2 N
             A(1)=1.0
             A(2)=K(1)
             DO 30 NINC=2,N
               DO 10 J=1,NINC
                 JTEMP=NINC-J+1
                 B(J)=A(JTEMP)
```

```
10          CONTINUE
          DO 20 ITER=2,NINC
            A(ITER)=A(ITER)+(K(NINC)*B(ITER-1))
20          CONTINUE
          A(NINC+1)=K(NINC)
30        CONTINUE
        RETURN
        END

100     SUBROUTINE LPCX_K
200 C
300 C   This subroutine transforms the reflection coefficients(K'
400 c   to other LPC related parameters.  There are eight entry p
500 c   The first two arguments are the K-param array (real*4), a
600 c   NLPC (I*2) model order.  This is followed by output array
700 c   and output related input parameters.
800 c
900 c<<
```

```
6000    c
6100            ENTRY K_TO_RHO(FK,NLPC,RHO,nrho)
6200            call LPCX_K_TO_RHOS(FK,NLPC,RHO,NRHO)
6300    c
6400            RETURN
6500    C
6600    C       ..............................................................
6700    C
6800    C       Entry III.5 -- K to RA ( autocorrelation of the inverse fi
6900    c                       coefficients).
7000    c               Output: RA(1:NLPC+1) real * 4
7100    c
7200            ENTRY K_TO_RA(FK,NLPC,RA)
7300            CALL LPCX_KTOA(FK,NLPC,TEMP1)
7400            CALL LPCX_ATORA(TEMP1,RA,NLPC)
7500            DO 10 J=1,NLPC+1
7600    10      TEMP1(J)= 0.
7700            RETURN
7800    C
7900    C       ..............................................................
8000    C
8100    C       Entry III.6 -- K to S (LPC model spectrum in dB)
8200    c               Output: S(1:NOUT) real *4 in dB units
8400    c       Extra Input:                    Nout I*2 # of bins in 0 to '
8500    c
8600            ENTRY K_TO_S(FK,NLPC,S,NOUT)
8700            CALL LPCX_KTOA(FK,NLPC,TEMP1)
8800            G = 1.
8900            NB = 1
9000            TEMP(1)=1.
9100            NLPC1  = NLPC +1
9200            CALL LPCX_FREQRESP(TEMP,TEMP1,G,NB,NLPC1,NOUT,S)
9300            TEMP(1)=0.
9400            DO 11 J=1,1024
9500            TEMP1(J)=0.
9600            TEMP2(J)=0.
9700    11      CONTINUE
9800            RETURN
9900    C
10000   C       ..............................................................
10100   C
10200   C       Entry III.7 -- K to Q(cuadratic factors of the inverse fi'
10300   c                       polynomial)
10400   C       Output: NINT[nlpc/2] quadratic factors in the
10500   c               vector form Q(2,NINT(nlpc/2))
10600   c
10700           ENTRY K_TO_Q(FK,NLPC,Q,IER) ! IER=1 IMPLIES NO CONVERGENC
10750           IER = 0
10800           CALL LPCX_KTOA(FK,NLPC,TEMP1)
10900           CALL POLY_FACTOR(TEMP1,NLPC,Q,CONV)
11000           IF(.NOT.CONV) IER = 1
11100           DO 12 J=1,NLPC+1
11200   12      TEMP1(J) = 0.
11300           RETURN
11400   C
11500   C       ..............................................................
11600   C
11700   C       Entry III.8 -- K to F (CF,BW)
11800   c       Additional inputs: FS, sampling frequency in HZ
11900   c       output: CF(1:NINT(NLPC/2)),BW(1:NINT(NLPC/2) R*4
12000   C               ICX (1:NINT(NLPC/2))  I*2   1 OR 0 COMPLEX FLAG
12100   C
12200           ENTRY K_TO_F(FK,NLPC,CF,BW,ICX,FS,IER) ! IER=1 NO CONVERGE
12250           IER = 0
12300           CALL LPCX_KTOA(FK,NLPC,TEMP1)
12400           CALL LPCX_ATOROOTS(TEMP1,NLPC,CF,BW,ICX,FS,CONV)
12500           IF(.NOT.CONV)IER=1
12600           DO 14 J=1,NLPC+1
```

```
12700   14      TEMP1(J) = 0.
12800           RETURN
12900           END
13000   C       ..............................................
13100   C       ..............................................
13200   C       ..............................................
  100           SUBROUTINE LPCX_LAR
  200   C       This subroutine converts log area ratio parameters LAR tc
  300   c       LPC related parameters.  There are eight entry points.  T
  400   c       first two arguments are the LAR array(real*4), and model
  500   c       NLPC(I*2).  These are followed by output array(real*4), a
  600   c       I/O related parameters.
  700   c
  800   c       <<<<<<<<<<<<<<<<<<<<<<<<<<<<<<<<<<<<<<<<<<<<<<<<<<<<<<<<<<<
  900   c                                PROGRAM BEGINS
 1000   C       <<<<<<<<<<<<<<<<<<<<<<<<<<<<<<<<<<<<<<<<<<<<<<<<<<<<<<<<<<<
 1100           DIMENSION RHO(1),A(1),FK(1),FLAR(1),C(1),S(1),RA(1),Q(2,1
 1200           1       CF(1),BW(1)
 1300           DIMENSION TEMP(1024),TEMP1(1024),TEMP2(1024),TEMP3(2,1024
 1400           INTEGER * 2 ICX(1),NLPC,NOUT,NC,IER,NRHO
 1500           LOGICAL CONV
 1600   C
 1700   C       <<<<<<<<<<<<<<<<<<<<<<<<<<<<<<<<<<<<<<<<<<<<<<<<<<<<<<<<<<<
 1800   c
 1900   C       Entry Set VI: Input parameter is LAR
 2000   c               Input: LAR(1:nlpc) real*4
 2100   c                       NLPC  I*2 model order
 2200   c
 2300   c       Entry VI.1 -- LAR to K(reflection coefts)
 2400   c               Output:K(1:nlpc) real*4
 2500   c
 2600           ENTRY LAR_TO_K(FLAR,NLPC,FK)
 2700           CALL LPCX_LARTOK(FK,FLAR,NLPC)
 2800           RETURN
 2900   C
 3000   C       ..............................................
 3100   C
 3200   C       Entry VII.2 -- LAR tc A(predictor coefficients)
 3300   c               Output:A(0:NLPC) real*4
 3400   c
 3500           ENTRY LAR_TO_A(FLAR,NLPC,A)
 3600           CALL LPCX_LARTOK(TEMP1,FLAR,NLPC)
 3700           CALL LPCX_KTOA(TEMP1,NLPC,A)
 3800           DO 36 J=1,NLPC
 3900   36      TEMP1(J)=0.
 4000           RETURN
 4100   C
 4200   C       ..............................................
 4300   C
 4400   C       Entry VI.3 -- LAR to C(cepstral coefficients)
 4500   c               Output:C(1:nc) real*4
 4600   c               extra input: nc I*4 # of cepstral coefts needed
 4700   c
 4800           ENTRY LAR_TO_C(FLAR,NLPC,C,NC)
 4900           CALL LPCX_LARTOK(TEMP1,FLAR,NLPC)
 5000           CALL LPCX_KTOA(TEMP1,NLPC,TEMP2)
 5100           CALL LPCX_ATOC(TEMP2,NLPC,C,NC)
 5200           DO 37 J=1,NLPC+1
 5300           TEMP1(J)=0.
 5400           TEMP2(J)=0.
 5500   37      CONTINUE
 5600           RETURN
 5700   C
 5800   C       ..............................................
 5900   C
 6000   C       Entry VI.4 -- LAR to Rho(normalized autocorrelation)
 6100   c               output: Rho(1:nrho)  real*4
 6200   c
```

```
6300            ENTRY LAR_TO_RHO(FLAR,NLPC,RHO,NRHO)
6400            CALL LPCX_LARTOK(TEMP1,FLAR,NLPC)
6500            CALL LPCX_K_TO_RHOS(TEMP1,NLPC,RHO,NRHO)
6600            DO 39 J=1,NLPC
6700    39      TEMP1(J) =0.
6800            RETURN
6900    C
7000    C       ..............................................................
7100    C
7200    C       Entry VI.5 -- LAR to RA(autocorrelation of the inverse fil
7300    c                                        coefficients)
7400    c               Output:RA(1:nlpc+1) real*4
7500    c
7600            ENTRY LAR_TO_RA(FLAR,NLPC,RA)
7700
7800            CALL LPCX_LARTOK(TEMP1,FLAR,NLPC)
7900            CALL LPCX_KTOA(TEMP1,NLPC,TEMP2)
8000            CALL LPCX_ATORA(TEMP2,RA,NLPC)
8100            DO 40 J=1,NLPC+1
8200            TEMP1(J)=0.
8300            TEMP2(J)=0.
8400    40      CONTINUE
8500            RETURN
8600    C
8700    C       ..............................................................
8800    C
8900    C       Entry VI.6 -- LAR to S(LPC spectrum in dB units)
9000    c               output:S(1:nout) in dB units. real*4
9100    c               extra input: nout I*2 # of bins in 0 - FS/2 Hz
9300    c
9400            ENTRY LAR_TO_S(FLAR,NLPC,S,NOUT)
9500            CALL LPCX_LARTOK(TEMP1,FLAR,NLPC)
9600            CALL LPCX_KTOA(TEMP1,NLPC,TEMP2)
9700            DO 399 J=1,NLPC+1
9800            TEMP1(J) = TEMP2(J)
9900            TEMP2(J) = 0.
10000   399     CONTINUE
10100           G = 1.
10200           NB = 1.
10300           TEMP(1)=1.
10400           NLPC1  = NLPC +1
10500           CALL LPCX_FREQRESP(TEMP,TEMP1,G,NB,NLPC1,NOUT,S)
10600           TEMP(1)=0.
10700           DO 200 J=1,1024
10800           TEMP1(J)=0.
10900           TEMP2(J)=0.
11000   200     CONTINUE
11100           RETURN
11200   C
11300   C       ..............................................................
11400   C
11500   C       Entry VI.7 -- LAR to Q( quadratic factors of the inverse f
11600   c                                        polynomial)
11700   c       Output: NINT(nlpc/2) quadratic factors in the
11800   c               vector form Q(2,NINT(nlpc/2))
11900   c
12000           ENTRY LAR_TO_Q(FLAR,NLPC,Q,IER) ! IER =1 NO CONVERGENCE
12050           IER = 0  ! INITIALIZE ERROR VARIABLE
12100           CALL LPCX_LARTOK(TEMP1,FLAR,NLPC)
12200           CALL LPCX_KTOA(TEMP1,NLPC,TEMP2)
12300           CALL POLY_FACTOR(TEMP2,NLPC,Q,CONV)
12400           IF(.NOT.CONV) IER = 1
12500           DO 400 J=1,NLPC+1
12600           TEMP1(J)=0.
12700   400     TEMP2(J)=0.
12800           RETURN
12900   C
13000   C       ..............................................................
13100   C
```

```
13200   C       Entry VI.8 --  LAR tc F(CF,BW and ICX)
13300   c       Additional inputs: FS, sampling frequency in HZ
13400   c       output: CF(1:NINT(NLPC/2)),BW(1:NINT(NLPC/2) R*4
13500   C               ICX (1:NINT(NLPC/2))  I*2   1 OR 0 COMPLEX FLAG
13600   C
13700           ENTRY LAR_TO_F(FLAR,NLPC,CF,BW,ICX,FS,IER) ! IER =1 NO CON
13750           IER = 0 ! INITIALIZE ERROR FLAG
13800           CALL LPCX_LARTOK(TEMP1,FLAR,NLPC)
13900           CALL LPCX_KTOA(TEMP1,NLPC,TEMP2)
14000           CALL LPCX_ATOROOTS(TEMP2,NLPC,CF,BW,ICX,FS,CONV)
14050           IF(.NOT.CONV)IER=1
14100           DO 14 J=1,NLPC+1
14200           TEMP2(J)=0.
14300   14      TEMP1(J) = 0.
14400           RETURN
14500           END
14600   C       ..............................................................
14700   C       ..............................................................
14800   C       ..............................................................
14900   C       ..............................................................
15000   C       ..............................................................
15100   C       ..............................................................
 100            SUBROUTINE LPCX_F
 200    C       This subroutine transforms center frequency, bandwidth an
 300    c       complex flag information to other LPC related parameters.
 400    c       There are eight entry points.  The first four arguments
 500    c       are the center frequency array CF (real*4 in HZ),the
 600    c       bandwidth array BW( real*4 in HZ), and the complex flag
 700    c       array ICX(I*2), and NLPC (I*2) model order.  These are
 800    c       followed by the output array and I/O related quantity lik
 900    c       the sampling frequency in HZ.
1000    c
1100    c       <<<<<<<<<<<<<<<<<<<<<<<<<<<<<<<<<<<<<<<<<<<<<<<<<<<<<<<<<<<<
1200    c                               PROGRAM BEGINS
1300    C       <<<<<<<<<<<<<<<<<<<<<<<<<<<<<<<<<<<<<<<<<<<<<<<<<<<<<<<<<<<<
1400    C
1500            DIMENSION RHO(1),A(1),FK(1),FLAR(1),C(1),S(1),RA(1),Q(2,1)
1600            1       CF(1),BW(1)
1700            DIMENSION TEMP(1024),TEMP1(1024),TEMP2(1024),TEMP3(2,1024)
1800            INTEGER * 2 ICX(1),NLPC,NOUT,NC,IER,NRHO
1900            LOGICAL CONV
2000    C
2100    C       <<<<<<<<<<<<<<<<<<<<<<<<<<<<<<<<<<<<<<<<<<<<<<<<<<<<<<<<<<<<
2200    c
2300    c       Entry Set V: Input parameter set is F(CF,BW,ICX)
2400    C               Inputs: CF(1:NLPC/2),BW(1:NLPC/2) IN HZ real *4
2500    c                       NLPC model order I*2
2600    c                       ICX(1:NLPC/2) I*2 complex flag
2700    c                       FS sampling frequency HZ
2800    c
2900    c
3000    c
3100    c       Entry V.1 -- F to Q(quadratic factors of the pred polynom
3200    c       Output: NINT(nlpc/2) quadratic factors in the
3300    c               vector form Q(2,NINT(nlpc/2))
3400    c
3500            ENTRY F_TO_Q(CF,BW,ICX,NLPC,Q,FS)
3600    C       CHECK WHETHER NLPC IS EVEN OR ODD
3700            N2 = NLPC/2
3800            NLPC2 = 2 * N2
3900            IF( NLPC2 .EQ.NLPC)THEN
4000            N2 =NLPC/2
4100            ELSE
4200            N2 =  1 + (NLPC/2)
4300            ENDIF
4400    C       CONVERT CF AND BW TO QUADRATICS
4500            DO 23 J=1,N2
4600            C1 = CF(J)
4700            B = BW(J)
```

```
4800            ICMPLX = ICX(J)
4900            CALL LPCX_CFBWTOF(F1,F2,C1,B,ICMPLX,FS)
5000            Q(1,J) = F1
5100            Q(2,J)=F2
5200    23      CONTINUE
5300            RETURN
5400    C
5500    C       ..................................................
5600    C
5700    C       Entry V.2 -- F to A(predictor coefficients)
5800    c               output:A(1:nlpc) real*4
5900    c
6000            ENTRY F_TO_A(CF,BW,ICX,NLPC,A,FS)
6100    C       CHECK WHETHER NLPC IS EVEN OR ODD
6200            N2 = NLPC/2
6300            NLPC2 = 2 * N2
6400            IF( NLPC2 .EQ.NLPC)THEN
6500            N2 =NLPC/2
6600            ELSE
6700            N2 =  1 + (NLPC/2)
6800            ENDIF
6900    C       CONVERT CF AND BW TO QUADRATICS
7000            DO 24 J=1,N2
7100            C1 = CF(J)
7200            B = BW(J)
7300            ICMPLX = ICX(J)
7400            CALL LPCX_CFBWTOF(F1,F2,C1,B,ICMPLX,FS)
7500            TEMP3(1,J)=F1
7600            TEMP3(2,J)=F2
7700    24      CONTINUE
7800    C
7900            CALL PROD_FACTOR(TEMP3,N2,TEMP1)
8000            DO 90 J=1,NLPC+1
8100            A(J)=TEMP1(J)
8200    90      TEMP1(J)=0.
8300            TEMP1(2*N2)=0.
8400            DO 25 J=1,N2
8500            TEMP3(1,J)=0.
8600            TEMP3(2,J)=0.
8700    25      CONTINUE
8800            RETURN
8900    C
9000    C       ..................................................
9100    C
9200    C       Entry V.3 -- F to K(reflection coefficients)
9300    c               Output: K(1:nlpc) real * 4
9400    c
9500            ENTRY F_TO_K(CF,BW,ICX,NLPC,FK,FS)
9600    C       CHECK WHETHER NLPC IS EVEN OR ODD
9700            N2 = NLPC/2
9800            NLPC2 = 2 * N2
9900            IF( NLPC2 .EQ.NLPC)THEN
10000           N2 =NLPC/2
10100           ELSE
10200           N2 =  1 + (NLPC/2)
10300           ENDIF
10400   C       CONVERT CF AND BW TO QUADRATICS
10500           DO 26 J=1,N2
10600           C1 = CF(J)
10700           B = BW(J)
10800           ICMPLX = ICX(J)
10900           CALL LPCX_CFBWTOF(F1,F2,C1,B,ICMPLX,FS)
11000           TEMP3(1,J)=F1
11100           TEMP3(2,J)=F2
11200   26      CONTINUE
11300   C
11400           CALL PROD_FACTOR(TEMP3,N2,TEMP1)
11500           CALL LPCX_ASTOKS(TEMP1,FK,NLPC)
11600           DO 255 J=1,N2
11700           TEMP3(1,J)=0.
11800           TEMP3(2,J)=0.
```

```
11900   255     CONTINUE
12000           DO 27 J=1,2*N2
12100   27      TEMP1(J) = 0.
12200           RETURN
12300   C
12400   C       ..............................................................
12500   C
12600   C       Entry V.4 -- F to LAR (log area ratio coefts)
12700   c               Output: LAR(1:NLPC) real * 4
12800   c
12900           ENTRY F_TO_LAR(CF,BW,ICX,NLPC,FLAR,FS)
13000   C       CHECK WHETHER NLPC IS EVEN OR ODD
13100           N2 = NLPC/2
13200           NLPC2 = 2 * N2
13300           IF( NLPC2 .EQ.NLPC)THEN
13400           N2 =NLPC/2
13500           ELSE
13600           N2 =  1 + (NLPC/2)
13700           ENDIF
13800   C       CONVERT CF AND BW TO QUADRATICS
13900           DO 266 J=1,N2
14000           C1 = CF(J)
14100           B = BW(J)
14200           ICMPLX = ICX(J)
14300           CALL LPCX_CFBWTOF(F1,F2,C1,B,ICMPLX,FS)
14400           TEMP3(1,J)=F1
14500           TEMP3(2,J)=F2
14600   266     CONTINUE
14700   C
14800           CALL PROD_FACTOR(TEMP3,N2,TEMP1)
14900           CALL LPCX_ASTOKS(TEMP1,TEMP2,NLPC)
15000           DO 28 J=1,NLPC
15100   28      TEMP2(J)=-TEMP2(J)
15200           CALL LPCX_KTOLAR(TEMP2,FLAR,NLPC)
15300           DO 2555 J=1,N2
15400           TEMP3(1,J)=0.
15500           TEMP3(2,J)=0.
15600   2555    CONTINUE
15700           DO 277 J=1,2*N2
15800           TEMP2(J)=0.
15900   277     TEMP1(J)=0.
16000           RETURN
16100   C       ..............................................................
16200   C
16300   C       Entry V.5 -- F to C(cepstral coefficients)
16400   c               Output:C(1:nc) real*4
16500   c               extra input: nc I*2 number of cepstral coefts neec
16600   c
16700           ENTRY F_TO_C(CF,BW,ICX,NLPC,C,NC,FS)
16800   C
16900   C       CHECK WHETHER NLPC IS EVEN OR ODD
17000           N2 = NLPC/2
17100           NLPC2 = 2 * N2
17200           IF( NLPC2 .EQ.NLPC)THEN
17300           N2 =NLPC/2
17400           ELSE
17500           N2 =  1 + (NLPC/2)
17600           ENDIF
17700   C       CONVERT CF AND BW TO QUADRATICS
17800           DO 666 J=1,N2
17900           C1 = CF(J)
18000           B = BW(J)
18100           ICMPLX = ICX(J)
18200           CALL LPCX_CFBWTOF(F1,F2,C1,B,ICMPLX,FS)
18300           TEMP3(1,J)=F1
18400           TEMP3(2,J)=F2
18500   666     CONTINUE
18600   C
18700           CALL PROD_FACTOR(TEMP3,N2,TEMP1)
18800           CALL LPCX_ATOC(TEMP1,NLPC,C,NC)
```

```
18900            DO 95 J=1,N2
19000            TEMP3(1,J)=0.
19100    95      TEMP3(2,J)=0.
19200            DO 955 J=1,2*N2
19300    955     TEMP1(J)=0.
19400            RETURN
19500    C
19600    C
19700    C       ..............................................................
19800    C
19900    C       Entry V.6 -- F to S(LPC model spectrum in dB units)
20000            ENTRY F_TO_S(CF,BW,ICX,NLPC,S,NOUT,FS)
20100    C       CHECK WHETHER NLPC IS EVEN OR ODD
20200            N2 = NLPC/2
20300            NLPC2 = 2 * N2
20400            IF( NLPC2 .EQ.NLPC)THEN
20500            N2 =NLPC/2
20600            ELSE
20700            N2 =  1 + (NLPC/2)
20800            ENDIF
20900    C       CONVERT CF AND BW TO QUADRATICS
21000            DO 2666 J=1,N2
21100            C1 = CF(J)
21200            B = BW(J)
21300            ICMPLX = ICX(J)
21400            CALL LPCX_CFBWTOF(F1,F2,C1,B,ICMPLX,FS)
21500            TEMP3(1,J)=F1
21600            TEMP3(2,J)=F2
21700    2666    CONTINUE
21800    C
21900            CALL PROD_FACTOR(TEMP3,N2,TEMP1)
22000            G = 1.
22100            NB = 1
22200            TEMP(1)=1.
22300            NLPC1  = NLPC +1
22400            CALL LPCX_FREQRESP(TEMP,TEMP1,G,NB,NLPC1,NOUT,S)
22500            TEMP(1)=0.
22600            DO 200 J=1,1024
22700            TEMP1(J)=0.
22800            TEMP3(1,J)=0.
22900            TEMP3(2,J)=0.
23000            TEMP2(J)=0.
23100    200     CONTINUE
23200            RETURN
23300    C
23400    C       ..............................................................
23500    C
23600    C       Entry V.7 -- F to RA( autocorrelation of the inverse filte
23700    c               Output:RA(1:nlpc+1) real * 4
23800    c
23900            ENTRY F_TO_RA(CF,BW,ICX,NLPC,RA,FS)
24000    C       CHECK WHETHER NLPC IS EVEN OR ODD
24100            N2 = NLPC/2
24200            NLPC2 = 2 * N2
24300            IF( NLPC2 .EQ.NLPC)THEN
24400            N2 =NLPC/2
24500            ELSE
24600            N2 =  1 + (NLPC/2)
24700            ENDIF
24800    C       CONVERT CF AND BW TO QUADRATICS
24900            DO 30 J=1,N2
25000            C1 = CF(J)
25100            B = BW(J)
25200            ICMPLX = ICX(J)
25300            CALL LPCX_CFBWTOF(F1,F2,C1,B,ICMPLX,FS)
25400            TEMP3(1,J)=F1
25500            TEMP3(2,J)=F2
25600    30      CONTINUE
25700    C
25800            CALL PROD_FACTOR(TEMP3,N2,TEMP1)
```

```
25900            CALL LPCX_ATORA(TEMP1,RA,NLPC)
26000            DO 31 J=1,2*N2
26100            TEMP3(1,J)=0.
26200            TEMP3(2,J)=0.
26300            TEMP1(J) = 0.
26400     31     CONTINUE
26500            RETURN
26600     C
26700     C      ..............................................................
26800     C
26900     C      Entry V.8 -- F to Rho(normalized autocorrelation)
27000     c              output:Rho(0:nrho) real*4
27100     c
27200            ENTRY F_TO_RHO(CF,BW,ICX,NLPC,RHO,NRHO,FS)
27300     C
27400     C      CHECK WHETHER NLPC IS EVEN OR ODD
27500            N2 = NLPC/2
27600            NLPC2 = 2 * N2
27700            IF( NLPC2 .EQ.NLPC)THEN
27800            N2 =NLPC/2
27900            ELSE
28000            N2 =  1 + (NLPC/2)
28100            ENDIF
28200     C      CONVERT CF AND BW TO QUADRATICS
28300            DO 32 J=1,N2
28400            C1 = CF(J)
28500            B = BW(J)
28600            ICMPLX = ICX(J)
28700            CALL LPCX_CFBWTOF(F1,F2,C1,B,ICMPLX,FS)
28800            TEMP3(1,J)=F1
28900            TEMP3(2,J)=F2
29000     32     CONTINUE
29100     C
29200            CALL PROD_FACTOR(TEMP3,N2,TEMP1)
29300            CALL LPCX_ASTOKS(TEMP1,TEMP2,NLPC)
29400            DO 33 J=1,N2
29500            TEMP3(1,J)=0.
29600            TEMP3(2,J)=0.
29700     33     CONTINUE
29800            CALL LPCX_K_TO_RHOS(TEMP2,NLPC,RHO,NRHO)
29900            DO 34 J=1,2*N2
30000            TEMP1(J)=0.
30100            TEMP2(J)=0.
30200     34     CONTINUE
30300            RETURN
30400            END
30500     C      ..............................................................
30600     C      ..............................................................
30700     C      ..............................................................
30800     C      ..............................................................
30900     C      ..............................................................
          PROGRAM RTTRACK          ! ROOT TRACKING
C
C*****************************************************************
C          This program accepts as input an analysis file or a digitied
C        speech file from which it computes the reflection coefficients,
C        converts them to poles, and fits Legendre polynomials to the root
C        tracks.  The center frequency is represented by the following tran
C                1. CENTER FREQUENCY (Hz)
C                2. LOG-CF (dB)
C                3. MEL-CF (dB)
C        The bandwidth is represented by the following transforms:
C                4. BANDWIDTH (Hz)
C                5. LOG-AMPLITUDE (LOG(1-r)) (dB)
C                6. POLE-MAGN
C        The residual polynomial is represented by the following 2 paramete
C                7. LAR-1 (RESID. POLYN.)
C                8. LAR-2 (RESID. POLYN.)
C        Energy and Pitch are represented as:
C                9. ENERGY
```

```
C                10. LOG-ENERGY
C                11. PITCH
C                12. LOG-PITCH
C        NOTE:
C             *   If an unvoiced frame has energy < 3, it is considered
C                 silence; the energy value is set to zero and no other bits
C                 are transmitted.
C             *   The residual polynomial parameters can be encoded either
C                 individually or using time encoding.
C             *   The program can be used to determine the JNDs for the
C                 curve fitting error threshold, or the quantization step
C                 size for the Legendre coefficients.
C             *   The order of fit for the BW can be determined in three
C                 ways: a) Using the ERRTHR, like the other parameters.
C                 b) Fixing the max order of the fit to be 1 (const. and
C                 first order term).  c) Not transmitting BW at all, and
C                 recovering it at the receiver according to a rule.
C*****************************************************************
C
        PARAMETER LBUF = 35, NBINS = 128
        PARAMETER BW_FIXED = 100

        INTEGER*2 BWTH_UP, BWTH_LO, DTOA
        INTEGER*2 CF(LBUF,8)
        INTEGER*2 BW(LBUF,8)
        INTEGER*2 PNTR(LBUF,8), PNTR_BCK(LBUF,8), PNTR1(LBUF,8), PNTR2(LBUF,
        INTEGER*2 ICX(8), ICFL(8,LBUF), ICXAUX(8)
        INTEGER*2 NNZP(LBUF)
        INTEGER*2 IOR(8), IANGLE(16)
        INTEGER*2 PTCH_EN(2,LBUF), PEPNTR (2,LBUF)
        INTEGER*2 INPARAM(18), OUTPARAM(18)
        INTEGER*2 INUN, OUTUN, IO_UN, STUN
        INTEGER*2 LFRAME,IERR,NFACTR,ISAMPD,IDATATP,LENGT
        INTEGER*2 IP(2000),INSPEECH(512), LEN(12)
        INTEGER*2 IPARAM(30000)

        DIMENSION SPEECH(512), FORW(512), BACK(512)
        DIMENSION BWIN(10), BWAUX(8), BWST(LBUF)
        DIMENSION CFIN(10), CFAUX(8), PLT(LBUF)
        DIMENSION EN(LBUF), PT(LBUF)
        DIMENSION CL(70)
        DIMENSION FFPARAM1(50), FFPARAM(50)
        DIMENSION PMAGN(16),PANGLE(16), DIST_MIN(8)
        DIMENSION RC(16),A(16),T_FUNC(LBUF)
        DIMENSION CODE(100000), DECODE(100000), ICPTR(250)
        DIMENSION IFORM(15),STEP(10)
        DIMENSION FLAR(LBUF,2), DUMMY(LBUF)
        DIMENSION BITS(15), MAXLGND(15), AVLGND(15)
        DIMENSION ERRTHR(10), X(LBUF)

        CHARACTER*32 STFILE, INFILE1,STRING, PAR(12)
        CHARACTER*32 OUTFILE, INFILE, FILENAM
        CHARACTER*78 NDESCR, CHAR_STR
        CHARACTER*8 NAME,LABEL
        CHARACTER*9 KDATE, WCHAR
        CHARACTER*8 KTIME
        CHARACTER*78 OUTSTRING

        LOGICAL*2 CONVERGE, FIRSTPASS, FIRSTSILENCE
        LOGICAL*2 QNT, JND, ERTHJND, FIT, ISOL_FRAME
        LOGICAL*1 CHAR

        DATA PAR/'CENTER FREQ','LOG-CF','MEL-CF','BANDWIDTH','LOG AMPL',
        1        'POLE MAGN','LAR-1','LAR-2','ENERGY','LOG-ENERGY',
        2        'PITCH','LOG-PITCH'/
        DATA LEN/11,6,6,9,8,9,5,5,6,10,5,9/

        INCLUDE 'UD:[PANOS.ROOTS]HEADER.FRM'

        PI=ACOS(-1.)
```

```
      INUN=1
      OUTUN=2
      LREC = 0
      NREC = 0
      JNDPAR = 1
      JNDCOEF = 1
      STEPJND = 0.1
      IERTH = 1
      VERTH = 1.
      ICOL_BW = 1
      INFILE = 'UD:[PANOS.ROOTS]M1A.LPC'
      LENGTH1 = 23
      OUTFILE = 'UD:[PANOS.ROOTS]M1A.LPC'
      LENGTH2 = 23
C
C*****************************************************************
C     OPEN ANALYSIS FILES AND INPUT ENCODING DATA
C*****************************************************************
C
C
C     QUANTIZATION FILE
C
      CALL GET_STRING ('Coding data file (Def.: RTTRK.DAT)',STFILE,LENG
      IF (LENGT.EQ.0) THEN
              STFILE = 'UD:[PANOS.ROOTS]RTTRK.DAT'
              LENGT = 25
      END IF
      LUN=3
      OPEN (UNIT=LUN,NAME=STFILE,TYPE='OLD')

      READ (LUN,*) FFPARAM1(1)  ! 1=Coef quant JND, 2=error thresh. JN
C                                        Else=No exper.
      READ (LUN,*) FFPARAM1(2)  ! Linear(1),Max entr(2),Min dev(3) Qua
      READ (LUN,*) FFPARAM1(3)  ! 1st param: CF(1), LOG-CF(2), MEL-CF(
      READ (LUN,*) FFPARAM1(4)  ! 2nd param: BW(1), LOG-AMPL(2), POLE-
C                                   >3 (3-4): BW by rule
      READ (LUN,*) FFPARAM1(5)  ! Encode Energy(0) or log(Energy)(1)
      READ (LUN,*) FFPARAM1(6)  ! Encode Pitch(0) or log(Pitch)(1)
      READ (LUN,*) FFPARAM1(7)  ! Error thresh. for 1st param. (CF)
      READ (LUN,*) FFPARAM1(8)  ! Error thresh. for 2nd param. (BW)
      READ (LUN,*) FFPARAM1(9)  ! Error thresh. for resid. polyn.
      READ (LUN,*) FFPARAM1(10) ! Error thresh. for energy.
      READ (LUN,*) FFPARAM1(11) ! Error thresh. for pitch.
      READ (LUN,*) FFPARAM1(12) ! Quant. step size (1st component, CF)
      READ (LUN,*) FFPARAM1(13) ! Quant step size (2nd component, BW)
      READ (LUN,*) FFPARAM1(14) ! Quant. step size for res. pol.(1st c
      READ (LUN,*) FFPARAM1(15) ! Quant. step size for energy.(1st coe
      READ (LUN,*) FFPARAM1(16) ! Quant. step size for pitch.(1st coef
      READ (LUN,*) FFPARAM1(17) ! Max order of fit for 1st paramet. (C
      READ (LUN,*) FFPARAM1(18) ! Max order of fit for 2nd paramet. (B
      READ (LUN,*) FFPARAM1(19) ! Max order of fit for resid. polyn.
      READ (LUN,*) FFPARAM1(20) ! Max order of fit for energy
      READ (LUN,*) FFPARAM1(21) ! Max order of fit for pitch
      READ (LUN,*) FFPARAM1(22) ! %/100 increase of quant. step size f
C                                   coefficients of order > 2.
      READ (LUN,*) FFPARAM1(23) ! Quant. step of coeff 2 = STEP(7) * C
C                                   step of coeff 1.
      READ (LUN,*) FFPARAM1(24) ! # of bits for residual polynomial,
C                                   <0: Time encoding.
      READ (LUN,*) FFPARAM1(25) ! Fuctional form of cost (1-3)
      READ (LUN,*) FFPARAM1(26) ! Cost weight
      READ (LUN,*) FFPARAM1(27) ! Frame period in ms for DS files.
      READ (LUN,*) FFPARAM1(28) ! Window length in ms for DS files.
      READ (LUN,*) FFPARAM1(29) ! Burg (0) or autocorrel (1) anal. for
      READ (LUN,*) FFPARAM1(30) ! LPC model order.
      READ (LUN,*) FFPARAM1(31) ! Upper BW threshold.
      READ (LUN,*) FFPARAM1(32) ! Lower BW threshold.
      READ (LUN,*) FFPARAM1(33) ! Quantize(1) or not(.)
      READ (LUN,*) FFPARAM1(34) ! Plot(1), output(.)
```

```
      CALL DOUBLE (FFPARAM1(1), FFPARAM(1), 2*50)
      CALL TO_ANSI
      CALL TINIT(1)
      FIRSTSILENCE = .TRUE.
      OVERHEAD = 0                    ! Overhead bits.
      CALL CLEAR (BITS(1), 30)
      CALL CLEAR (MAXLGND(1), 30)
      CALL CLEAR (AVLGND(1), 30)
      CALL TCS
      CALL TPOSCR(3,1)
      TYPE 45
      FORMAT (2X,' 1: 1=Coef JND 2=Err JND .=No exper',8X,
     1                '22: %/100 incr in step'/
     2        2X,' 2: 1=Linear 2=max entr 3=min dev qnt',6X,
     3                '23: Qnt step2 / step1'/
     4        2X,' 3: 1=CF 2=LOG-CF 3=MEL-CF',17X,
     5                '24: Res pol bits (<0: time enc.)'/
     6        2X,' 4: 1=BW 2=LOG-AMP 3=POLE-MAG 4-5=fix',6X,
     7                '25: Cost function (1-3)'/
     8        2X,' 5: 0=energy 1=log-energy',18X,
     9                '26: Cost weight'/
     1        2X,' 6: 0=pitch 1=log-pitch',20X,
     2                '27-28: Frame prd, window len (ms)'/
     3        2X,' 7-11: Error thresh. for 7=CF 8=BW',9X,
     4                '29: 0=Burg, 1=Autocor.'/
     5        10X,       '9=res. pol 10=energy 11=pitch',6X,
     6                '30: LPC order'/
     7        2X,'12-16: Qnt step (1st coef) 12=CF 13=BW',5X,
     8                '31: Upper BW thresh'/
     9        10X,       '14=res pol 15=energy 16=ptch',8X,
     1                '32: Lower BW thresh'/
     2        2X,'17-21: Max fit order 17=CF 18=BW',11X,
     3                '33: 1=quantize, .=no'/
     4        10X,       '19=res pol 20=energy 21=pitch',6X,
     5                '34: 1=plot, .=output')

C     CALL DOUBLE (FFPARAM1(1), FFPARAM(1), 2*50)
      CALL TPOSCR (20,4)
      CALL TPUTST
      1  ('1-34: change param,  -CONSOLE: listen,  0: exit,  999: run >
      CALL TPOSCR (20,64)
      CALL TCEOL
      ACCEPT 63, LONG, IDO
63    FORMAT (Q,I4)
      IF (LONG .EQ. 0) GO TO 60
      IF (IDO .EQ. 0) GO TO 920
      IF (IDO .LT. 0) THEN
              DTOA = -IDO

! Listen to the original sentence

              CALL SP_OPEN_OLD (INUN,'#'//INFILE(1:LENGTH1),IERR)
              CALL SP_RETCODE (IERR)
              CALL SP_GET_HEADER (INUN,HEADER,IERR)
              CALL SP_RETCODE (IERR)
              ISMPRD1 = SD_SAMPERIOD
              IDATYP1 = SD_DATATYPE
              LPC1 = SD_ORDRLPC
              NFRM1 = SP_NUMFRAMES
              FRPRD1 = SP_FRPERIOD
              ALPHA1 = SP_PREEMPH
              NWORDS = NFRM1 * (LPC1+2)
              CALL SP_READ (INUN, 1, 1, NWORDS, IDIDNT, IPARAM, IERR)
              CALL SP_RETCODE (IERR)
              CALL LPC_SPEAK3 (IPARAM, NFRM1, LPC1, ISMPRD1,
     1                         FRPRD1, ALPHA1, DTOA, IERR)
              CALL SP_RETCODE (IERR)
              CALL SP_CLOSE (INUN,IERR)
              CALL SP_RETCODE (IERR)
```

```
! Listen to the processed sentence

                IO_UN = OUTUN
                FILENAM = OUTFILE
                LENG = LENGTH2
                IF (IPLOUT .EQ. 1) THEN
                        IO_UN = INUN
                        FILENAM = INFILE
                        LENG = LENGTH1
                END IF
                CALL SP_OPEN_OLD (IO_UN,'#'//FILENAM(1:LENG),IERR)
                CALL SP_RETCODE (IERR)
                CALL SP_GET_HEADER (IO_UN,HEADER,IERR)
                CALL SP_RETCODE (IERR)
                ISMPRD1 = SD_SAMPERIOD
                IDATYP1 = SD_DATATYPE
                LPC1 = SD_ORDRLPC
                NFRM1 = SP_NUMFRAMES
                FRPRD1 = SP_FRPERIOD
                ALPHA1 = SP_PREEMPH
                NWORDS = NFRM1 * (LPC1+2)
                CALL SP_READ (IO_UN, 1, 1, NWORDS, IDIDNT, IPARAM, IERR)
                CALL SP_RETCODE (IERR)
                CALL LPC_SPEAK3 (IPARAM, NFRM1, LPC1, ISMPRD1,
        1                        FRPRD1, ALPHA1, DTOA, IERR)
                CALL SP_RETCODE (IERR)
                CALL SP_CLOSE (IO_UN,IERR)
                CALL SP_RETCODE (IERR)
                GO TO 60
        END IF
        IF (IDO .LE. 34) THEN
                CALL TPOSCR (22,4)
                ENCODE (15,65,CHAR_STR) FFPARAM(IDO)
65              FORMAT (F10.4)
                CALL TPUTST ('Old parameter value >'//CHAR_STR(1:15))
                CALL TPOSCR (23,4)
                CALL TPUTST ('New parameter value >')
                CALL TPOSCR (23,26)
                ACCEPT 70, LONG, TEMP
70              FORMAT (Q,F10.4)
                IF (LONG .GT. 0) FFPARAM(IDO) = TEMP
                CALL TPOSCR(22,1)
                CALL TCEOL
                CALL TPOSCR(23,1)
                CALL TCEOL
                GO TO 60
        END IF

        IEXPER = FFPARAM(1)
        IFORM(1) = FFPARAM(2)
        IFORM(2) = FFPARAM(3)
        IFORM(3) = FFPARAM(4)
        IFORM(4) = FFPARAM(5)
        IFORM(5) = FFPARAM(6)
        ERRTHR(1) = FFPARAM(7)
        ERRTHR(2) = FFPARAM(8)
        ERRTHR(3) = FFPARAM(9)
        ERRTHR(4) = FFPARAM(10)
        ERRTHR(5) = FFPARAM(11)
        STEP(1) = FFPARAM(12)
        STEP(2) = FFPARAM(13)
        STEP(3) = FFPARAM(14)
        STEP(4) = FFPARAM(15)
        STEP(5) = FFPARAM(16)
        MAXFITCF = FFPARAM(17)
        MAXFITBW = FFPARAM(18)
        MAXFITRP = FFPARAM(19)
        MAXFITE = FFPARAM(20)
        MAXFITP = FFPARAM(21)
```

```
      STEP(6) = FFPARAM(22)
      STEP(7) = FFPARAM(23)
      IFORM(6) = FFPARAM(24)
      IFL = FFPARAM(25)
      ALPHA = FFPARAM(26)
      FRAME = FFPARAM(27)
      WIND = FFPARAM(28)
      IANAL = FFPARAM(29)
      LPC = FFPARAM(30)
      BWTH_UP = FFPARAM(31)
      BWTH_LO = FFPARAM(32)
      IQNT = FFPARAM(33)
      IPLOUT = FFPARAM(34)

      JND = .FALSE.
      ERTHJND = .FALSE.
      QNT = .TRUE.
      IF (IQNT .NE. 1) QNT = .FALSE.
      IF (IEXPER.EQ.1 .OR. IEXPER.EQ.2) THEN
              IF (IEXPER .EQ. 1) JND = .TRUE.
              IF (IEXPER .EQ. 2) ERTHJND = .TRUE.
              QNT = .FALSE.
      END IF


100   IF (JND) THEN
              CALL GET_I4
      1        ('Param for JND(1=CF,2=BW,3=LAR-1,4=LAR-2,5=En,6=Ptch)',
      2                                        JNDPAR, JNDPAR)
              CALL GET_I4 ('Coeff. order to be quantized', JNDCOEF, JN
              CALL GET_R4 ('Quantization step size', STEPJND, STEPJND)
      END IF
      IF (ERTHJND) THEN
              CALL GET_I4
      1 ('Threshold for CF(1), BW(2), LAR(3), enrg(4), ptch(5)',IERTH,
              CALL GET_R4 ('Value of error threshold',VERTH,VERTH)
              ERRTHR(IERTH) = VERTH
      END IF
C
C     LGND COEFF STATISTICS FILE
C
      IF (QNT) THEN
              BITCF = INT (LOG(MAXFITCF-1.)/LOG(2.)) + 1
              BITBW = INT (LOG(MAXFITBW-1.)/LOG(2.)) + 1
              BITRP = INT (LOG(MAXFITRP-1.)/LOG(2.)) + 1
              BITE = INT (LOG(MAXFITE-1.)/LOG(2.)) + 1
              BITP = INT (LOG(MAXFITP-1.)/LOG(2.)) + 1
              CALL GET_STRING
      1       ('Lgnd coeff. histogram file (Default: LGNDHIS.DAT)',
      2                                        STFILE,LENGT)
              IF (LENGT.EQ.0) THEN
                      STFILE = 'UD:[PANOS.ROOTS]LGNDHIS.DAT'
                      LENGT = 27
              END IF
              STUN = 15
              CALL SP_OPEN_OLD (STUN,'#'//STFILE(1:LENGT),IERR)
              CALL SP_RETCODE (IERR)
      END IF

      INFILE1 = INFILE
      LENGTH11 = LENGTH1
      CALL GET_STRING ('Input file (Def: previous file)',INFILE,LENGTH
      IF (LENGTH1.EQ.0) THEN
              INFILE = INFILE1
              LENGTH1 = LENGTH11
      END IF
      CALL SP_OPEN_OLD (INUN,'#'//INFILE(1:LENGTH1),IERR)
      CALL SP_RETCODE (IERR)
      CALL SP_GET_HEADER (INUN,HEADER,IERR)
      CALL SP_RETCODE (IERR)
```

```
        IF (SD_DATATYPE .NE. 1) THEN
                LPC=SD_ORDRLPC
                INUMFR=SP_NUMFRAMES
        END IF
        NQUAD=(LPC+1)/2
        FREQ=5.E5/FLOAT(SD_SAMPERIOD)
        IF (ABS(FREQ-4000.) .GT. 2.)
        1       TYPE *, 'CAUTION: Sampling freq .NE. 8 KHz !!!!!!'
        FS = 2.*FREQ
        IFRAME=FRAME*1000./FLOAT(SD_SAMPERIOD)+.5
        IWIND=WIND*1000./FLOAT(SD_SAMPERIOD)+.5
        CALL CLEAR (SPEECH(1),1024)
        ALPHA1 = 0.9375             ! Preemphasis const.
        SLAST=0.                    ! Previous frame's last value


        IF (IPLOUT .NE. 1) THEN
                CALL GET_STRING ('Output analysis file (Default: RC.LPC)'
                                                        OUTFILE,LENGTH2)
        1
                IF (LENGTH2 .EQ. 0) THEN
                        OUTFILE = 'UD:[PANOS.ROOTS]RC.LPC'
                        LENGTH2 = 22
                END IF
                ISAMPD=SD_SAMPERIOD
                IDATATP=SD_DATATYPE
                CALL DOUBLE (SD_NAME(1),%REF(NAME),4)
                CALL DOUBLE (SD_DESCR(1),%REF(NDESCR),39)
                CALL SP_OPEN_NEW ('#'//OUTFILE(1:LENGTH2),NAME,IDATATP,I
        1                                       NDESCR,OUTUN,NEWID,IERR)
                CALL SP_RETCODE (IERR)
                CALL SP_PUT_HEADER (OUTUN,HEADER,IERR)
                CALL SP_RETCODE (IERR)
        END IF
C
C*********************************************************************
C       INITIALIZATION
C*********************************************************************
C
        IF (QNT) THEN ! create coding / decoding tables.
                CALL CDRTTRK (STUN, ICPTR, CODE, DECODE, IFORM, STEP)
                CALL SP_CLOSE (STUN,IERR)
                CALL SP_RETCODE (IERR)
        END IF
        LFRAME=LPC+2
        NFRAME=LFRAME
        IFIRST = 1
        NUMFR = 800
        IF (SD_DATATYPE .NE. 1) NUMFR = INUMFR
        IF (SD_DATATYPE .EQ. 1) THEN ! input file is a DS file
                SP_FRPERIOD = FRAME
                IF (IANAL.EQ.1) CALL HAMWIN (IWIND)
C
C       PITCH TRACKING
C
                ISAMP=SD_SAMPERIOD
                CALL PTOPTT (INUN,FRAME,10.,2.,25.,8.,ISAMP,NSAMP,IP)
        END IF
        IF (IPLOUT .EQ. 1) THEN
                CALL GET_I4 ('Color (0) or B&W (1-2) Grinnell',ICOL_BW,IC
                IF (ICOL_BW .EQ. 0) THEN
                        CALL GR_INIT ('GRNLCOL', ISTAT)
                        JCHAN = 0
!                       CALL LOADCTAB (JCHAN)
                        ICHAN = 7
                ELSE
                        CALL GR_INIT ('GRNLB&W', ISTAT)
                        ICHAN = ICOL_BW
                END IF
                IF (.NOT.ISTAT) STOP 'GRINNELL is tied up'
                CALL GR_ERASE (ICHAN)
```

```
                CALL GR_SEND
                IGRSCALE = 15
                IF (ICOL_BW .EQ. 0) IGRSCALE = 255
        END IF
120     IF (IPLOUT .EQ. 1) THEN
                CALL GET_I4 ('Plot data(1), Lpnd fit(2), or both(3)',3,IP
                IF (ICOL_BW .EQ. 0) IDF = IDF + 10
                CALL GET_I4
        1       ('Plot 1=CF, 2=BW, 3=K1, 4=K2, 5=Energy, 6=Pitch',1,ICFE
                CALL GET_I4 ('First frame',IFIRST,IFIRST)
                CALL GET_I4 ('Number of frames',NUMFR,NUMFR)
        END IF
        LAG = MIN (LBUF-1, NUMFR-1)
        CALL CLEAR (PEPNTR(1,1), 2*LBUF)
        CALL CLEAR (PTCH_EN(1,1), 2*LBUF)
        CALL CLEAR (A(1), 30)
        DO  I=1,5
                PNTR (LBUF, I) = -1
                PNTR (LBUF-1, I) = -1
                PNTR (LBUF-2, I) = -1
                PNTR_BCK (LBUF, I) = -1
                PNTR_BCK (1, I) = -1
        END DO

C
        NFRMIN = MIN (IFIRST, NUMFR)
        NFRMAX = MIN (NUMFR+IFIRST-1, NUMFR)
        NNFRMX = NFRMAX
C
C*********************************************************************
C       INPUT DATA FROM SPEECH OR ANALYSIS FILE, AND COMPUTE LPC POLES
C*********************************************************************
C
        NFR = NFRMIN - 1
130     NFR=NFR+1

        IF (SD_DATATYPE .EQ. 1) THEN      ! digitized speech file.
                CTIME = (NFR-0.5)*FRAME/1000.
                CALL SP_GET_FRAME (INUN,CTIME,WIND,INSPEECH,IWIND,IERR)
                IF (IERR.EQ.1601) NFRMAX = NFR  ! End of file
                IF (IERR .NE. 1601) CALL SP_RETCODE (IERR)

                DO I = IWIND,2,-1                 ! Preemphasis
                        SPEECH(I)=INSPEECH(I)-ALPHA1*INSPEECH(I-1)
                END DO
                SPEECH(1)=INSPEECH(1)-ALPHA1*SLAST
                SLAST=INSPEECH(IFRAME)

C
C       PROCESS SPEECH AND COMPUTE THE REFLECTION COEFFICIENTS
C
C
C       BURG'S METHOD
C
                IF (IANAL.EQ.0) THEN
                        ENERGY=0.
                        DO 140 I=1,IWIND
140                     ENERGY=ENERGY+SPEECH(I)**2
                        NWORDS=2*IWIND
                        CALL DOUBLE (SPEECH(1),FORW(1),NWORDS)
                        CALL DOUBLE (SPEECH(1),BACK(1),NWORDS)
C
                        CALL BURG1 (1,LPC,FORW,BACK,RC,IWIND)
                ELSE
C
C       AUTOCORRELATION ANALYSIS
C
                        CALL AUTOC1 (SPEECH,LPC,FORW)
                        CALL LGSOL (FORW,LPC,RC,BACK)
                        DO 150 I=1,LPC
```

```
150                     RC(I)=-RC(I)
                        ENERGY = FORW(1)/0.3974
                END IF
                INPARAM(1) = SQRT(ENERGY/FLOAT(IWIND))
                INPARAM(2) = IP(NFR)
                DO I = 1,LPC
                        INPARAM(2+I) = RC(I) * 32768.
                END DO
        ELSE    ! the input is an analysis file.
                CALL SP_READ (INUN,LFRAME,NFR,NFRAME,IDIDNT,INPARAM,IERR)
                CALL SP_RETCODE (IERR)
        END IF
C

        INDX = MOD (NFR-1, LBUF) + 1 ! pointer of the circular buffer
        INDX_M1 = INDX - 1
        IF (INDX_M1 .EQ. 0) INDX_M1 = LBUF
        INDX_M2 = INDX_M1 - 1
        IF (INDX_M2 .EQ. 0) INDX_M2 = LBUF
        INDX_M3 = INDX_M2 - 1
        IF (INDX_M3 .EQ. 0) INDX_M3 = LBUF
        INDX_P1 = MOD (INDX, LBUF) + 1
        IF (NUMFR .LT. LBUF) INDX_P1 = 1

        IF (INPARAM(1).LT.3 .AND. INPARAM(2).EQ.0) THEN
                DO I=1,LPC+2
                        INPARAM(I) = 0
                END DO
        END IF
        DO 170 I=3,LPC+2
170     RC(I)=FLOAT(INPARAM(I))/32768.
        PTCH_EN(1,INDX) = INPARAM(1)
        PTCH_EN(2,INDX) = INPARAM(2)

C
        CALL K_TO_F (RC(3), LPC, CFIN, BWIN, ICX, FS, IER)
        IF (IER .EQ. 1) STOP 'POLYFACTR did not converge'
C
C*****************************************************************
C       SORT THE POLES BY ANGLE
C*****************************************************************
C
        MREAL = 15
        NREAL = 0
        RPMAX = 0
        DO 200 I=1,NQUAD
        IOR(I) = I
        IF (ICX(I) .EQ. 0) THEN ! real pole
                NREAL = NREAL + 1
                IANGLE(I) = FS
                RP1 = SIGN (EXP(-ABS(CFIN(I))*PI/FS), CFIN(I))
                RP2 = SIGN (EXP(-ABS(BWIN(I))*PI/FS), BWIN(I))
                IF (MAX (RP1, RP2) .GT. RPMAX) THEN
                        RPMAX = MAX (RP1, RP2)
                        MREAL = I
                END IF
        ELSE ! complex pole
                IANGLE(I) = CFIN(I)
        END IF
200     CONTINUE
        IANGLE(MREAL) = 0

        CALL BFIS (IANGLE, 1, NQUAD, 1, IOR) ! sort by angle


        DO 220 I=1,NQUAD
                ICFL (I, INDX) = ICX (IOR(I))
                CF (INDX, I) = CFIN (IOR(I))
                BW (INDX, I) = BWIN (IOR(I))
220     CONTINUE
```

```
      NNZP(INDX) = NQUAD-NREAL
      IF (ICFL (1,INDX) .EQ. 0) THEN ! retain largest real pole
              NNZP(INDX) = NNZP(INDX) + 1
              RP1 = SIGN (EXP(-ABS(CF(INDX,1))*PI/FS), FLOAT(CF(INDX,1)
              RP2 = SIGN (EXP(-ABS(BW(INDX,1))*PI/FS), FLOAT(BW(INDX,1)
              RPMAX = MAX (RP1, RP2)
              RPMIN = MIN (RP1, RP2)
              BW (INDX, NQUAD+1) = SIGN (-FS*LOG(ABS(RPMIN))/PI, RPMIN)
              BW (INDX, 1) = -FS*LOG(RPMAX)/PI
               CF (INDX, 1) = 0
       END IF
       IF (NNZP(INDX) .EQ. 0) TYPE *,'All negative real poles in frame

       DO I = 2, NQUAD
               IF (ICFL (I,INDX) .EQ. 0) THEN
                       PNTR (INDX, I) = -1
                       PNTR_BCK (INDX, I) = -1
               END IF
       END DO

       IF (NFR .EQ. NFRMIN) GO TO 130  ! at the beginning skip trackin
C
C*********************************************************************
C      APPLY DYNAMIC PROGRAMMING TO FIND THE BEST PATHS FOR FORMANTS
C*********************************************************************
C
       DO 240 JP=1,NNZP(INDX_M1) ! look forward from each pole
               DIST_MIN (JP) = 1E30
       DO 240 JP1=1,NNZP(INDX) ! to all poles of the next frame
               DISTOR = COST (CF(INDX_M1,JP), CF(INDX,JP1), BW(INDX_M1,
       1                       BW(INDX,JP1), ALPHA, IFL)
               IF (DISTOR .GE. DIST_MIN(JP)) GO TO 240
               DIST_MIN(JP) = DISTOR
               PNTR (INDX_M1, JP) = JP1
240    CONTINUE

C
C*******************************************************************
C        BREAK MULTIPLE BRANCHES.
C*******************************************************************
C

       DO 280 I=1,NNZP(INDX)
       CONVERGE = .FALSE.
       NEXT = -1
       DO 260 J=1,NNZP(INDX_M1)
       IF (PNTR (INDX_M1, J) .NE. I) GO TO 260
       IF ((CF (INDX_M1, J) .EQ. 0) .OR. (CF (INDX, I) .EQ. 0)
       1 .OR. (BW (INDX,I) .GT. BWTH_UP) .OR. (BW (INDX_M1,J) .GT. BWTH
       2       ) THEN ! isolate point: real pole(, or high BW).
               PNTR (INDX_M1, J) = -1
               GO TO 260
       END IF
       IF (CONVERGE) THEN ! separate multiple branches
               IF (DIST_MIN (NEXT) .GE. DIST_MIN (J)) THEN
                       PNTR (INDX_M1,NEXT) = -1
                       NEXT = J
               ELSE
                       PNTR (INDX_M1,J) = -1
               END IF
       ELSE
               NEXT = J
               CONVERGE = .TRUE.
       END IF
260    CONTINUE
       PNTR_BCK (INDX, I) = NEXT
280    CONTINUE
C
C*********************************************************************
C      BREAK POINTS AT T-FUNCTION PEAKS, AT V-UV TRANSITIONS, AROUND
C      SILENCE, AND AT THE END OF THE SENTENCE.
C*********************************************************************
```

```
C
! Break points at T-Function peaks.

        T_FUNC (INDX) = (DIST(RC(3),A(3),LPC,1)+DIST(A(3),RC(3),LPC,1)-2.
        CALL DOUBLE (RC(1), A(1), 30)
        IF (T_FUNC(INDX_M1) .GT. 0.5   .AND.
        1                T_FUNC(INDX_M1) .GT. T_FUNC(INDX_M2)  .AND.
        2                T_FUNC(INDX_M1) .GT. T_FUNC(INDX)) THEN
                DO  J=1,NQUAD
                        PNTR(INDX_M2,J) = -1
                        PNTR_BCK(INDX_M1,J) = -1
                END DO
        END IF

! Break points at V-UV transitions

        IF ((PTCH_EN(2,INDX_M1).GT.0 .AND. PTCH_EN(2,INDX).EQ.0)  .OR.
        1       (PTCH_EN(2,INDX_M1).EQ.0 .AND. PTCH_EN(2,INDX).GT.0)) TH
                DO  J=1,NQUAD
                        PNTR(INDX_M1,J) = -1
                        PNTR_BCK(INDX,J) = -1
                END DO
        END IF

! Break points around silence

        IF ((PTCH_EN(1,INDX_M1).GT.0 .AND. PTCH_EN(1,INDX).EQ.0)  .OR.
        1       (PTCH_EN(1,INDX_M1).EQ.0 .AND. PTCH_EN(1,INDX).GT.0)) TH
                DO  J=1,NQUAD
                        PNTR(INDX_M1,J) = -1
                        PNTR_BCK(INDX,J) = -1
                END DO
        END IF

! Break point at the end of the sentence.

        IF (NFR .EQ. NFRMAX) THEN
                DO 320 I=1,NNZP(INDX)
320             PNTR(INDX,I) = -1
        ELSE IF (NFR-NFRMIN+1 .LT. LBUF) THEN   ! fill the buffer first
                GO TO 130
        END IF

C
C*****************************************************************
C         EXTRACT ROOT, BW, ENERGY, AND PITCH PATHS.
C*****************************************************************
C

340     FIRSTPASS = .TRUE.      ! is this the first track detected?
        ISOL_FRAME = .TRUE.

! Check:  silence
        IF (PTCH_EN (1,INDX_P1) .EQ. 0) THEN
                IF (FIRSTSILENCE) OVERHEAD = OVERHEAD + 7
                FIRSTSILENCE = .FALSE.
                DO I=1,LPC+2
                        OUTPARAM(I) = 0
                END DO
                IF (IPLOUT.NE.1) GO TO 720
                GO TO 740
        END IF
        FIRSTSILENCE = .TRUE.

! Check the roots of the frame

        DO 600 IPL=1,NNZP(INDX_P1)              !  <---  <--- Start big l
        IF (PNTR (INDX_P1, IPL) .LE. 0) THEN
                IF (PNTR (INDX_P1, IPL) .EQ. 0) ISOL_FRAME = .FALSE.
                GO TO 600
```

```
        END IF

! Dismantle high BW paths (in first pass)

        IF (FIRSTPASS) THEN
          CALL DOUBLE (PNTR(1,1), PNTR2(1,1), 8*LBUF)    ! PNTR2: for loca
          ICOUNT_MIN = 1000
          DO 380 JJ = 1, NNZP(INDX_P1)
                IF (PNTR(INDX_P1,JJ) .LE. 0) GO TO 380
                NSHARP = 0 ! examine the formant segment.
                IPOINTER = JJ
                ICOUNT = 0
360             ICOUNT = ICOUNT + 1
                INDX_PN = MOD (INDX_P1+ICOUNT-2, LBUF) +1
                IF (BW (INDX_PN, IPOINTER) .LT. BWTH_LO) NSHARP = NSHARP
                PNTR2 (INDX_PN, IPOINTER) = 0
                IPOINTER = PNTR (INDX_PN, IPOINTER)
                IF (IPOINTER .GT. 0  .AND.  ICOUNT .LT. LBUF-3) GO TO 360
                IF (NSHARP .LT. ICOUNT/2) THEN ! dismantle track.
                        IPOINTER = JJ
                        DO I = INDX_P1, INDX_P1+ICOUNT-1
                                II = MOD (I-1, LBUF) + 1
                                ITEMP = PNTR (II, IPOINTER)
                                PNTR (II, IPOINTER) = -1
                                PNTR2 (II, IPOINTER) = -1
                                PNTR_BCK (II, IPOINTER) = -1
                                IPOINTER = ITEMP
                        END DO
                ELSE ! set break point at the end of the track.
                        IF (ICOUNT.EQ.LBUF-3 .AND. JJ.NE.NNZP(INDX_P1))
                                                                GO TO 380
     1                  IF (ICOUNT .LT. ICOUNT_MIN) ICOUNT_MIN = ICOUNT
                        IFR = MOD (INDX_P1+ICOUNT-2, LBUF) + 1
                        IFR_P1 = MOD (IFR, LBUF) + 1
                        DO I = 1, NQUAD
                                PNTR (IFR, I) = -1
                                PNTR2 (IFR, I) = -1
                                PNTR_BCK (IFR_P1, I) = -1
                        END DO
                END IF
380       CONTINUE
          IF (ICOUNT_MIN .EQ. 1000) GO TO 600
          DO ITF = 2, ICOUNT_MIN
            INDX_PN = MOD (INDX_P1+ITF-2, LBUF) + 1
            DO 420 JJ = 1, NNZP(INDX_PN)
                IF (PNTR2(INDX_PN,JJ) .LE. 0) GO TO 420
                NSHARP = 0 ! examine the formant segment.
                IPOINTER = JJ
                ICOUNT = 0
400             ICOUNT = ICOUNT + 1
                INDX_PNN = MOD (INDX_PN+ICOUNT-2, LBUF) +1
                IF (BW (INDX_PNN, IPOINTER) .LT. BWTH_LO) NSHARP = NSHARP
                PNTR2 (INDX_PNN, IPOINTER) = 0
                IPOINTER = PNTR (INDX_PNN, IPOINTER)
                IF (IPOINTER .GT. 0) GO TO 400
                IF (NSHARP .LT. ICOUNT/2) THEN ! dismantle track.
                        IPOINTER = JJ
                        DO I = INDX_PN, INDX_PN+ICOUNT-1
                                II = MOD (I-1, LBUF) + 1
                                ITEMP = PNTR (II, IPOINTER)
                                PNTR (II, IPOINTER) = -1
                                PNTR2 (II, IPOINTER) = -1
                                PNTR_BCK (II, IPOINTER) = -1
                                IPOINTER = ITEMP
                        END DO
                ELSE ! set break point at the beginning of the track and
                        IFR_M1 = INDX_PN - 1
                        IF (IFR_M1 .EQ. 0) IFR_M1 = LBUF
                        DO I = 1, NQUAD
                                PNTR (IFR_M1, I) = -1
```

```
                                PNTR2 (IFR_M1, I) = -1
                                PNTR_BCK (INDX_PN, I) = -1
                        END DO
                        IF (IFR_M1 .EQ. INDX_P1) GO TO 600
                        GO TO 440
                END IF
420         CONTINUE
          END DO
440       CALL DOUBLE (PNTR(1,1), PNTR1(1,1), 8*LBUF)
          IF (PNTR (INDX_P1, IPL) .LE. 0) GO TO 600
        END IF


! Extract the acceptable paths

        NREC = NREC + 1 ! count the number of segmentations.
        ICOUNT = 0      ! extract formant segment.
        IPOINTER = IPL
460     ICOUNT = ICOUNT + 1
        INDX_PN = MOD (INDX_P1+ICOUNT-2, LBUF) +1
        PLT (ICOUNT) = CF (INDX_PN, IPOINTER)
        BWST (ICOUNT) = BW (INDX_PN, IPOINTER)
        IF (FIRSTPASS) THEN
                EN(ICOUNT) = PTCH_EN (1, INDX_PN)
                PT(ICOUNT) = PTCH_EN (2, INDX_PN)
        END IF
        IPOINTER = PNTR (INDX_PN, IPOINTER)
        IF (IPOINTER .GT. 0  .AND.  ICOUNT .LT. LBUF-3) GO TO 460
        IPOINTER = IPL
        DO 480 I=0,ICOUNT-1
                INDX_PN = MOD (INDX_P1+I-1, LBUF) + 1
                ITEMP = PNTR (INDX_PN, IPOINTER)
                PNTR (INDX_PN, IPOINTER) = 0
                IPOINTER = ITEMP
480     CONTINUE
        LREC = LREC + ICOUNT     ! total # of frames fitted by polyn.


C
C*********************************************************************
C       FIT LEGENDRE POLYNOMIALS FOR PLOTTING.
C*********************************************************************
C

        IF (IPLOUT .EQ. 1) THEN ! plot

! Plot CF

                IF (ICFBW .EQ. 1) THEN
                        MAXFIT = MAXFITCF
                        LGND = MAXFITCF
                        IFLG = IFORM(2)
                        CALL RTCONVERT (PLT, ICOUNT, PLT, FMIN, FMAX, FS,
                        CALL LGND_FIT (PLT, ICOUNT, LGND, MAXFIT,
        1                       ERRTHR(1), ERR, FMIN, FMAX, CL, DUMMY)
                        IF (QNT .AND. EN(1).GT.1E-4) THEN        ! Quantiz
                                DO I = 1,LGND
                                        CALL CODER (CL(I),CODE(ICPTR(2*I-
        1                               ICPTR(2*I),ICODE)
                                        CL(I) = DECODE (ICPTR(2*I-1)+ICOD
                                END DO
                        END IF
                        CALL GR_FIT_PLOT (ICHAN, PLT, ICOUNT,
        1                       NFR-NFRMIN+1-LAG, NNFRMX-NFRMIN+1, LGND,
        2                       CL, FMIN, FMAX, FMIN, FMAX, IDF)

! Plot BW

                ELSE IF (ICFBW.EQ.2 .AND. IFORM(3).LE.3) THEN
                        MAXFIT = MAXFITBW
```

```
                    LGND = MAXFITBW
                    IFLG = IFORM(3) + 3
                    CALL RTCONVERT (BWST, ICOUNT,BWST,FMIN, FMAX, FS,
                    CALL LGND_FIT (BWST, ICOUNT, LGND, MAXFIT,
     1                      ERRTHR(2), ERR, FMIN, FMAX, CL, DUMMY)
                    IF (QNT .AND. EN(1).GT.1E-4) THEN        ! Quantiz
                            DO I = 1,LGND
                                    CALL CODER (CL(I),CODE(ICPTR(16+2*
     1                              +1),ICPTR(16+2*I),ICODE)
                                    CL(I) = DECODE(ICPTR(16+2*I-1)+IC
                            END DO
                    END IF
                    CALL GR_FIT_PLOT (ICHAN, BWST, ICOUNT,
     1                      NFR-NFRMIN+1-LAG, NNFRMX-NFRMIN+1, LGND,
     2                      CL, FMIN, FMAX, FMIN, FMAX, IDF)
                    STIME = SP_FRPERIOD * 1E-3 * FLOAT(NFRMIN-1)
                    SEC = SP_FRPERIOD * 1E-3 * FLOAT(NNFRMX-NFRMIN)
                    MAXPIX = 1024
                    IF (ICOL_BW .EQ. 0) MAXPIX = 512
                    ILOC = 0.55*MAXPIX
                    CALL GR_TIC_MARKS (ICHAN, IGRSCALE, MAXPIX, 0.,1.
     1                      STIME, SEC, 10.0, MAXPIX, ILOC, 0.02, 0.1
C                   CALL GR_SIGN (620,280)
                    CALL VTON (CHAR)
                    CALL VTWAIT
                    CALL GR_ERASE (ICHAN)
                    CALL GR_SEND

! Plot energy

            ELSE IF (ICFBW.EQ.5 .AND. FIRSTPASS) THEN
                    IADD = 16
                    IF (IFORM(3) .LE. 3) IADD = IADD + 16
                    IF (IFORM(6) .LT. 0) THEN
                            IADD = IADD + 32
                    ELSE
                            IADD = IADD + 4
                    END IF
                    MAXFIT = MAXFITE
                    LGND = MAXFITE
                    IFLG = IFORM(4) + 7
                    CALL RTCONVERT (EN, ICOUNT, EN, FMIN, FMAX, FS, I
                    CALL LGND_FIT (EN, ICOUNT, LGND, MAXFIT, ERRTHR(4
     1                      ERR, FMIN, FMAX, CL, DUMMY)
                    IF (QNT .AND. CL(1).NE.0.) THEN ! Quantize
                            DO I = 1,LGND
                                    CALL CODER (CL(I),CODE(ICPTR(IADD
     1                                 2*I-1)+1),ICPTR(IADD+2*I),ICOD
                                    CL(I) = DECODE (ICPTR(IADD+2*I-1)
     1                                                   ICODE)
                            END DO
                    END IF
                    CALL GR_FIT_PLOT (ICHAN, EN, ICOUNT, NFR-NFRMIN+1
     1                      NNFRMX-NFRMIN+1, LGND, CL,
     2                              FMIN, FMAX, FMIN, FMAX, IDF)

! Plot pitch

            ELSE IF (ICFBW.EQ.6 .AND. FIRSTPASS) THEN
                    IADD = 48
                    IF (IFORM(3) .LE. 3) IADD = IADD + 16
                    IF (IFORM(6) .LT. 0) THEN
                            IADD = IADD + 32
                    ELSE
                            IADD = IADD + 4
                    END IF
                    MAXFIT = MAXFITP
                    LGND = MAXFITP
                    IFLG = MOD (IFORM(5)+9, 10)
```

```
                CALL RTCONVERT (PT, ICOUNT, PT, FMIN, FMAX, FS, I
                CALL LGND_FIT (PT, ICOUNT, LGND, MAXFIT, ERRTHR(5
     1                  ERR, FMIN, FMAX, CL, DUMMY)
                IF (QNT .AND. CL(1).NE.0.) THEN ! Quantize
                        DO I = 1,LGND
                                CALL CODER (CL(I),CODE(ICPTR(IADD
     1                             2*I-1)+1),ICPTR(IADD+2*I),ICO(
                                CL(I) = DECODE (ICPTR(IADD+2*I-1)
     1                                                  ICODE)
                        END DO
                END IF
                CALL GR_FIT_PLOT (ICHAN, PT, ICOUNT, NFR-NFRMIN+1
     1                  NNFRMX-NFRMIN+1, LGND, CL,
     2                          FMIN, FMAX, FMIN, FMAX, IDF)
            END IF
C
C*********************************************************************
C       FIT LEGENDRE POLYNOMIALS FOR OUTPUT.
C*********************************************************************
C
        ELSE    ! prepare output
            DO I = 1,ICOUNT
                X(I) = -1. + 2. * (I-1.) / (ICOUNT-1.)
            END DO

            IF (QNT) OVERHEAD = OVERHEAD + 9

! Compute CF

            MAXFIT = MAXFITCF
            LGND = MAXFITCF
            IFLG = IFORM(2)
            CALL RTCONVERT (PLT, ICOUNT, PLT, FMIN, FMAX, FS, IFLG)
            CALL LGND_FIT (PLT, ICOUNT, LGND, MAXFIT,
     1                  ERRTHR(1), ERR, FMIN, FMAX, CL, DUMMY)
            IF (JND .AND. JNDCOEF.LE.LGND .AND. EN(1).GT.1E-4 .AND.
     1                  JNDPAR.EQ.1) THEN
                CL(JNDCOEF) = (INT(CL(JNDCOEF)
     2                          /STEPJND)+0.5) * STEPJND
                CALL ORTHPOL2 (CL,X,LGND,ICOUNT,DUMMY)
            END IF
            IF (QNT .AND. EN(1).GT.1E-4) THEN ! Quantize
                AVLGND(1) = AVLGND(1) + LGND
                IF (LGND.GT.MAXLGND(1)) MAXLGND(1) = LGND
                BITS(1) = BITS(1) + BITCF
                DO J = 1,LGND
                        BITS(1) = BITS(1) + ICPTR (2*J)
                        CALL CODER (CL(J),CODE(ICPTR(2*
     1                          J-1)+1),ICPTR(2*J),ICODE)
                        CL(J) = DECODE (ICPTR(2*J-1)+ICODE)
                END DO
                CALL ORTHPOL2 (CL,X,LGND,ICOUNT,DUMMY)
            END IF
            IFLG = IFLG + 10
            CALL RTCONVERT (DUMMY, ICOUNT, DUMMY, FMIN, FMAX, FS, IFL
            IPOINTER = IPL
            DO I= 1, ICOUNT
                II = MOD (INDX_P1+I-2, LBUF) + 1
                CF (II, IPOINTER) = DUMMY(I)
                IPOINTER = PNTR1 (II, IPOINTER)
            END DO

! Compute BW

            IF (IFORM(3) .LE. 3) THEN
                MAXFIT = MAXFITBW
                LGND = MAXFITBW
                IFLG = IFORM(3) + 3
                CALL RTCONVERT (BWST,ICOUNT,BWST, FMIN, FMAX, FS,
                CALL LGND_FIT (BWST, ICOUNT, LGND, MAXFIT,
     1                  ERRTHR(2), ERR, FMIN, FMAX, CL, DUMMY)
```

```
                IF (JND .AND. JNDCOEF.LE.LGND .AND. EN(1).GT.1E-4
1                       JNDPAR.EQ.2) THEN
                        CL(JNDCOEF) = (INT(CL(JNDCOEF)
2                               /STEPJND)+0.5) * STEPJND
                        CALL ORTHPOL2 (CL,X,LGND,ICOUNT,DUMMY)
                END IF
                IF (QNT .AND. EN(1).GT.1E-4) THEN ! Quantize
                        AVLGND(2) = AVLGND(2) + LGND
                        IF (LGND.GT.MAXLGND(2)) MAXLGND(2) = LGND
                        BITS(2) = BITS(2) + BITBW
                        DO J = 1,LGND
                                BITS(2) = BITS(2) + ICPTR (16+2*J
                                CALL CODER (CL(J),CODE(ICPTR(16+2
1                               J-1)+1),ICPTR(16+2*J),ICODE)
                                CL(J) = DECODE (ICPTR(16+2*J-1)+I
                        END DO
                        CALL ORTHPOL2 (CL,X,LGND,ICOUNT,DUMMY)
                END IF
                IFLG = IFLG + 10
                CALL RTCONVERT (DUMMY,ICOUNT,DUMMY,FMIN,FMAX, FS,
                IPOINTER = IPL
                DO I= 1, ICOUNT
                        II = MOD (INDX_P1+I-2, LBUF) + 1
                        BW (II, IPOINTER) = DUMMY(I)
                        IPOINTER = PNTR1 (II, IPOINTER)
                END DO
        ELSE IF (IFORM(3) .EQ. 4) THEN ! BW = const. = BW_FIXED
                IPOINTER = IPL
                DO I= 1, ICOUNT
                        II = MOD (INDX_P1+I-2, LBUF) + 1
                        BW (II, IPOINTER) = BW_FIXED
                        IPOINTER = PNTR1 (II, IPOINTER)
                END DO
        ELSE            ! BW = BW_FIXED + 0.1 * (CF-2000)
                IPOINTER = IPL
                DO I= 1, ICOUNT
                        II = MOD (INDX_P1+I-2, LBUF) + 1
                        BW (II, IPOINTER) = BW_FIXED
                        IF (CF(II,IPOINTER) .GT. 2000)
1                               BW (II, IPOINTER) = BW_FIXED + 0.
2                                       (CF (II, IPOINTER) - 2000
                        IPOINTER = PNTR1 (II, IPOINTER)
                END DO
        END IF

! Compute energy

        IF (FIRSTPASS) THEN
                IADD = 16
                IF (IFORM(3) .LE. 3) IADD = IADD + 16
                IF (IFORM(6) .LT. 0) THEN
                        IADD = IADD + 32
                ELSE
                        IADD = IADD + 4
                END IF
                MAXFIT = MAXFITE
                LGND = MAXFITE
                IFLG = IFORM(4) + 7
                CALL RTCONVERT (EN, ICOUNT, EN, FMIN, FMAX, FS, I
                CALL LGND_FIT (EN, ICOUNT, LGND, MAXFIT,
1                       ERRTHR(4), ERR, FMIN, FMAX, CL, DUMMY)
                IF (JND .AND. JNDCOEF.LE.LGND .AND. EN(1).GT.1E-4
1                       JNDPAR.EQ.5) THEN
                        CL(JNDCOEF) = (INT(CL(JNDCOEF)
2                               /STEPJND)+0.5) * STEPJND
                        CALL ORTHPOL2 (CL,X,LGND,ICOUNT,DUMMY)
                END IF
                IF (QNT .AND. CL(1).GT.1E-4) THEN ! Quantize
                        AVLGND(5) = AVLGND(5) + LGND
                        IF (LGND.GT.MAXLGND(5)) MAXLGND(5) = LGN
                        BITS(5) = BITS(5) + BITE
                        DO J = 1,LGND
```

```
                                        BITS(5) = BITS(5) + ICPTR (IADD+2
                                        CALL CODER (CL(J),CODE(ICPTR(IADD
     1                                  J-1)+1),ICPTR(IADD+2*J),ICODE)
                                        CL(J) = DECODE
     1                                          (ICPTR(IADD+2*J-1)+ICODE)
                                 END DO
                                 CALL ORTHPOL2 (CL,X,LGND,ICOUNT,DUMMY)
                         END IF
                         IFLG = IFLG + 10
                         CALL RTCONVERT (DUMMY,ICOUNT, DUMMY,FMIN,FMAX,FS,
                         DO I= 1, ICOUNT
                                 II = MOD (INDX_P1+I-2, LBUF) + 1
                                 PTCH_EN (1, II) = DUMMY(I)
                         END DO

! Compute Pitch

                         IF (PT(1) .LT. 1E-1) GO TO 590
                         IADD = 48
                         IF (IFORM(3) .LE. 3) IADD = IADD + 16
                         IF (IFORM(6) .LT. 0) THEN
                                 IADD = IADD + 32
                         ELSE
                                 IADD = IADD + 4
                         END IF
                         MAXFIT = MAXFITP
                         LGND = MAXFITP
                         IFLG = MOD (IFORM(5)+9, 10)
                         CALL RTCONVERT (PT, ICOUNT, PT, FMIN, FMAX, FS, I
                         CALL LGND_FIT (PT, ICOUNT, LGND, MAXFIT,
     1                           ERRTHR(5), ERR, FMIN, FMAX, CL, DUMMY)
                         IF (JND .AND. JNDCOEF.LE.LGND .AND. EN(1).GT.1E-
     1                           JNDPAR.EQ.6) THEN
                                 CL(JNDCOEF) = (INT(CL(JNDCOEF)
     2                                   /STEPJND)+0.5) * STEPJND
                                 CALL ORTHPOL2 (CL,X,LGND,ICOUNT,DUMMY)
                         END IF
                         IF (QNT .AND. EN(1).GT.1E-4 .AND.
     1                                   CL(1).GT.1E-4) THEN ! Quantize
                                 AVLGND(6) = AVLGND(6) + LGND
                                 IF (LGND.GT.MAXLGND(6)) MAXLGND(6) = LGN
                                 BITS(6) = BITS(6) + BITP
                                 DO J = 1,LGND
                                         BITS(6) = BITS(6) + ICPTR (IADD+
                                        CALL CODER (CL(J),CODE(ICPTR(IADD+
     1                                  J-1)+1),ICPTR(IADD+2*J),ICODE)
                                        CL(J) = DECODE
     1                                          (ICPTR(IADD+2*J-1)+ICODE)
                                 END DO
                                 CALL ORTHPOL2 (CL,X,LGND,ICOUNT,DUMMY)
                         END IF
                         IFLG = IFLG + 10
                         CALL RTCONVERT (DUMMY,ICOUNT, DUMMY,FMIN,FMAX,FS,I
                         DO I= 1, ICOUNT
                                 II = MOD (INDX_P1+I-2, LBUF) + 1
                                 PTCH_EN (2, II) = DUMMY(I)
                         END DO
590                      CONTINUE
                 END IF
        END IF

        FIRSTPASS = .FALSE.
        ISOL_FRAME = .FALSE.

600     CONTINUE

C
C*********************************************************************
C       COMPUTE LAR-1 AND LAR-2 OF RESIDUAL POLYNOMIAL.
C*********************************************************************
C
```

```
      IF (.NOT.FIRSTPASS .AND. EN(1).GT.1E-4) THEN
              LAR_INDEX = 0
              CALL CLEAR (FLAR(1,1), 4*LBUF)
              DO  I = 1,ICOUNT
                      INDX_PN = MOD (INDX_P1+I-2, LBUF) + 1
                      IF (ICFL(1,INDX_PN) .EQ. 0)
     1                        CF (INDX_PN, 1) = BW (INDX_PN, NQUAD+1)
                      IIND = 0
                      DO  J = 1,NQUAD
                              IF (PNTR(INDX_PN,J).LT.0 .AND.
     1                                PNTR_BCK(INDX_PN,J).LT.0) THEN
                                      IIND = IIND + 1
                                      ICXAUX(IIND) = ICFL(J, INDX_PN)
                                      CFAUX (IIND) = CF (INDX_PN, J)
                                      BWAUX (IIND) = BW (INDX_PN, J)
                              END IF
                      END DO
                      IF (IIND .NE. 0) THEN
                              CALL F_TO_LAR (CFAUX,BWAUX,ICXAUX,2*IIND,F
                              FLAR (I, 1) = RC (1)
                              FLAR (I, 2) = RC (2)
                      END IF
              END DO
      END IF

! Individual encoding of the residual polynomial

      IF (.NOT.FIRSTPASS .AND. EN(1).GT.1E-4 .AND. IFORM(6).GE.0 .AND. G
     1                                                                  TH
              IADD = 16
              IF (IFORM(3) .LE. 3) IADD = IADD + 16
              BITS(3) = BITS(3) + IFORM(6)
              DO I = 1,ICOUNT
                      DO J = 1,2
                              CALL CODER (FLAR(I,J), CODE (ICPTR(IADD+
     1                                  2*J-1)+1), ICPTR(IADD+2*J), ICOD
                              FLAR(I,J) = DECODE (ICPTR(IADD+2*J-1)+IC
                      END DO
              END DO
      END IF

! Time encoding of residual polynomial

      IF (.NOT.FIRSTPASS .AND. EN(1).GT.1E-4 .AND. IFORM(6).LT.0) THEN
              IF (IPLOUT.EQ.1 .AND. (ICFBW-3)*(ICFBW-4).NE.0) GO TO 61

! LAR-1 (RES. POL.)

              IADD = 16
              IF (IFORM(3) .LE. 3) IADD = IADD + 16
              MAXFIT = MAXFITRP
              LGND = MAXFITRP
              FMIN = -10.
              FMAX = 10.
              CALL LGND_FIT (FLAR(1,1), ICOUNT, LGND, MAXFIT,
     1                        ERRTHR(3), ERR, FMIN, FMAX, CL, DUMMY)
              IF (JND .AND. JNDCOEF.LE.LGND .AND. EN(1).GT.1E-4 .AND.
     1                        JNDPAR.EQ.3) THEN
                      CL(JNDCOEF) = (INT(CL(JNDCOEF)
     2                                /STEPJND)+0.5) * STEPJND
                      CALL ORTHPOL2 (CL,X,LGND,ICOUNT,DUMMY)
              END IF
              IF (QNT .AND. EN(1).GT.1E-4) THEN ! Quantize
                      AVLGND(3) = AVLGND(3) + LGND
                      IF (LGND.GT.MAXLGND(3)) MAXLGND(3) = LGND
                      BITS(3) = BITS(3) + BITRP
                      DO J = 1,LGND
                              BITS(3) = BITS(3) + ICPTR (IADD+2*J)
                              CALL CODER (CL(J),CODE(ICPTR(IADD+2*
     1                                J-1)+1),ICPTR(IADD+2*J),ICODE)
```

```
                                CL(J) = DECODE
     1                                          (ICPTR(IADD+2*J-1)+ICODE
                        END DO
                        IF (IPLOUT.NE.1) CALL ORTHPOL2 (CL,X,LGND,ICOUNT
                END IF
                IF (IPLOUT.EQ.1 .AND. ICFBW.EQ.3)
     1                  CALL GR_FIT_PLOT (ICHAN, FLAR(1,1), ICOUNT,
     2                          NFR-NFRMIN+1-LAG, NNFRMX-NFRMIN+1, LGND,
     3                          CL, FMIN, FMAX, FMIN, FMAX, IDF)
                IF (IPLOUT.NE.1) THEN
                        DO I = 1,ICOUNT
                                FLAR(I,1) = DUMMY(I)
                        END DO
                END IF

! LAR-2 (RES. POL.)

                LGND = MAXFITRP
                IADD = IADD + 16
                CALL LGND_FIT (FLAR(1,2), ICOUNT, LGND, MAXFIT,
     1                          ERRTHR(3), ERR, FMIN, FMAX, CL, DUMMY)
                IF (JND .AND. JNDCOEF.LE.LGND .AND. EN(1).GT.1E-4 .AND.
     1                          JNDPAR.EQ.4) THEN
                        CL(JNDCOEF) = (INT(CL(JNDCOEF)
     2                                  /STEPJND)+0.5) * STEPJND
                        CALL ORTHPOL2 (CL,X,LGND,ICOUNT,DUMMY)
                END IF
                IF (QNT .AND. EN(1).GT.1E-4) THEN ! Quantize
                        AVLGND(4) = AVLGND(4) + LGND
                        IF (LGND.GT.MAXLGND(4)) MAXLGND(4) = LGND
                        BITS(4) = BITS(4) + BITRP
                        DO J = 1,LGND
                                BITS(4) = BITS(4) + ICPTR (IADD+2*J)
                                CALL CODER (CL(J),CODE(ICPTR(IADD+2*
     1                                  J-1)+1),ICPTR(IADD+2*J),ICODE)
                                CL(J) = DECODE
     1                                          (ICPTR(IADD+2*J-1)+ICODE)
                        END DO
                        IF (IPLOUT.NE.1) CALL ORTHPOL2 (CL,X,LGND,ICOUNT,D
                END IF
                IF (IPLOUT.EQ.1 .AND. ICFBW.EQ.4)
     1                  CALL GR_FIT_PLOT (ICHAN, FLAR(1,2), ICOUNT,
     2                          NFR-NFRMIN+1-LAG, NNFRMX-NFRMIN+1, LGND,
     3                          CL, FMIN, FMAX, FMIN, FMAX, IDF)
                IF (IPLOUT.NE.1) THEN
                        DO I = 1,ICOUNT
                                FLAR(I,2) = DUMMY(I)
                        END DO
                END IF
        END IF

610     IF (IPLOUT .EQ. 1) GO TO 740

! Isolated frame;  Repeat previous frame

        IF (ISOL_FRAME) THEN
                OVERHEAD = OVERHEAD + 2
                GO TO 720
        END IF

C
C
C*********************************************************************
C               OUTPUT
C*********************************************************************
C

620     IF (ICFL(1,INDX_P1) .EQ. 0)
     1                  CF(INDX_P1,1) = BW (INDX_P1, NQUAD+1)
        NPOLES = 0
```

```
      DO 640 J=1,NQUAD
      IF (ICFL(J,INDX_P1).EQ.1 .AND. PNTR(INDX_P1,J).GE.0) THEN
              NPOLES = NPOLFS+1
              ICXAUX(NPOLES) = 1
              CFAUX(NPOLES) = CF(INDX_P1,J)
              BWAUX(NPOLES) = BW(INDX_P1,J)
      END IF
640   CONTINUE
      IADD = 0
      IF (NPOLES .EQ. NQUAD) THEN
              IF (IPLOUT.EQ.1) GO TO 740
              GO TO 660
      END IF


      LAR_INDEX = LAR_INDEX + 1
      RC(1) = FLAR (LAR_INDEX, 1)
      RC(2) = FLAR (LAR_INDEX, 2)
      CALL LAR_TO_F (RC, 2, CFAUX(NPOLES+1),
      1       BWAUX(NPOLES+1), ICXAUX(NPOLES+1), FS, IER)
      IF (IER .EQ. 1) STOP 'POLYFACTR did not converge'
      IADD = 1
660   CALL F_TO_K (CFAUX, BWAUX, ICXAUX, 2*(NPOLES+IADD), RC, FS)
      IF (NPOLES .LT. NQUAD-1) THEN
              DO 680 J= 2*(NPOLES+1)+1, 2*NQUAD
680           RC(J) = 0
      END IF


      OUTPARAM(1) = PTCH_EN(1,INDX_P1)
      OUTPARAM(2) = PTCH_EN(2,INDX_P1)
      DO 700 J=3,LPC+2
700   OUTPARAM(J) = RC(J-2) * 32768

720   CALL SP_WRITE
      1       (OUTUN, LFRAME, NFR-NFRMIN+1-LAG, NFRAME, OUTPARAM, IERR)
      CALL SP_RETCODE (IERR)

740   IF (NFR .EQ. NFRMAX) THEN
              LAG = LAG - 1
              IF (LAG .LT. 0) GO TO 750
              INDX_P1 = MOD (INDX_P1, LBUF) + 1
              GO TO 340
      END IF

      IF (NFR .LT. NFRMAX) GO TO 130  ! continue the big loop.

750   IF (IPLOUT .EQ. 1) THEN
              CALL DATE (KDATE)
              CALL TIME (KTIME)
              NCHAR = 64
              ENCODE (NCHAR,760,OUTSTRING) INFILE(1:LENGTH1),KDATE,KTIM
760           FORMAT (2X,'FILENAME: ',A,5X,A,5X,A)
              IF (ICOL_BW .NE. 0) THEN
                      IXFIRST = 104
                      IYFIRST = 825
                      IWIDTH = 25
                      IWCHAR = 8
                      WCHAR = 'H'
              ELSE
                      IXFIRST = 52
                      IYFIRST = 412
                      IWIDTH = 14
                      IWCHAR = 7
                      WCHAR = ' '
              END IF
              CALL GR_WRT_STR (ICHAN,IXFIRST,IYFIRST+4*IWIDTH,IWCHAR,0,
      1                                OUTSTRING(1:NCHAR),IGRSCALE,WCHAR
              IF (ICFBW .EQ. 1) INDADD = IFORM(2)
              IF (ICFBW .EQ. 2) INDADD = IFORM(3) + 3
```

```
                IF (ICFBW .EQ. 3) INDADD = 7
                IF (ICFBW .EQ. 4) INDADD = 8
                IF (ICFBW .EQ. 5) INDADD = IFORM(4) + 9
                IF (ICFBW .EQ. 6) INDADD = IFORM(5) + 11
                ENCODE (NCHAR,780,OUTSTRING) PAR(INDADD)(1:LEN(INDADD)),
     1                NFRMIN,NFRMAX
                CALL GR_WRT_STR (ICHAN,IXFIRST,IYFIRST+3*IWIDTH,IWCHAR,0,
     1                              OUTSTRING(1:NCHAR),IGRSCALE,WCHAR
                ENCODE (NCHAR,800,OUTSTRING) NDESCR(1:40)
                CALL GR_WRT_STR (ICHAN,IXFIRST,IYFIRST+1*IWIDTH,IWCHAR,0,
     1                              OUTSTRING(1:NCHAR),IGRSCALE,WCHAR
780             FORMAT (2X,'PARAM: ',A,5X,'FIRST FRAME: ',I3,4X,
     1                                      'LAST FRAME: ',I3)
800             FORMAT (2X,A)
                CALL GR_SEND

            IF (ICFBW .EQ. 1) THEN
                        STIME = SP_FRPERIOD * 1E-3 * FLOAT(NFRMIN-1)
                        SEC = SP_FRPERIOD * 1E-3 * FLOAT(NNFRMX-NFRMIN)
                        MAXPIX = 1024
                        IF (ICOL_BW .EQ. 0) MAXPIX = 512
                        ILOC = (0.3+0.5/4.)*MAXPIX
                        CALL GR_TIC_MARKS (ICHAN, IGRSCALE, MAXPIX, 0.,1.
     1                          STIME, SEC, 10.0, MAXPIX, ILOC, 0.02, 0.1
                        ILOC = (0.3+2.*0.5/4.)*MAXPIX
                        CALL GR_TIC_MARKS (ICHAN, IGRSCALE, MAXPIX, 0.,1.
     1                          STIME, SEC, 10.0, MAXPIX, ILOC, 0.02, 0.1
                        ILOC = (0.3+3.*0.5/4.)*MAXPIX
                        CALL GR_TIC_MARKS (ICHAN, IGRSCALE, MAXPIX, 0.,1.
     1                          STIME, SEC, 10.0, MAXPIX, ILOC, 0.02, 0.1
C                       CALL GR_SIGN (620,280)
            ELSE
                        STIME = SP_FRPERIOD * 1E-3 * FLOAT(NFRMIN-1)
                        SEC = SP_FRPERIOD * 1E-3 * FLOAT(NNFRMX-NFRMIN)
                        MAXPIX = 1024
                        IF (ICOL_BW .EQ. 0) MAXPIX = 512
                        ILOC = 0.55*MAXPIX
                        CALL GR_TIC_MARKS (ICHAN, IGRSCALE, MAXPIX, 0.,1.
     1                          STIME, SEC, 10.0, MAXPIX, ILOC, 0.02, 0.1
C                       CALL GR_SIGN (620,280)
            END IF
            CALL GET_I4 ('Enter 1=More plots, ELSE=Exit',1,ICONT)
            CALL GR_ERASE (ICHAN)
            CALL GR_SEND
            IF (ICONT .EQ. 1) GO TO 120
            IF (ICOL_BW .NE. 0) CALL GR_RELEASE ('GRNLB&W', ISTAT)
            IF (ICOL_BW .EQ. 0) CALL GR_RELEASE ('GRNLCOL', ISTAT)
        END IF

C
C       COMPUTE BIT RATE
C
        IF (QNT .AND. IPLOUT.NE.1) THEN
                OVERHEAD = OVERHEAD / FLOAT(NFRMAX-NFRMIN+1)
                TOTAL = OVERHEAD
                DO I = 1,6
                        BITS(I) = BITS(I) / FLOAT(NFRMAX-NFRMIN+1)
                        TOTAL = TOTAL + BITS(I)
                        AVLGND(I) = AVLGND(I) / FLOAT(NREC)
                END DO
                RECL = FLOAT(LREC) / FLOAT(NREC)
                TYPE 900, TOTAL,OVERHEAD,RECL,
     1                      (BITS(I),AVLGND(I),MAXLGND(I),I=1,6)
                LOGUN = 13
                OPEN (UNIT=LOGUN, FILE='UD:[PANOS.ROOTS]RTTRKLOG.DAT',
     1                          STATUS='UNKNOWN',ACCESS='APPEND')
                CALL DATE (KDATE)
                CALL TIME (KTIME)
                WRITE (LOGUN, 820) KDATE,KTIME,INFILE(1:LENGTH1),
     1                                          OUTFILE(1:LENGTH2)
```

```
820             FORMAT (////5X,A,5X,A/2X,'IN-FILENAME: ',A/
      1         1X,'OUT-FILENAME: ',A//)
                REWIND LUN
                I = 0
840             READ (LUN, 860, END=880) CHAR_STR
860             FORMAT (A)
                I = I + 1
                NST1 = INDEX (CHAR_STR, '!')
                NST2 = LENGTH(CHAR_STR)
                NCHAR = 13+NST2-NST1
                ENCODE (NCHAR,870,OUTSTRING) FFPARAM(I),CHAR_STR(NST1:NST2)
870             FORMAT (F10.4,2X,A)
                WRITE (LOGUN, 860) OUTSTRING(1:NCHAR)
                GO TO 840
880             WRITE (LOGUN, 900) TOTAL,OVERHEAD,RECL,
      1                      (BITS(I),AVLGND(I),MAXLGND(I),I=1,6)
900             FORMAT (//20X,'Total average bits/frame: ',F6.2//
      1                 5X,'Bits/frame for overhead: ',F6.2/
      2                 5X,'Average record length: ',F6.1/
      2                 13X,'Bits/frame',2X,'Ave. fit length',2X,
      3                 'Max fit length'/
      4                 5X,'Cent Freq',1X,F5.2,10X,F4.1,15X,I2/
      5                 5X,'Bandwdth',2X,F5.2,10X,F4.1,15X,I2/
      6                 5X,'LAR-1',5X,F5.2,10X,F4.1,15X,I2/
      7                 5X,'LAR-2',5X,F5.2,10X,F4.1,15X,I2/
      8                 5X,'Energy',4X,F5.2,10X,F4.1,15X,I2/
      9                 5X,'Pitch',5X,F5.2,10X,F4.1,15X,I2)
                CLOSE (UNIT=LOGUN)
        END IF

        CALL SP_CLOSE (INUN,IERR)
        CALL SP_RETCODE (IERR)
        IF (IPLOUT .NE. 1) CALL SP_CLOSE (OUTUN, IERR)
        CALL SP_RETCODE (IERR)
        CALL GET_STRING ('Type CR to continue',STFILE,LENGT)
        GO TO 40
920     CONTINUE
        CLOSE (LUN)
        END
        PROGRAM CODEC            ! FINAL VERSION
C
C*****************************************************************
C         This program accepts as input an analysis file of
C       reflection coefficients, encodes / decodes them
C       according to the specifications of a data file, and
C       outputs the new reflection coeff. to an analysis file.
C       Optionally, the program can adjust a parameter value
C       iteratively so that a desired bit rate is achieved.
C         The statistics file contains the histograms of the
C       LPC parameters to be used in encoding.
C         STRUCTURE OF DATA FILE (FREE FORMATED):
C
C               Desired bpf (0=no iterations)
C               1=adapt 1st param., 2=adapt 2nd param.
C               Flag:  1=LPC encoding, 2=Root encoding
C               Linear(1), Max entropy(2), Min deviation(3) Quant.
C               Energy bits/frame
C               Pitch bits/frame
C               1st parameter form (CF)
C               1st parameter step size
C               2nd parameter form (BW)
C               2nd parameter step size
C               Residual polynomial bits/frame
C               LPC parameters: RC(18), LAR(19), ASIN(20)
C               LPC encoding bits/frame
C
C       NOTE:  The 20 different parameter forms used are the following:
C               1) CENTER FREQUENCY (HZ)
C               2) LOG [CENT. FREQ.]  (DB)
C               3) MEL-FREQ=LOG(1+CF/1000) (DB)
```

```
C                4) CF - DIFFERENCES (HZ)
C                5) LOG[CF] - DIFFERENCES (DB)
C                6) MEL[CF] - DIFFERENCES (DB)
C                7) POLE MAGNITUDE
C                8) BANDWIDTH  (HZ)
C                9) SPECTRAL AMPLITUDE (DB)
C               10) 1ST REFLECTION COEF.
C               11) 2ND REFLECTION COEF.
C               12) 1ST LAR
C               13) 2ND LAR
C               14) 1ST ASIN(K)
C               15) 2ND ASIN(K)
C               16) 1ST LAR (1-4 POLE PAIRS) (RESID. POLYN.)
C               17) 2ND LAR (1-4 POLE PAIRS) (RESID. POLYN.)
C        Statistics are also computed for the following LPC
C        parameters (all 10 of them):
C                18) REFLECTION COEFFICIENTS
C                19) LAR
C                20) ASIN (K)
C
C        NOTE:  If a frame has no complex poles,
C                it is replaced by the previous frame.
C        NOTE:  If a frame has energy < 1, it is considered silence;
C                It is also considered silence if it is unvoiced
C                (pitch=0) and has energy < 3.
C*****************************************************************
C
         PARAMETER NF=20
        PARAMETER NPTS=128

        DIMENSION CODE(10000,2),DECODE(10000,2)
        DIMENSION ICPTR(100,2),IFORM(12),RCSTORE(15),PANGLE(15)
        DIMENSION RC(15),A(15),STEP(5),INP(4,2)
        DIMENSION CF(15), BW(15), CFIN(15), BWIN(15)

        INTEGER*2 INPARAM(15),OUTPARAM(15),INUN,OUTUN,STUN
        INTEGER*2 LFRAME,IERR,NFACTR,ISAMPD,IDATATP,LENGTH
        INTEGER*2 ICX(15), ICFL(15), IOR(15), IANGLE(15)

        CHARACTER*32 STFILE,INFILE,OUTFILE,INF1,OUTF1
        CHARACTER*78 NDESCR
        CHARACTER*8 NAME,LABEL
        LOGICAL*2 CONVERGE
        LOGICAL*2 FLAG          ! Flag to signal final choice of parameters
        INCLUDE 'UD:[PANOS.ROOTS]HEADER.FRM'


        FLAG = .FALSE.
        PI=ACOS(-1.)
        FREQ=4000.
        FS = 2. * FREQ
        STEPOLD = 0.
        BPFOLD = 0.
C
C*****************************************************************
C       OPEN ANALYSIS FILES AND INPUT ENCODING DATA
C*****************************************************************
C
120     CALL GET1_STRING ('Input analysis file',INFILE,LENGTH1)
        IF (LENGTH1.EQ.0) GO TO 120
        INUN=1
        CALL SP_OPEN_OLD (INUN,'#'//INFILE(1:LENGTH1),IERR)
        CALL SP_RETCODE (IERR)
        CALL SP_GET_HEADER (INUN,HEADER,IERR)
        CALL SP_RETCODE (IERR)
        NUMFR=SP_NUMFRAMES
        CALL GET1_STRING ('Output analysis file (Default: RC.LPC)',
                                                    OUTFILE,LENGTH2)
        1
        IF (LENGTH2.EQ.0) THEN
                OUTFILE = 'UD:[PANOS.ROOTS]RC.LPC'
                LENGTH2 = 22
```

```
      END IF
      OUTUN=2
      ISAMPD=SD_SAMPERIOD
      IDATATP=SD_DATATYPE
      CALL DOUBLE (SD_NAME(1),%REF(NAME),4)
      CALL DOUBLE (SD_DESCR(1),%REF(NDESCR),39)
      CALL SP_OPEN_NEW ('#'//OUTFILE(1:LENGTH2),NAME,IDATATP,ISAMPD,
     1        NDESCR,OUTUN,NEWID,IERR)
      CALL SP_RETCODE (IERR)
      CALL SP_PUT_HEADER (OUTUN,HEADER,IERR)
      CALL SP_RETCODE (IERR)
C
C     STATISTICS FILE
C
      CALL GET1_STRING ('Histogram file (Default: ROOT500A.DAT)',
                                                    STFILE,LENGTH)
     1
      IF (LENGTH.EQ.0) THEN
              STFILE = 'UD:[PANOS.ROOTS]ROOT500A.DAT'
              LENGTH = 28
      END IF
      STUN=4
      CALL SP_OPEN_OLD (STUN,'#'//STFILE(1:LENGTH),IERR)
      CALL SP_RETCODE (IERR)
      CALL SP_GET_HEADER (STUN,HEADER,IERR)
      CALL SP_RETCODE (IERR)
      BWTHR=SP_BWTHRESH
      LPC=SD_ORDRLPC
      NQUAD=(LPC+1)/2
C
C     QUANTIZATION FILE
C
      CALL GET1_STRING ('Quant. data file (Default: RTQNT.DAT)',
                                                    STFILE,LENGTH)
     1
      IF (LENGTH.EQ.0) THEN
              STFILE = 'UD:[PANOS.ROOTS]RTQNT.DAT'
              LENGTH = 25
      END IF
      LUN=3
      OPEN (UNIT=LUN,NAME=STFILE,TYPE='OLD')
      READ (LUN,*) BPF          ! Desired bpf (0=no iterations)
      READ (LUN,*) IPAR         ! 1=adapt 1st param., 2=adapt 2nd param.
      READ (LUN,*) IFORM(5)     ! Flag:  1=LPC encoding, 2=Root encoding
      READ (LUN,*) IFORM(1)     ! Linear(1), Max entr.(2), Min dev.(3) Qua
      READ (LUN,*) ICPTR(2,1)   ! Energy bits/frame
      READ (LUN,*) ICPTR(4,1)   ! Pitch bits/frame
      READ (LUN,*) IFORM(2)     ! 1st parameter form (CF)
      READ (LUN,*) STEP(1)      ! 1st parameter step size
      READ (LUN,*) IFORM(3)     ! 2nd parameter form (BW)
      READ (LUN,*) STEP(2)      ! 2nd parameter step size
      READ (LUN,*) IFORM(4)     ! Residual polynomial bits/frame
      READ (LUN,*) LPC_PARAM    ! LPC parameters: RC(18), LAR(19), ASIN(2(
      READ (LUN,*) LPC_BITS     ! LPC encoding bits/frame
      ICPTR(2,2)=ICPTR(2,1)
      ICPTR(4,2)=ICPTR(4,1)
      IF (IFORM(2).GE.10 .AND. IFORM(2).LE.14) THEN
              IFORM(3) = IFORM(2) + 1
              STEP(2) = STEP(1)
      END IF
      IF (IFORM(5) .EQ. 1) THEN
              IFORM(2) = LPC_PARAM
              IFORM(4) = LPC_BITS
      END IF
      CLOSE (UNIT=LUN)
C
C*********************************************************************
C     CREATE ENCODING / DECODING TABLES
C*********************************************************************
C
      STEP(3)=1.5*16./2.**ICPTR(2,1)  ! Step for energy
      CALL CDTABLES (LPC,STUN,ICPTR,CODE,DECODE,IFORM,STEP)
```

```
C
C*********************************************************************
C       INPUT REFLECTION COEFF. AND CONVERT THEM TO POLES
C*********************************************************************
C
140     TOTFR = 0.
        AVLAR = 0.
        AVDIS = 0.
        WAVDIS = 0.
        CALL CLEAR (INP(1,1),16)
        LFRAME=LPC+2
        NFRAME=LFRAME
C
        DO 500 NFR=1,NUMFR
        CALL SP_READ (INUN,LFRAME,NFR,NFRAME,IDIDNT,INPARAM,IERR)
        CALL SP_RETCODE (IERR)
        IF ((INPARAM(1).LE.1) .OR. (INPARAM(1).LT.3 .AND. INPARAM(2).EQ.0))
        1                                                    THEN     ! Silence
                DO 160 I=1,LPC+2
160             OUTPARAM(I)=0
                GO TO 400
        END IF
        DO 200 I=1,LPC
200     RC(I)=FLOAT(INPARAM(I+2))/32768.
        CALL DOUBLE (RC(1), RCSTORE(1), 2*LPC)

        IF (INPARAM(2).EQ.0) THEN
           IVU=2                          ! UNVOICED FRAME
        ELSE
           IVU=1                          ! VOICED FRAME
        END IF

        IF (IFORM(5) .EQ. 1) GO TO 320
C
C
C*************************************************************
C       FIND THE MAGNITUDES AND THE ANGLES OF THE POLES.
C       SORT THE POLES BY ANGLE AND RETAIN THE ONES WITH BW < BWTHR.
C       IF THERE ARE NO COPMLEX PAIRS, IGNORE THE FRAME.
C       IF THERE ARE NO POLES WITH BW<BWTHR, RETAIN THE ONE WITH
C       THE SMALLEST BANDWIDTH.
C*************************************************************
C
        CALL K_TO_F (RC, LPC, CFIN, BWIN, ICX, FS, IER)
        IF (IER .EQ. 1) STOP 'POLYFACTR did not converge'
        NREAL = 0
        NPOLES = 0
        DO 240 I=1,NQUAD
        IOR(I) = I
        IF (ICX(I) .EQ. 0) THEN ! real pole
                NREAL = NREAL + 1
                IANGLE(I) = 2 * FS
        ELSE IF (BWIN(I) .GT. BWTHR) THEN ! broad BW pole
                NPOLES = NPOLES + 1
                IANGLE(I) = FS + BWIN(I)
        ELSE ! complex pole
                IANGLE(I) = CFIN(I)
        END IF
240     CONTINUE

        IF (NREAL .EQ. NQUAD) THEN ! Replace the frame by the previous one.
                GO TO 400
        END IF
        IF (NREAL+NPOLES .EQ. NQUAD) THEN
                NPOLES = 1
        ELSE IF (NPOLES+NREAL .EQ. 0) THEN
                NPOLES = NQUAD - 1
        ELSE
                NPOLES = NQUAD - NREAL - NPOLES
        END IF
```

```
      INP(NPOLES,IVU)=INP(NPOLES,IVU)+1
      IF (.NOT.FLAG .AND. BPF.GT.0) GO TO 500

      INT21 = 1
      INT22 = NQUAD
      INT23 = 1
      CALL BFIS (IANGLE, INT21, INT22, INT23, IOR) ! sort by angle


      DO 280 I=1,NQUAD
              ICFL (I) = ICX (IOR(I))
              CF (I) = CFIN (IOR(I))
              BW (I) = BWIN (IOR(I))
280   CONTINUE
C
C*********************************************************************
C     CONVERT THE POLES TO THE DESIRED PARAMETERS, ENCODE / DECODE
C     THEM, AND CONVERT THEM BACK TO REFLECTION COEFFICIENTS.
C*********************************************************************
C

320   DO I=1,2          ! Encode Energy and Pitch
              FPAR = FLOAT(INPARAM(I))
              CALL CODER (FPAR, CODE (ICPTR(2*I-1,IVU)+1, IVU),
     1                                ICPTR(2*I, IVU), ICODE)
              OUTPARAM(I) = DECODE (ICPTR(2*I-1,IVU)+ICODE, IVU)
      END DO

      IFORM(6)=NPOLES
      NN = NQUAD
      IF (IFORM(5) .EQ. 1) NN = LPC
      CALL CONVFORW (CF, BW, ICFL, RC, IFORM, NN)
      IF (IFORM(5) .EQ. 1) THEN        ! LPC parameter coding
              DO I=1,LPC
                      CALL CODER (RC(I), CODE (ICPTR(2*I+3,IVU)+1, IVU),
     1                                        ICPTR(2*I+4,IVU), ICODE)
                      RC(I) = DECODE (ICPTR(2*I+3,IVU)+ICODE, IVU)
              END DO
      ELSE            ! Root coding
              DO I=1,2          ! Residual polynomial
                      CALL CODER (RC(I), CODE (ICPTR(2*(I+2*NPOLES-2)+43,
     1                  IVU)+1, IVU), ICPTR(2*(I+2*NPOLES-2)+44,IVU), ICO
                      RC(I) = DECODE (ICPTR(2*(I+2*NPOLES-2)+43,IVU)+ICOD
     1                                                                IVU)
              END DO
              IADD=NPOLES*(NPOLES-1)  ! Roots
              DO I=1,2*NPOLES
                      IIND = (I+1) / 2
                      IF (MOD(I,2) .EQ. 1) FPAR = CF(IIND)
                      IF (MOD(I,2) .EQ. 0) FPAR = BW(IIND)
                      CALL CODER (FPAR, CODE (ICPTR(2*(I+IADD)+3,
     1                  IVU)+1, IVU), ICPTR(2*(I+IADD)+4,IVU), ICODE)
                       FPAR = DECODE (ICPTR(2*(I+IADD)+3,IVU)+ICODE, IVU)
                       IF (MOD(I,2) .EQ. 1) CF(IIND) = FPAR
                       IF (MOD(I,2) .EQ. 0) BW(IIND) = FPAR
               END DO
      END IF

      CALL CONVBACK (CF, BW, ICFL, RC, IFORM, NN)

C
C*********************************************************************
C     COMPUTE OBJECTIVE DISTANCE MEASURE AND
C                     OUTPUT QUANTIZED PARAMETERS
C*********************************************************************
C
      TOTFR = TOTFR + 1
      AVDIS = AVDIS + DIST (RCSTORE, RC, LPC, 1)
      WAVDIS = WAVDIS + (DIST (RCSTORE, RC, LPC, 1) +
     1                   DIST (RC, RCSTORE, LPC, 1) - 2.) / 2.
      AVLAR = AVLAR + 20. * SQRT(DIST (RCSTORE, RC, LPC, 2))
```

```
      DO 360 I=1,LPC
360   OUTPARAM(I+2)=RC(I)*32768.

400   IF (FLAG .OR. BPF.GE.0)
      1        CALL SP_WRITE (OUTUN,LFRAME,NFR,NFRAME,OUTPARAM,IERR)
      CALL SP_RETCODE (IERR)
500   CONTINUE
C
C
      IF (IFORM(5) .NE. 1) THEN
               ITER = 1

510            SUM3=0
               SUM4=0
               DO 540 I=1,4
               JJ=I*(I-1)
               SUM1=0
               SUM2=0
               DO 520 J=1,2*I
               SUM1=SUM1+ICPTR(2*(JJ+J)+4,1)
520            SUM2=SUM2+ICPTR(2*(JJ+J)+4,2)
               SUM3=SUM3+INP(I,1)*SUM1+INP(I,2)*SUM2
               SUM4=SUM4+INP(I,1)+INP(I,2)
540            CONTINUE
               BPFNEW=SUM3/SUM4+2+IFORM(4)
               IF (.NOT.FLAG .AND. BPF.GT.0) THEN
                       IF (ABS(BPF-BPFNEW)/BPF .LT. 0.01 .OR. (ITER.GT.90
      1                 .AND. ABS(BPF-BPFNEW)/BPF .LT. 0.02)) THEN
                               TYPE *,'Number of iterations:',ITER
                               FLAG = .TRUE.
                               GO TO 140
                       END IF
                       ITER = ITER + 1
                       IF (ITER.GT.100) GO TO 550
                       IF (ABS(BPFNEW-BPFOLD).LT.1E-4 .OR. ITER.LT.3) THE
                               BPFOLD = BPFNEW
                               STEPOLD = STEP(IPAR)
                               STEP(IPAR) = BPFNEW * STEP(IPAR) / BPF
                       ELSE
                               EX = (BPF-BPFNEW) / (BPF-BPFOLD)
                               BPFOLD = BPFNEW
                               TEMP = (STEP(IPAR) - EX * STEPOLD) / (1. - E
                               STEPOLD = STEP(IPAR)
                               STEP(IPAR) = TEMP
                       END IF
                       CALL CDTABLES (LPC,STUN,ICPTR,CODE,DECODE,IFORM,STEP
                       GO TO 510
               END IF
      ELSE
               BPFNEW = IFORM(4)
      END IF

      TYPE *,'Step size for first parameter:',STEP(1)
      TYPE *,'Step size for second parameter:',STEP(2)

550   OPEN (UNIT=13, FILE='UD:[PANOS.ROOTS]RTDAT.DAT', STATUS='UNKNOWN',
      1                ACCESS='APPEND')
      CALL TRNLOG (INFILE(1:LENGTH1), INF1, LENGTH1, IERR)
      IF (IERR .NE. 1) TYPE *,'Logical translation error (CODEC)'
      CALL TRNLOG (OUTFILE(1:LENGTH2), OUTF1, LENGTH2, IERR)
      IF (IERR .NE. 1) TYPE *,'Logical translation error (CODEC)'
      WRITE (13,560) INF1(1:LENGTH1),OUTF1(1:LENGTH2),BWTHR,IFORM(2),
      1                        STEP(1),IFORM(3),STEP(2),IFORM(4),BPFNEW
560   FORMAT ('1',////8X,'Input filename:  ',T41,A/
      1        8X,'Output filename:  ',T41,A/
      2        8X,'Bandwidth threshold (in Hz): ',T41,F4.0/
      3        8X,'First parameter form: ',T41,I2/
      4        8X,'Step size for first parameter: ',T41,F6.3/
      5        8X,'Second parameter form: ',T41,I2/
      6        8X,'Step size for second parameter: ',T41,F6.3/
      7        8X,'Bits for residual polynomial: ',T41,I2/
```

```
      8       8X,'Average # of bits/frame (overhead + filter)=',F4.1)
      TYPE *,' Average # of bits/frame (overhead + filter)=',BPFNEW

      AVDIS = AVDIS / TOTFR
      WAVDIS = WAVDIS / TOTFR
      AVLAR = AVLAR / TOTFR
      TYPE *,'Average likelihood ratio =',AVDIS
      TYPE *,'Average cosh measure =',WAVDIS
      TYPE *,'Average mean square LAR distance (in dB)=',AVLAR
      WRITE (13,580) AVDIS,WAVDIS,AVLAR,((INP(I,K),(ICPTR(2*(I*(I-1)+J)
      1        +4,K),J=1,2*I,2),K=1,2), ((ICPTR(2*(I*(I-1)+J)+4,K),
      2        J=2,2*I,2),K=1,2),I=1,4)
580   FORMAT (8X,'Average likelihood ratio =',TR16,F6.2/
      1        8X,'Average cosh measure =',TR20,F6.2/
      2        8X,'Average mean square LAR distance (in dB)=',F6.2///
      3        8X,'Distribution of bits (voiced / unvoiced)'//
      4        8X,'1st param.: (',I3,' frames)  ',(I1,2X),'/',
      4                        ' (',I3,' frames)',(2X,I1)/
      5        8X,'2nd param.: ',14X,(I1,2X),'/',13X,(2X,I1)/
      4        8X,'1st param.: (',I3,' frames)  ',2(I1,2X),'/',
      4                        ' (',I3,' frames)',2(2X,I1)/
      5        8X,'2nd param.: ',14X,2(I1,2X),'/',13X,2(2X,I1)/
      4        8X,'1st param.: (',I3,' frames)  ',3(I1,2X),'/',
      4                        ' (',I3,' frames)',3(2X,I1)/
      5        8X,'2nd param.: ',14X,3(I1,2X),'/',13X,3(2X,I1)/
      4        8X,'1st param.: (',I3,' frames)  ',4(I1,2X),'/',
      4                        ' (',I3,' frames)',4(2X,I1)/
      5        8X,'2nd param.: ',14X,4(I1,2X),'/',13X,4(2X,I1))
      IF (ITER .GT. 100) WRITE (13,600)
600   FORMAT (///10X,'***  MORE THAN 100 ITERATIONS  ***')
C
C
      CLOSE (UNIT=13)
      CALL SP_CLOSE (STUN,IERR)
      CALL SP_RETCODE (IERR)
      CALL SP_CLOSE (INUN,IERR)
      CALL SP_RETCODE (IERR)
      CALL SP_CLOSE (OUTUN,IERR)
      CALL SP_RETCODE (IERR)
      STOP
C
C
      END
      SUBROUTINE CDTABLES (N,STUN,ICPTR,CODE,DECODE,IFORM,STEP)
C
C*********************************************************************
C        This subroutine computes the coding and decoding tables
C      for RMS energy, pitch, and the LPC parameters specified by 'IFORM'.
C
C      INPUTS:
C        N:    LPC order
C        STUN: Logical unit number for input statistics file.
C        IFORM(1): 1=Linear quantization
C                  2=Max entropy (equal area) quantization
C                  3=Min Deviation Quantization.
C        IFORM(2): Forms of poles (1st component), or
C                  form of LPC param.
C        IFORM(3): Forms of poles (2nd component).
C        IFORM(4): Total # of bits for residual polyn., or
C                  total # of bits for LPC encoding.
C        IFORM(5): Flag: 1=LPC coding
C                        2=Root coding.
C        STEP(1): Step size, 1st component.
C        STEP(2): Step size, 2nd component.
C        STEP(3): Energy step size in DB.
C      OUTPUTS:
C        ICPTR: An array of pointers(offsets) and table lengths (in bits)
C               for the coding/decoding tables. Table lengths for
C                  Energy and Pitch are also input.
C        CODE:  Coding table
C        DECODE:Decoding table.
C*********************************************************************
C
```

```
      PARAMETER NF=20
      PARAMETER NPTS=128
      DIMENSION DIF(15),NBITS(15),STEP(1),DATA(NPTS)
      REAL CODE(10000,2),DECODE(10000,2)
      INTEGER*2 STUN,IDATA(300)
      INTEGER*4 ICPTR(100,2),IFORM(1)
      EQUIVALENCE (IDATA(1), DATA(1))

      PI=ACOS(-1.)
      IPNTR=1
      ICPTR(1,1)=IPNTR-1
      ICPTR(1,2)=IPNTR-1
C
C*********************************************************************
C     DISTRIBUTION OF BITS
C*********************************************************************
C
C     LPC PARAMETERS
C
      IF (IFORM(5) .EQ. 1) THEN
            DO  IVU=1,2
                  DO NLPC=1,N
                        IFIRST=NPTS*((IFORM(2)-1)*2*10+(IVU-1)*10
     1                                                  +NLPC-1)*2+
                        CALL SP_READ (STUN,1,IFIRST,2*NPTS,
     1                                        IDIDNT,IDATA,IERR)
                        CALL SP_RETCODE (IERR)
                        DIF(NLPC)=DATA(8)-DATA(7)
                  END DO
                  CALL ALLOCBITS (DIF,N,IFORM(4),NBITS)
                  DO I=1,N
                        ICPTR(2*I+4,IVU)=NBITS(I)
                  END DO
            END DO
      ELSE
C
C     RESIDUAL POLYNOMIAL
C
            DO 20 IVU=1,2
            DO 20 NPOLES=1,4
            DO 10 I=1,2
                  IFIRST=NPTS*(10*2*(14+I)+(IVU-1)*10+NPOLES-1)*2+1
                  CALL SP_READ (STUN,1,IFIRST,2*NPTS,IDIDNT,IDATA,IER
                  CALL SP_RETCODE (IERR)
                  DIF(I)=DATA(8)-DATA(7)
10          CONTINUE
            CALL ALLOCBITS (DIF,2,IFORM(4),NBITS)
            DO 20 I=1,2
                  ICPTR(2*(I+2*NPOLES-2)+44,IVU)=NBITS(I)
20          CONTINUE
      END IF
C
C*********************************************************************
C         ENERGY CODING/DECODING TABLES
C*********************************************************************
C
99    ENERGY_MAX = 353.
      ENERGY_MIN = 1.
      BETA = 10.
      LEVELS=2**ICPTR(2,1)
C    RATIO = EXP (LOG (ENERGY_MAX/ENERGY_MIN) / FLOAT(LEVELS-1))
      RATIO = EXP(LOG(1.+ENERGY_MAX/BETA) / FLOAT(LEVELS))
     SRATO=SQRT(RATIO)
     DECODE(IPNTR,1)=0
     DECODE(IPNTR,2)=DECODE(IPNTR,1)
     CODE(IPNTR,1)=0.
     CODE(IPNTR,2)=CODE(IPNTR,1)
C     IPNTR=IPNTR+1
C     DECODE(IPNTR,1) = ENERGY_MIN
C     DECODE(IPNTR,2)=DECODE(IPNTR,1)
C     CODE(IPNTR,1) = ENERGY_MIN * SRATO
```

```
C       CODE(IPNTR,2)=CODE(IPNTR,1)
C        ENGY = ENERGY_MIN
         ENGY = 1.

! The formula used is to linearly quantize log (1+x/beta), 0 <= x <= xmax,


      DO 100 I=2,LEVELS
      IPNTR=IPNTR+1
      ENGY = ENGY*RATIO
      DECODE(IPNTR,1) = BETA * (ENGY-1)
      DECODE(IPNTR,2)=DECODE(IPNTR,1)
      CODE(IPNTR,1) = BETA * (ENGY*SRATO-1)
100   CODE(IPNTR,2)=CODE(IPNTR,1)
C
C*********************************************************************
C            PITCH CODING/DECODING TABLES
C*********************************************************************
C
        ICPTR(3,1)=IPNTR
        ICPTR(3,2)=IPNTR
        PCHMIN=17
        PCHMAX=198
        LEVELS=2**ICPTR(4,1)
        IPNTR=IPNTR+1
        DECODE(IPNTR,1)=0.
        DECODE(IPNTR,2)=DECODE(IPNTR,1)
        CODE(IPNTR,1)=0.
        CODE(IPNTR,2)=CODE(IPNTR,1)
        IPNTR=IPNTR+1
      RATIO=EXP(ALOG(PCHMAX/PCHMIN)/FLOAT(LEVELS-2))
      SRATO=SQRT(RATIO)
      DECODE(IPNTR,1)=PCHMIN
      DECODE(IPNTR,2)=DECODE(IPNTR,1)
      CODE(IPNTR,1)=1.
      CODE(IPNTR,2)=CODE(IPNTR,1)
      DO 120 I=1,LEVELS-2
      IPNTR=IPNTR+1
      DECODE(IPNTR,1)=MAX1(DECODE(IPNTR-1,1)+1.,PCHMIN*RATIO**I+.5)
      DECODE(IPNTR,2)=DECODE(IPNTR,1)
      CODE(IPNTR,1)=INT(DECODE(IPNTR,1)/SRATO+.5)
120   CODE(IPNTR,2)=CODE(IPNTR,1)
C
C*********************************************************************
C       CODING / DECODING TABLES FOR LPC PARAMETERS.
C*********************************************************************
C
        IF (IFORM(5) .EQ. 1) THEN
                IPNTR1=IPNTR
                DO 130 IVU=1,2
                IPNTR=IPNTR1
                DO NPAR=1,N
                        LEVELS = 2**ICPTR(2*NPAR+4,IVU)
                        ICPTR(2*NPAR+3,IVU) = IPNTR
                        IF (IPNTR.GT.9900) STOP 'Coding Table length > 990
                        IFIRST = NPTS*(10*2*(IFORM(2)-1)+10*(IVU-1)+
        1                                       NPAR-1)*2+1
                        CALL SP_READ (STUN,1,IFIRST,2*NPTS,IDIDNT,IDATA,IE
                        CALL SP_RETCODE (IERR)
                        IBNS=DATA(5)
                        IFL = 1
                        CALL QUHIST (DATA(9),DATA(7),DATA(8),
        1                       CODE(IPNTR+1,IVU),DECODE(IPNTR+1,IVU),
        2                       QSTEP,ICPTR(2*NPAR+4,IVU),IBNS,IFORM(1),IFL
                        IPNTR = IPNTR + LEVELS
                END DO
130             CONTINUE
                RETURN
        END IF
```

```
C
C*********************************************************************
C       CODING / DECODING TABLES FOR POLES
C*********************************************************************
C
        IPNTR1=IPNTR
        DO 160 IVU=1,2
        IPNTR=IPNTR1
        DO 140 NPOLES=1,4
                IADD=NPOLES*(NPOLES-1)
        DO 140 I=1,2*NPOLES
                ICPTR(2*(I+IADD)+3,IVU)=IPNTR
                IF (IPNTR.GT.9900) STOP 'Coding Table length > 9900'
                JJ=MOD(I+1,2)+2          ! alternate pole parameters
                IPOLE=(I+1)/2+IADD/2
                IFIRST=NPTS*(10*2*(IFORM(JJ)-1)+10*(IVU-1)+IPOLE-1)*2+1
                CALL SP_READ (STUN,1,IFIRST,2*NPTS,IDIDNT,IDATA,IERR)
                CALL SP_RETCODE (IERR)
                IBNS=DATA(5)
                IFL = 2
                CALL QUHIST (DATA(9),DATA(7),DATA(8),
        1                CODE(IPNTR+1,IVU),DECODE(IPNTR+1,IVU),
        2                STEP(JJ-1),NBTS,IBNS,IFORM(1),IFL)
                ICPTR(2*(I+IADD)+4,IVU)=NBTS
                IPNTR=IPNTR+2**NBTS
140     CONTINUE
C
C*********************************************************************
C       CODING / DECODING TABLES FOR RESIDUAL POLYNOMIAL
C*********************************************************************
C
        NNP=44
        DO 160 NPOLES=1,4
        DO 160 I=1,2
                LEVELS=2**ICPTR(2*(I+2*NPOLES-2)+NNP,IVU)
                ICPTR(2*(I+2*NPOLES-2)+NNP-1,IVU)=IPNTR
                IF (IPNTR.GT.9900) STOP 'Coding Table length > 9900'
                IFIRST=NPTS*(NPOLES-1+(IVU-1)*10+(14+I)*10*2)*2+1
                CALL SP_READ (STUN,1,IFIRST,2*NPTS,IDIDNT,IDATA,IERR)
                CALL SP_RETCODE (IERR)
                IFL = 1
                IBNS=DATA(5)
                CALL QUHIST (DATA(9),DATA(7),DATA(8),
        1                CODE(IPNTR+1,IVU),DECODE(IPNTR+1,IVU),QSTEP,
        2                ICPTR(2*(I+2*NPOLES-2)+NNP,IVU),IBNS,IFORM(1),IFL)
                IPNTR=IPNTR+LEVELS
160     CONTINUE
        RETURN
C
C
        END
        SUBROUTINE CODER(PARAMETER,TABLE,NBITS,ICODE)
C*********************************************************************
C            This subroutine codes the parameter 'PARAMETER'.
C       The coding table is supplied in the array 'TABLE', and the
C       number of BITS in the code is given in 'NBITS'.
C       Everything < TABLE(2) is encoded at ICODE=1.
C       Everything >= TABLE(2**NBITS) is encoded at ICODE=2**NBITS.
C*********************************************************************
        REAL TABLE(1)
        ISUB=2**(NBITS-1)
        ICODE=1
C           BASIC CODING LOOP
 10       ICODE=ICODE+ISUB
          IF(PARAMETER.LT.TABLE(ICODE))ICODE=ICODE-ISUB
          ISUB=ISUB/2
          IF(ISUB.GT.0)GO TO 10
C                FINISHED WITH BASIC CODING LOOP
        RETURN
        END
```

```
      SUBROUTINE CONVFORW (CF,BW,ICX,RC,IFORM,NQUAD)
C
C*********************************************************************
C       Subroutine to convert the first IFORM(6) parameters contained in
C       CF and BW into the forms suggested by IFORM(2) and IFORM(3) for
C       the poles and LAR's for the residual polynomial.
C       NQUAD = # of quadratic factors.
C       In the case of LPC parameters, the NQUAD (=LPC order) parameters
C       are converted to forms suggested by IFORM(2).
C       Upon output, the first IFORM(6) elements of CF and BW contain
C       the transformed parameters, while RC contains either the LAR's
C       of the residual polynomial or the LPC parameters.
C
C       THIS SUBROUTINE IS CALLED IN THE PROGRAM 'CODEC'
C*********************************************************************
C
      INTEGER*2 NFACTR,ICX(1)
      DIMENSION IFORM(1),RC(1),A(15),CF(1),BW(1)
      FREQ=4000
      FS = 2.*FREQ
      PI=ACOS(-1.)
      NPOLES=IFORM(6)
C
C*********************************************************************
C       TRANSFORM LPC PARAMETERS
C*********************************************************************
C
      IF (IFORM(5) .EQ. 1) THEN
              IF (IFORM(2) .EQ. 20) THEN
                      DO I=1,NQUAD
                              RC(I) = ASIN (RC(I))
                      END DO
              ELSE IF (IFORM(2) .EQ. 19) THEN
                      CALL K_TO_LAR (RC, NQUAD, A)
                      CALL DOUBLE (A(1), RC(1), 2*NQUAD)
              END IF
              RETURN
      END IF
C
C*********************************************************************
C       TRANSFORM ROOT PARAMETERS
C*********************************************************************
C
      OLD = 0
      DO 200 I=1,NPOLES
      IF (IFORM(2) .EQ. 2) THEN
              CF(I) = 20.*LOG10 (CF(I))
      ELSE IF (IFORM(2) .EQ. 3) THEN
              CF(I) = 20.*LOG10 (1.+CF(I)/1000.)
      ELSE IF (IFORM(2) .EQ. 4) THEN
              TEMP = CF(I)
              CF(I) = TEMP - OLD
              OLD = TEMP
      ELSE IF (IFORM(2) .EQ. 5) THEN
              TEMP = 20. * LOG10 (CF(I))
              CF(I) = TEMP - OLD
              OLD = TEMP
      ELSE IF (IFORM(2) .EQ. 6) THEN
              TEMP = 20. * LOG10 (1.+CF(1)/1000.)
              CF(I) = TEMP - OLD
              OLD = TEMP
      END IF

      IF (IFORM(3) .EQ. 7) THEN
              BW(I) = EXP (-BW(I)*PI/FS)
      ELSE IF (IFORM(3) .EQ. 9) THEN
              TEMP = EXP (-BW(I)*PI/FS)
              BW(I) = -20. * LOG10 (1.-TEMP)
      END IF
      IF (IFORM(2) .GE. 10 .AND. IFORM(2) .LE. 14) THEN
```

```
                CALL F_TO_K (CF(I), BW(I), ICX(I), 2, A, FS)
                IF (IFORM(2) .EQ. 12) THEN
                        CALL K_TO_LAR (A, 2, RC)
                        CALL DOUBLE (RC(1), A(1), 4)
                ELSE IF (IFORM(2) .EQ. 14) THEN
                        A(1) = ASIN (A(1))
                        A(2) = ASIN (A(2))
                END IF
                CF(I) = A(1)
                BW(I) = A(2)
        END IF
200     CONTINUE
C
C*****************************************************************
C       RESIDUAL POLYNOMIAL
C*****************************************************************
C
        CALL F_TO_LAR (CF(NPOLES+1), BW(NPOLES+1), ICX(NPOLES+1),
        1                                2*(NQUAD-NPOLES), RC, FS)


        RETURN
        END
        SUBROUTINE CONVBACK (CF,BW,ICX,RC,IFORM,NQUAD)
C
C*******************************************************************
C       Subroutine to convert the first IFORM(6) parameters contained in
C       CF and BW beeing in forms suggested by IFORM(2) and IFORM(3), and
C       the LAR's of the residual polynomial into 2*NQUAD reflection
C       coefficients stored in the array RC.
C       NQUAD = # of quadratic factors.
C       In the case of LPC parameters, the NQUAD (=LPC order) parameters
C       are reconstructed from the forms suggested by IFORM(2).
C       Upon output, the  array RC contains the reflection coefficients.
C
C       THIS SUBROUTINE IS CALLED IN THE PROGRAM 'CODEC'
C*******************************************************************
C
        INTEGER*2 NFACTR,ICX(1)
        DIMENSION IFORM(1),RC(1),A(15),CF(1),BW(1)
        FREQ=4000
        FS = 2.*FREQ
        PI=ACOS(-1.)
        NPOLES=IFORM(6)
C
C*******************************************************************
C       TRANSFORM LPC PARAMETERS
C*******************************************************************
C
        IF (IFORM(5) .EQ. 1) THEN
                IF (IFORM(2) .EQ. 20) THEN
                        DO I=1,NQUAD
                                RC(I) = SIN (RC(I))
                        END DO
                ELSE IF (IFORM(2) .EQ. 19) THEN
                        CALL LAR_TO_K (RC, NQUAD, A)
                        CALL DOUBLE (A(1), RC(1), 2*NQUAD)
                END IF
                RETURN
        END IF
C
C*******************************************************************
C       TRANSFORM ROOT PARAMETERS
C*******************************************************************
C
        OLD = 0
        DO 200 I=1,NPOLES
        IF (IFORM(2) .EQ. 2) THEN
                CF(I) = 10**(CF(I)/20.)
        ELSE IF (IFORM(2) .EQ. 3) THEN
                CF(I) = 1000.*(-1.+10**(CF(I)/20.))
```

```
        ELSE IF (IFORM(2) .EQ. 4) THEN
                CF(I) = CF(I) + OLD
                OLD = CF(I)
        ELSE IF (IFORM(2) .EQ. 5) THEN
                CF(I) = CF(I) + OLD
                OLD = CF(I)
                CF(I) = 10**(CF(I)/20.)
        ELSE IF (IFORM(2) .EQ. 6) THEN
                CF(I) = CF(I) + OLD
                OLD = CF(I)
                CF(I) = 1000.*(-1.+10**(CF(I)/20.))
        END IF

        IF (IFORM(3) .EQ. 7) THEN
                BW(I) = - LOG(BW(I))*FS/PI
        ELSE IF (IFORM(3) .EQ. 9) THEN
                TEMP = 1.-10**(-BW(I)/20.)
                BW(I) =  - LOG(TEMP)*FS/PI
        END IF


        IF (IFORM(2) .GE. 10 .AND. IFORM(2) .LE. 14) THEN
                A(1) = CF(I)
                A(2) = BW(I)
                IF (IFORM(2) .EQ. 12) THEN
                        CALL LAR_TO_K (A, 2, RC(3))
                        CALL DOUBLE (RC(3), A(1), 4)
                ELSE IF (IFORM(2) .EQ. 14) THEN
                        A(1) = SIN (A(1))
                        A(2) = SIN (A(2))
                END IF
        -       CALL K_TO_F (A, 2, CF(I), BW(I), ICX(I), FS, IER)
                IF (IER .EQ. 1) STOP 'POLYFACTR did not converge'
        END IF
200     CONTINUE
C
C*****************************************************************
C       RESIDUAL POLYNOMIAL
C*****************************************************************
C
        CALL LAR_TO_F (RC,2, CF(NPOLES+1), BW(NPOLES+1), ICX(NPOLES+1),FS,I
        IF (IER .EQ. 1) STOP 'POLYFACTR did not converge'

C
C*****************************************************************
C       OUTPUT REFLECTION COEFFICIENTS
C*****************************************************************
C
        CALL CLEAR (CF(NPOLES+2), 2*(NQUAD-NPOLES-1))
        CALL CLEAR (BW(NPOLES+2), 2*(NQUAD-NPOLES-1))
        CALL CLEAR (ICX(NPOLES+2), NQUAD-NPOLES-1)

        NQ2 = 2*NQUAD
        CALL F_TO_K (CF, BW, ICX, NQ2, RC, FS)

        RETURN
        END
        SUBROUTINE ALLOCBITS (DIF,NUM,NTOT,NBITS)
C
C*******************************************************************
C       SUBROUTINE TO DISTRIBUTE THE TOTAL NUMBER OF BITS, "NTOT",
C       AMONG THE "NUM" PARAMETERS.  "DIF" CONTAINS THE DIFFERENCES
C       BETWEEN MAX AND MIN VALUES OF THE PARAMETERS.
C       "NBITS" IS THE FINAL DISTRIBUTION OF BITS.
C*******************************************************************
C
        DIMENSION DIF(1),NBITS(1),FN(15),IND(15)
C
C
```

```
      FACTR=1
      DO 100 I=1,NUM
100   FACTR=FACTR*DIF(I)
      FACTR=(FACTR/2.**NTOT)**(1./FLOAT(NUM))
      NBALANCE=0
      DO 120 I=1,NUM
      FN(I)=LOG(DIF(I)/FACTR)/LOG(2.)
      NBITS(I)=FN(I)+0.5
      IF (NBITS(I).LT.0) NBITS(I)=0
      NBALANCE=NBALANCE+NBITS(I)
120   CONTINUE
      NBALANCE=NTOT-NBALANCE
      IF (NBALANCE.EQ.0) RETURN
C
C     SURPLUS OR SHORTAGE BITS
C
      DO 140 I=1,NUM
      FN(I)=FN(I)+0.5-NBITS(I)
140   IND(I)=I
      DO 160 I=1,NUM-1
      DO 160 J=1,NUM-I
      IF (FN(J).GE.FN(J+1)) GO TO 160
      ITEMP=IND(J)
      IND(J)=IND(J+1)
      IND(J+1)=ITEMP
160   CONTINUE
C
      IF (NBALANCE.GT.0) THEN          ! SURPLUS BITS
180      DO 200 I=1,NUM
         NBITS(IND(I))=NBITS(IND(I))+1
         NBALANCE=NBALANCE-1
         IF (NBALANCE.EQ.0) RETURN
200      CONTINUE
         GO TO 180
      ELSE                             ! SHORTAGE BITS
220      DO 240 I=NUM,1,-1
         IF (NBITS(IND(I)).EQ.0) GO TO 240
         NBITS(IND(I))=NBITS(IND(I))-1
         NBALANCE=NBALANCE+1
         IF (NBALANCE.EQ.0) RETURN
240      CONTINUE
         GO TO 220
      END IF
      END
      SUBROUTINE QUHIST (HIS,AMIN,AMAX,CODE,DECODE,QSTEP,
      1                                        NBITS,NPTS,LEAQ,IFL)
C
C*********************************************************************
C     Subroutine to compute (quantization) coding and decoding
C     levels from a histogram.
C     HIS: array with histog. with 'NPTS' bins
C     AMIN, AMAX: min and max values of histogram's abscissa
C     CODE, DECODE: output arrays for coding and decoding levels
C     QSTEP: quantization step size
C     2**NBITS: # of quant. levels
C     LEAQ: 1=linear quant.
C           2=max entropy (equal area) quant. with the decoding
C             levels at the medians.
C           3=minimum deviation quantization
C     IFL:    1=input NBITS, output QSTEP
C             2=input QSTEP, output NBITS
C*********************************************************************
C
      DIMENSION HIS(1),CODE(1),DECODE(1),CHIS(0:300)
C
C
C     COMPUTE # OF BITS AND # OF LEVELS
C
      IF (IFL .EQ. 2) THEN
            STEP=(AMAX-AMIN)/QSTEP
```

```
                IF (STEP.GT.1) THEN
                        NBITS = INT (LOG(STEP)/LOG(2.)) + 1
                ELSE
                        NBITS = 0
                END IF
        ELSE
                QSTEP = (AMAX-AMIN) / 2**NBITS
        END IF
        IF (NBITS.GT.20) THEN
                TYPE *,'# of bits in QUHISTBW =',NBITS
                TYPE *,'AMAX=',AMAX,'  AMIN=',AMIN,'  STEP=',QSTEP
        END IF
        LEVELS=2**NBITS
C
C*********************************************************************
C       LINEAR QUANTIZATION
C*********************************************************************
C
        IF (LEAQ .EQ. 1 .AND. LEVELS .GE. 2) THEN
                STEP=(AMAX-AMIN)/FLOAT(LEVELS)
                CODE(1)=AMIN
                DECODE(1)=CODE(1)+STEP/2.
                DO 100 I=2,LEVELS
                DECODE(I)=DECODE(I-1)+STEP
100             CODE(I)=CODE(I-1)+STEP
                RETURN
        END IF
C
C*********************************************************************
C       MINIMUM DEVIATION QUANTIZATION
C*********************************************************************
C
        CHIS(0)=0
        IF (LEAQ.EQ.3) THEN
                CHIS(1)=SQRT(HIS(1))
                DO 120 I=2,NPTS
120             CHIS(I)=CHIS(I-1)+SQRT(HIS(I-1))
                DO 140 I=1,NPTS
140             CHIS(I)=CHIS(I)/CHIS(NPTS)
                GO TO 180
        END IF
C
C*********************************************************************
C       MAXIMUM ENTROPY QUANTIZATION
C       (DECODING LEVELS AT THE MEDIANS)
C*********************************************************************
C
        CHIS(1)=HIS(1)
        DO 160 I=2,NPTS
160     CHIS(I)=CHIS(I-1)+HIS(I)

180     STEP=1./(2.*LEVELS)
        FACTR=(AMAX-AMIN)/FLOAT(NPTS)
        PC=0.
        IND=1
        CODE(1)=AMIN
        DO 240 I=1,2*LEVELS-1
        PC=PC+STEP
200     IF (PC.LE.CHIS(IND)) GO TO 220
        IND=IND+1
        GO TO 200
220     FLEVEL=(IND-2.+(PC-CHIS(IND-1))/(CHIS(IND)-CHIS(IND-1)))
        1       *FACTR+AMIN
        IHALF=(I+1)/2
        IF (2*IHALF.EQ.I) CODE(IHALF+1)=FLEVEL
        IF (2*IHALF.NE.I) DECODE(IHALF)=FLEVEL
240     CONTINUE
        IF (LEVELS.EQ.1) CODE(2) = AMAX
        RETURN
        END
```

```
      SUBROUTINE CDRTTRK (STUN,ICPTR,CODE,DECODE,IFORM,STEP)
C
C*********************************************************************
C         This subroutine computes the coding and decoding tables for
C       the Legendre coefficients for RMS energy, pitch, and the LPC
C       root parameters specified by 'IFORM'.
C
C       INPUTS:
C         STUN: Logical unit number for input statistics file.
C         IFORM(1): 1=Linear quantization
C                   2=Max entropy (equal area) quantization
C                   3=Min deviation quantization
C         IFORM(2): Form of 1st root param. (CF)
C         IFORM(3): Form of 2nd root param. (BW) (4: BW by rule)
C         IFORM(4): Use Energy(0) or log(Energy)(1)
C         IFORM(5): Use Pitch(0) or log(Pitch)(1)
C         IFORM(6): # of bits for resid. polyn. (<0: Time encoding)
C         STEP(1): Step size, 1st root param. (CF)
C         STEP(2): Step size, 2nd root param. (BW)
C         STEP(3): Step size, resid. polyn.
C         STEP(4): Step size, Energy.
C         STEP(5): Step size, Pitch.
C         STEP(6): Multiplicative increase in quant. step size.(1+STEP(6))
C         STEP(7): Step of coef 2 = STEP(7) * Step of coef 1
C       OUTPUTS:
C         ICPTR: An array of pointers(offsets) and table lengths
C                for the coding/decoding tables.
C         CODE:  Coding table
C         DECODE:Decoding table.
C*********************************************************************
C
      PARAMETER NPTS=128

      DIMENSION DIF(15),NBITS(15),STEP(1),DATA(NPTS)
      DIMENSION QSTP(16)

      REAL CODE(1),DECODE(1)

      INTEGER*2 STUN,IDATA(300)
      INTEGER*4 ICPTR(1),IFORM(1)

      EQUIVALENCE (IDATA(1), DATA(1))

      PI=ACOS(-1.)
      IPNTR=0

C
C*********************************************************************
C       CODING / DECODING TABLES FOR CENTER FREQ.
C*********************************************************************
C
      QSTP(1) = STEP(1)
      QSTP(2) = STEP(7) * STEP(1)
      DO J = 1,8
              IF (J .GE. 3) QSTP(J) = QSTP(2) * (1.+STEP(6))**(J-2)
              IFIRST=NPTS*(8*(IFORM(2)-1)+J-1)*2+1
              CALL SP_READ (STUN,1,IFIRST,2*NPTS,IDIDNT,IDATA,IERR)
              CALL SP_RETCODE (IERR)
              IF (DATA(6) .EQ. 0) STOP '>> NO DATA PNTS IN HIST <<'
              ICPTR(2*J-1)=IPNTR
              IBNS=DATA(5)
              IFL = 2
              CALL QUHIST (DATA(9),DATA(7),DATA(8),CODE(IPNTR+1),
     2                     DECODE(IPNTR+1),QSTP(J),NBTS,IBNS,IFORM(1),
              ICPTR(2*J)=NBTS
              IPNTR=IPNTR+2**NBTS
      END DO
C
C*********************************************************************
C       CODING / DECODING TABLES FOR BANDWIDTH
C*********************************************************************
C
```

```
      IADD = 0
      IF (IFORM(3) .GE. 4) GO TO 100
      IFRM = IFORM(3) + 3
      QSTP(1) = STEP(2)
      QSTP(2) = STEP(7) * STEP(2)
      DO J = 1,8
              IF (J .GE. 3) QSTP(J) = QSTP(2) * (1.+STEP(6))**(J-2)
              IFIRST=NPTS*(8*(IFRM-1)+J-1)*2+1
              CALL SP_READ (STUN,1,IFIRST,2*NPTS,IDIDNT,IDATA,IERR)
              CALL SP_RETCODE (IERR)
              IF (DATA(6) .EQ. 0) STOP '>> NO DATA PNTS IN HIST <<'
              ICPTR (16+2*J-1)=IPNTR
              IBNS=DATA(5)
              IFL = 2
              CALL QUHIST (DATA(9),DATA(7),DATA(8),CODE(IPNTR+1),
     2                     DECODE(IPNTR+1),QSTP(J),NBTS,IBNS,IFORM(1),'
              ICPTR(16+2*J)=NBTS
              IPNTR=IPNTR+2**NBTS
      END DO
      IADD = 16
C
C*********************************************************************
C     CODING / DECODING TABLES FOR RESIDUAL POLYNOMIAL.
C*********************************************************************
C
100   IF (IFORM(6) .LT. 0) THEN        ! time coding
              QSTP(1) = STEP(3)
              QSTP(2) = STEP(7) * STEP(3)
         DO I = 1,2
              IFRM = 6 + I
              DO J = 1,8
                      IF (J .GE. 3) QSTP(J) = QSTP(2) * (1.+STEP(6))**(J-
                      IFIRST=NPTS*(8*(IFRM-1)+J-1)*2+1
                      CALL SP_READ (STUN,1,IFIRST,2*NPTS,IDIDNT,IDATA,IER
                      CALL SP_RETCODE (IERR)
                      IF (DATA(6) .EQ. 0) STOP '>> NO DATA PNTS IN HIST <
                      ICPTR (16+IADD+16*(I-1)+2*J-1)=IPNTR
                      IBNS=DATA(5)
                      IFL = 2
                      CALL QUHIST (DATA(9),DATA(7),DATA(8),CODE(IPNTR+1),
     2                     DECODE(IPNTR+1),QSTP(J),NBTS,IBNS,IFORM(1),'
                      ICPTR(16+IADD+16*(I-1)+2*J)=NBTS
                      IPNTR=IPNTR+2**NBTS
              END DO
         END DO
              IADD = IADD + 32
      ELSE    ! individual coding

!     BIT ALLOCATION

              DO I=1,2
                      IFIRST=NPTS*(8*14+I-1)*2+1
                      CALL SP_READ (STUN,1,IFIRST,2*NPTS,IDIDNT,IDATA,IER
                      CALL SP_RETCODE (IERR)
                      DIF(I)=DATA(8)-DATA(7)
              END DO
              CALL ALLOCBITS (DIF,2,IFORM(6),NBITS)
              DO  I=1,2
                      ICPTR(16+IADD+2*I)=NBITS(I)
              END DO

!     CODING / DECODING TABLES FOR RESIDUAL POLYNOMIAL
C
              DO  I=1,2
                      LEVELS=2**ICPTR(16+IADD+2*I)
                      ICPTR(16+IADD+2*I-1)=IPNTR
                      IFIRST=NPTS*(8*14+I-1)*2+1
                      CALL SP_READ (STUN,1,IFIRST,2*NPTS,IDIDNT,IDATA,IER
                      CALL SP_RETCODE (IERR)
                      IBNS=DATA(5)
                      IFL = 1
```

```
                CALL QUHIST (DATA(9),DATA(7),DATA(8),
     1                  CODE(IPNTR+1),DECODE(IPNTR+1),SSTEP,
     2                  ICPTR(16+IADD+2*I),IBNS,IFORM(1),IFL)
                IPNTR=IPNTR+LEVELS
            END DO
            IADD = IADD + 4
        END IF

C
C*********************************************************************
C       CODING / DECODING TABLES FOR ENERGY
C*********************************************************************
C
        QSTP(1) = STEP(4)
        QSTP(2) = STEP(7) * STEP(4)
        IFRM = 9 + 2 * IFORM(4)
        DO J = 1,16
            IF (J .GE. 3) QSTP(J) = QSTP(2) * (1.+STEP(6))**(J-2)
            IFIRST=NPTS*(8*(IFRM-1)+J-1)*2+1
            CALL SP_READ (STUN,1,IFIRST,2*NPTS,IDIDNT,IDATA,IERR)
            CALL SP_RETCODE (IERR)
            IF (DATA(6) .EQ. 0) STOP '>> NO DATA PNTS IN HIST <<'
            ICPTR(16+IADD+2*J-1)=IPNTR
            IBNS=DATA(5)
            IFL = 2
            CALL QUHIST (DATA(9),DATA(7),DATA(8),CODE(IPNTR+1),
     2                  DECODE(IPNTR+1),QSTP(J),NBTS,IBNS,IFORM(1),1
            ICPTR(16+IADD+2*J)=NBTS
            IPNTR=IPNTR+2**NBTS
        END DO

C
C*********************************************************************
C       CODING / DECODING TABLES FOR PITCH
C*********************************************************************
C
        QSTP(1) = STEP(5)
        QSTP(2) = STEP(7) * STEP(5)
        IFRM = 13 + IFORM(5)
        DO J = 1,8
            IF (J .GE. 3) QSTP(J) = QSTP(2) * (1.+STEP(6))**(J-2)
            IFIRST=NPTS*(8*(IFRM-1)+J-1)*2+1
            CALL SP_READ (STUN,1,IFIRST,2*NPTS,IDIDNT,IDATA,IERR)
            CALL SP_RETCODE (IERR)
            IF (DATA(6) .EQ. 0) STOP '>> NO DATA PNTS IN HIST <<'
            ICPTR(48+IADD+2*J-1)=IPNTR
            IBNS=DATA(5)
            IFL = 2
            CALL QUHIST (DATA(9),DATA(7),DATA(8),CODE(IPNTR+1),
     2                  DECODE(IPNTR+1),QSTP(J),NBTS,IBNS,IFORM(1),1
            ICPTR(48+IADD+2*J)=NBTS
            IPNTR=IPNTR+2**NBTS
        END DO
        RETURN
C
C
        END
        SUBROUTINE RTCONVERT (AIN, LENGTH, AOUT, FMIN, FMAX, FS, IFLAG)
C
C*********************************************************************
C       Subroutine to convert CF, BW, Energy or Pitch to or from the followi
C       parameter forms:
C       For CF:
C               1.  CF
C               2.  Log CF
C               3.  Mel CF
C       For BW:
C               4.  BW
C               5.  Log (1-r)
C               6.  Pole magnitude
```

```
C       For Energy:
C               7.  Energy
C               8.  log(Energy)
C       For Pitch:
C               9.  Pitch
C               0.  log(Pitch)
C
C       AIN:  (R*4) Input array of dimension LENGTH
C       AOUT:  (R*4) Output array of dimension LENGTH
C       FMIN, FMAX: (R*4) Min, max values of parameters (output in frwrd tra
C       FS: (R*4) Sampling frequency
C       IFLAG:  (I*2) Flag of the form Y*10+X where X=1,...,9,0 signifies
C               what parameter is trasformed, and Y=0,1 signifies if it is
C               a forward (0) or inverse (1) transformation.
C*************************************************************************
C
        INTEGER*2 LENGTH, IFLAG

        DIMENSION AIN(LENGTH), AOUT(LENGTH)
        DIMENSION AMIN(10), AMAX(10)

        PI = ACOS (-1.)
        AMIN(1) = 0.
        AMIN(2) = 0.
        AMIN(3) = 0.
        AMIN(4) = 20.
        AMIN(5) = 0.01
        AMIN(6) = 0.001
        AMIN(7) = 3.
        AMIN(8) = 0.
        AMIN(9) = 0.
        AMIN(10) = 0.
        AMAX(1) = FS / 2.
        AMAX(2) = 20. * LOG10 (FS/2.)
        AMAX(3) = 20. * LOG10 (1.+FS/2000.)
        AMAX(4) = 4000.
        AMAX(5) = 350.
        AMAX(6) = 0.999
        AMAX(7) = 1000.
        AMAX(8) = 7.
        AMAX(9) = 1000.
        AMAX(10) = 7.
        IFL = IFLAG / 10
        IF (IFL .GE. 1) GO TO 200
C
C*************************************************************************
C       FORWARD TRANSFORMATION
C*************************************************************************
C
        IFL = IFLAG
        IF (IFL .EQ. 0) IFL = 10

        FMIN = AMIN(IFL)
        FMAX = AMAX(IFL)
        CALL DOUBLE (AIN(1), AOUT(1), 2*LENGTH)
        IF (IFL .EQ. 2) THEN              ! CF to log(CF)
                DO I = 1,LENGTH
                        AOUT(I) = 20 * LOG10 (AIN(I))
                END DO
        ELSE IF (IFL .EQ. 3) THEN         ! CF to Mel(CF)
                DO I = 1,LENGTH
                        AOUT(I) = 20 * LOG10 (1.+AIN(I)/1000.)
                END DO
        ELSE IF (IFL.EQ.5 .OR. IFL.EQ.6) THEN   ! BW to pole magnitude
                DO I = 1,LENGTH
                        AOUT(I) = EXP (-PI * AIN(I) / FS)
                END DO
                IF (IFL .EQ. 5) THEN      ! BW to log amplitude
                        DO I = 1,LENGTH
                                AOUT(I) = -20. * LOG10 (1.- AOUT(I))
                        END DO
                END IF
```

```
        ELSE IF (IFL .EQ. 8) THEN        ! Energy to log(Energy)
                DO I = 1,LENGTH
                        AOUT(I) = LOG (AIN(I) + 30.)
                END DO
        ELSE IF (IFL .EQ. 10) THEN       ! Pitch to log(Pitch)
                DO I = 1,LENGTH
                        AOUT(I) = LOG (AIN(I))
                END DO
        END IF

        RETURN
C
C*********************************************************************
C       INVERSE TRANSFORMATION
C*********************************************************************
C
200     IFL = MOD (IFLAG, 10)
        IF (IFL .EQ. 0) IFL = 10

        DO I = 1, LENGTH
                IF (AIN(I) .LT. AMIN(IFL)) AIN(I) = AMIN(IFL)
                IF (AIN(I) .GT. AMAX(IFL)) AIN(I) = AMAX(IFL)
        END DO
        CALL DOUBLE (AIN(1), AOUT(1), 2*LENGTH)
        IF (IFL .EQ. 2) THEN             ! log(CF) to CF
                DO I = 1,LENGTH
                        AOUT(I) = 10.**(AIN(I)/20.)
                END DO
        ELSE IF (IFL .EQ. 3) THEN        ! Mel(CF) to CF
                DO I = 1,LENGTH
                        AOUT(I) = 1000. * (10.**(AIN(I)/20.)-1.)
                END DO
        ELSE IF (IFL.EQ.5 .OR. IFL.EQ.6) THEN
         CALL DOUBLE (AIN(1), AOUT(1), 2*LENGTH)
         IF (IFL .EQ. 5) THEN     ! log amplitude to BW
                 DO I = 1,LENGTH
                         AOUT(I) = 1. - 10.**(-AIN(I)/20.)
                 END DO
         END IF
         DO I = 1,LENGTH          ! pole magnitude to BW
                 AOUT(I) = -FS * LOG(AOUT(I)) / PI
         END DO
 ELSE IF (IFL .EQ. 8) THEN        ! log(Energy) to Energy
         DO I = 1,LENGTH
                 AOUT(I) = EXP (AIN(I)) - 30.
         END DO
 ELSE IF (IFL .EQ. 10) THEN       ! log(Pitch) to Pitch
         DO I = 1,LENGTH
                 AOUT(I) = EXP (AIN(I))
         END DO
 END IF

 RETURN

 END
```

What is claimed is:

1. A method for encoding a speech input signal, comprising the steps of:

sampling a speech signal;

defining an inverse filter polynomial corresponding to said speech signal;

finding the roots of said inverse filter polynomial;

encoding all of said roots of said inverse filter polynomial which have bandwidth greater than a threshold bandwidth to provide a first output signal;

multiplying together roots of said inverse filter polynomial which do not have a bandwidth greater than said threshold bandwidth, to produce a residual polynomial;

defining reflection coefficients corresponding to said residual polynomial;

encoding parameters corresponding to a truncated set of said reflection coefficients of said residual polynomial to provide a second output signal; and storing or transmitting said first and second output signals.

2. The method of claim 1, wherein said truncated set of said reflection coefficients consists of the first two of said reflection coefficients.

3. The method of claim 1, wherein the logarithm of respective area ratios corresponding to said respective reflection coefficients within said truncated set of said reflection coefficients is encoded.

4. The method of claim 2, wherein the logarithm of respective area ratios corresponding to said respective reflection coefficients within said truncated set of said reflection coefficients is encoded.

5. The method of claim 1, further comprising the step of:

encoding pitch and gain parameters corresponding to said speech signal.

6. The method of claim 1, wherein said bandwidth threshold is less than 700 Hertz.

7. The method of claim 1, wherein said bandwidth threshold is approximately 300 Hertz.

8. The method of claim 1, wherein the phase of each of said roots of said inverse filter polynomial is encoded as the Mel of the center frequency thereof.

9. The method of claim 1, wherein the amplitude of each of said respective roots is encoded as the logarithm thereof.

10. The method of claim 1, wherein the amplitude of each of said respective roots is encoded as a corresponding bandwidth.

11. The method of claim 1, 2, 3, 4, 5, 6, 7, 8, 9, 10, further comprising the step of programming said encoded parameters in a read-only memory.

* * * * *